US006554411B1

(12) United States Patent
Hatasa et al.

(10) Patent No.: US 6,554,411 B1
(45) Date of Patent: Apr. 29, 2003

(54) LIQUID CONTAINER AND PRINTING APPARATUS TO WHICH THE LIQUID CONTAINER IS MOUNTED

(75) Inventors: Nobuyuki Hatasa, Kawasaki (JP); Tsutomu Abe, Isehara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/654,702

(22) Filed: Sep. 1, 2000

(30) Foreign Application Priority Data

Sep. 3, 1999 (JP) ..... 11-250881

(51) Int. Cl.[7] ..... B41J 2/175
(52) U.S. Cl. ..... 347/86
(58) Field of Search ..... 347/5, 19, 85, 347/86, 87

(56) References Cited

U.S. PATENT DOCUMENTS

| | | | | |
|---|---|---|---|---|
| 4,568,954 A | * | 2/1986 | Rosback | 347/86 |
| 4,775,871 A | | 10/1988 | Abe et al. | 347/85 |
| 5,155,502 A | | 10/1992 | Kimura et al. | 347/87 |
| 5,701,995 A | | 12/1997 | Higuma et al. | 206/205 |
| 5,852,459 A | | 12/1998 | Pawlowski, Jr. et al. | 347/86 |
| 5,917,524 A | | 6/1999 | Kimura et al. | 347/86 |
| 6,065,824 A | * | 5/2000 | Bullock et al. | 347/19 |
| 6,132,036 A | * | 10/2000 | Abe et al. | 347/86 |

FOREIGN PATENT DOCUMENTS

| | | |
|---|---|---|
| DE | 27 09 730 | 9/1978 |
| EP | 791463 | 8/1997 |
| EP | 878307 | 11/1998 |
| EP | 891865 | 1/1999 |

* cited by examiner

*Primary Examiner*—Anh T. N. Vo

(57) ABSTRACT

A liquid container for retaining a liquid which is detachably attached onto a main body of a printing apparatus that conducts printing by attaching the liquid onto a print medium, the liquid container includes a convex connecting portion which communicates with the main body of the printing apparatus, and a wall formed around the connecting portion, wherein the connecting portion includes an elastic member, and a leading edge of the connecting portion projected from the wall.

15 Claims, 64 Drawing Sheets

PRELIMINARY DISCHARGE PROCESS FLOW

SUCTION RECOVERY PROCESS FLOW

LIQUID CONTAINER AND PRINTING APPARATUS TO WHICH THE LIQUID CONTAINER IS MOUNTED

BACKGROUND OF THE INVENTION

1. Field of the Invention

The present invention relates to a liquid container detachably replaceably attached to a main body of a printing apparatus for reserving a liquid (ink) used for printing in the printing apparatus and the printing apparatus onto which the liquid container is attachable, and more particularly to an ink jet printing apparatus using a large-capacity liquid container.

2. Related Background Art

Up to now, as printing apparatuses that print a print medium such as a paper, a cloth, a plastic sheet or an OHP sheet, there have been employed printing apparatuses each having a head mounted thereon, using various printing systems such as a wire dot system, a thermal printing system, a heat transfer system or an ink jet system. Among them, the printing apparatus using the ink jet system (ink jet printing apparatus) is employed as a printer which is output means of an information processing system, for example, an output terminal of a copying machine, a facsimile machine, an electronic typewriter, a word processor or a work station, or a handy printer or a portable printer equipped in a personal computer, a host computer, a disk apparatus or a video apparatus. Thus, the ink jet printing apparatus is made commodity of commercial basis.

The ink jet system is of the print system in which an ink droplet is flied from a fine discharge port defined in an ink jet head, and the ink droplet is attached onto a print medium, to thereby conduct a desired print. The ink jet head of the ink jet printing apparatus is equipped with an electromechanical converting element such as a piezo electric element which generates a pressure with application of an electric energy, means for generating a heat due to irradiation of an electromagnetic wave such as laser or an electrothermal converting element having a heating resistor to discharge the ink droplet by using the heat energy, or the like, as discharge energy generating means for generating energy for discharging an ink from the discharge port.

Recently, an improvement in computers and its software leads to the execution of a precise color image processing, and as its output terminal, a printing apparatus which can output a color image with high precision and high quality has been demanded. In the ink jet printing apparatus, an ink jet head which can discharge a plurality of liquid different in color is employed in order that the color image can be outputted, and also the density of the discharge port is heightened or the concentration of ink is changed so as to output the high-precision and high-quality image.

The above-described ink jet printing apparatus is equipped with a liquid supply container which reserves a liquid (ink) for printing and a waste liquid container which retains the ink that does not contribute to print and falls into disuse. As an example of the liquid supply container and the waste liquid container, an ink cartridge into which the liquid supply container and the waste liquid container are integrated and which is detachably replaceably attached onto a main body of the printing apparatus is shown in FIGS. 73 and 74. FIG. 73 is an exploded perspective view showing the structure of the parts of the ink cartridge, and FIG. 74 is a cross-sectional view of the ink cartridge shown in FIG. 73.

As shown in FIGS. 73 and 74, the ink cartridge has an ink reservoir chamber formed by an ink container 541 and a cap 542 joined to an opening portion of the ink container 541, and a waste ink reservoir chamber formed by the waste ink container 543 and a cap 545 joined to the waste ink container 543. The ink container 541 and the waste ink container 543 are integrally engaged with each other. The waste ink container 543 includes an absorber 544 that absorbs and retains a recovery ink therein. The ink container 541 and the cap 542, and the waste ink container 543 and the cap 545 are joined to each other by, for example, ultrasonic welding, respectively.

Two cylindrical housings 550 formed so as to surround a communication port are disposed on a face of the cap 542 of the ink container 541 which is in contact with the exterior, and a dome-shaped elastic member 556 is fitted to each opening portion of the cylindrical housings 550 by a crest member 547 attached to the housing 550 so as to cover the housing 550. Thus, each of connecting portions of the ink container 541 with the main body of the apparatus for ink communication, etc., is formed by the communication port, the housing 550, the elastic member 556 and the crest member 547. Likewise, the waste ink container 543 has a connecting portion formed on a face connected to the face where the connecting portion of the ink container 541 is formed in a state where the ink container 541 and the waste ink container 543 are engaged with each other. A wall 553 is formed around those plural connecting portions on a face where the connecting portion of the ink cartridge is formed.

In the printing apparatus that enables color print, since plural kinds of inks are employed, in order to prevent an ink cartridge that reserves an ink different in kind from an ink reserved in an ink cartridge to be intentionally equipped in the apparatus from being erroneously inserted into a connecting port at the time of replacing the ink cartridge by a fresh cartridge, mis-insertion preventing grooves 551 having a configuration different for each of the ink cartridges that reserves various kinds of inks are provided in each of the ink cartridges. In other words, the main body of the printing apparatus is equipped with rails corresponding to the mis-insertion preventing grooves 551. Therefore, even if the ink cartridge different from the ink cartridge to be intentionally connected is going to be inserted thereinto, the ink cartridge cannot be inserted.

The wall 553 is so adapted as to protect the connecting portions and the mis-insertion preventing grooves 551 so that an operator's hand is prevented from entering the connecting portions and the mis-insertion preventing grooves 551, and the height of the wall 553 is normally equal to the height of the connecting portions or higher than the connecting portions.

The ink jet printing apparatus improves in the preservativity and the water resistance of a printing material with remarkable improvements of the ink, the head, etc., and also enhances its reliability such that the printing speed is increased, etc. For that reason, up to now, the ink jet printing apparatus market is mainly the personal user market for the purpose of utilization in a home, a small-scaled office, etc. However, now, the ink jet printing apparatus market is also advancing into a business user market for the purpose of utilization in a large-scaled office.

As compared with the personal user, the business user increases the printing frequency and the number of print sheets and is also highly conscious of the running costs. Under the circumstances, in order that the replacing frequency of the ink cartridges is reduced and the rate of the container costs to the ink costs is reduced to decrease the running costs in response to the user's demands, a large-capacity ink cartridge is increasingly employed.

In the small-capacity ink cartridge, there does not arise any problem even if the user drops down the ink cartridge in error to apply an impact to the wall 553. In the large-capacity ink cartridge, because an increased capacity causes an increase in weight, an impact becomes large when the ink cartridge drops down, resulting in the large possibility that the wall 553 is destroyed by the impact such as dropping.

The wall 553 is provided with a convex portion matched with a guide groove of the main body of the printing apparatus in order to surely connect the ink cartridge to the connecting port of the main body of the printing apparatus when the ink cartridge is inserted into the main body of the printing apparatus. Also, the mechanical key mechanism such as the above-mentioned mis-insertion preventing grooves 551 is formed in the wall 553 portion. Since the convex portion and the mechanical key mechanism come in contact with the main body of the printing apparatus to execute their functions as described above, there are many cases in which they are located on the outer portion of the ink cartridge. Therefore, when the ink cartridge drops down, the impact is directly applied to the convex portion and the mechanical key mechanism, and a breakage, deformation or the like may occur in the convex portion and the mechanical key mechanism. Some precision is required for the convex portion and the mechanical key mechanism in order to achieve their functions, and if the breakage or deformation occurs in the convex portion and mechanical key mechanism, there is the possibility that their functions are lost. In this case, there may be a case in which the ink cartridge cannot be used although any problem does not exist at all as the function for retaining the ink.

In addition, recently, in order to improve the reliability and the operability of the main body of the printing apparatus with an appropriate process in accordance with the kind of ink and the amount of ink reserved in the ink cartridge, there is a case where a storage medium in which various information, setting parameters and so on are recorded is disposed in the ink cartridge. The storage medium is also frequently fitted onto the wall 553 portion. The storage medium is formed of a member manufactured through a semiconductor process, and generally low in resistance to an impact. Upon application of the impact caused by dropping, the operating failure may occur in the storage medium, and the function of the storage medium is completely lost if a stronger impact is applied to the storage medium. Similarly, in this case, there is a fear that the ink cartridge cannot be used although a sufficient ink retaining function is effective.

Up to now, there has been applied a method of preventing the occurrence of the breakage and deformation of the convex portion and the mechanical key mechanism, the operating failure of the storage medium, etc., by provision of a packaging material made of a shock absorbing material which covers the entire ink cartridge. However, the provision of the shock absorbing member causes the costs of the ink cartridge to be raised.

SUMMARY OF THE INVENTION

The present invention has been made under the above circumstances, and therefore an object of the present invention is to provide a liquid container which is high in resistance to an impact occurring when the liquid container drops down in error and a printing apparatus to which the liquid container is attachable without any increase in the manufacturing costs.

In order to achieve the above object, according to the present invention, there is provided a liquid container for retaining a liquid, which is detachably attached onto a main body of a printing apparatus that conducts printing by attaching the liquid onto a print medium, the liquid container comprising:

a convex connecting portion which communicates with the main body of the printing apparatus; and a wall formed around the connecting portion;

wherein the connecting portion includes an elastic member, and a leading edge of the connecting portion is projected from the wall.

According to the above structure, since the largest impact caused by a first contact of the liquid container with a floor when the liquid container drops down is liable to be applied to the connecting portion projected from the wall, the wall can be suppressed from being deformed or damaged by application of a large impact to the wall. In addition, since the connecting portion has the elastic member, the impact can be absorbed by the elastic deformation of the elastic member.

When the connecting portion includes a hole defined in the liquid container, a housing formed so as to surround the hole, an elastic member which is disposed within an opening portion of the housing and shuts the hole, and a crest member which is disposed so as to cover the housing and fixedly presses the elastic member within the opening portion, the impact caused by dropping is transmitted to the elastic member through the crest member and can be absorbed by the elastic deformation of the elastic member.

When the housing is in the form of a cylinder and the elastic member is in the form of a dome a diameter of which is slightly larger than an inner diameter of the housing, a force that contracts in a radial direction is exerted on the elastic member from the housing in a state where the elastic member is fixedly pressed within the housing by the crest member. With this structure, in the case where the liquid container is attached to the main body of the printing apparatus, when a needle for communication penetrates the center portion of the elastic member to open a hole, a liquid can be prevented from being leaked from a clearance between the hole and the needle. Also, even if the liquid container is removed from the main body of the printing apparatus, since the hole cut by the needle is shut by the force exerted on the elastic member from the housing, the liquid can be prevented from being leaked.

When the elastic member and the crest member are integrally molded by a bicolor mold, the number of structural members is reduced, thereby being capable of reducing the manufacturing costs.

In addition, when a concave portion or a concave portion is defined in the main body of the printing apparatus, and another convex portion or another convex portion which is engaged with (fit to) the concave portion or the convex portion in the printing apparatus main body and then slid in an engaged state so that the liquid container can be inserted into the printing apparatus main body are formed on the wall of the liquid container, in the case where the liquid container is installed in the printing apparatus main body, the liquid container can be surely guided to a position to be installed. In this situation, since the liquid container of the present invention makes it difficult to exert the impact on the wall portion when the liquid container drops down in error as described above, it is difficult that the concave portion or the convex portion defined in the wall is deformed or damaged.

Also, when a concave portion or a convex portion a pattern of which is different for each of the kinds of the liquid containers to be attached is defined in the printing apparatus main body, and another concave portion or another convex portion which is engaged with the concave portion or the convex portion in the printing apparatus main body and a pattern of which is different for each of the kinds of the liquid containers is defined in the wall of the liquid container, even if one liquid container different from another liquid container to be intentionally connected is going to be inserted into the printing apparatus main body, the one liquid container cannot be inserted into the main body, thereby being capable of preventing the mis-attaching of the liquid container. In this situation, since the liquid container of the present invention makes it difficult to exert the impact on the wall portion when the liquid container drops down in error as described above, it is difficult that the concave portion or the convex portion defined in the wall is deformed or damaged.

Further, when a storage medium and connecting means for electrically connecting the storage medium and the main body are disposed on the wall of the liquid container, and means for reading stored information in the storage medium and printing apparatus operation control means the operating contents of which are changed on the basis of the stored information are disposed in the printing apparatus main body, the storage medium is allowed to store the monitor information, the control information, the identification information, the liquid amount information or the manufacturer's information of the liquid container therein. On the basis of the contents of those information, it is possible that an alarm signal is produced, the stored information is indicated or the printing operation is stopped, thereby being capable of improving the reliability of the operation of the printing apparatus. In addition, when means for changing the stored information in the storage medium is disposed in the printing apparatus main body, the contents of the stored information in the storage medium are appropriately corrected, thereby being capable of enhancing the reliability of the stored information. In this situation, since the liquid container of the present invention makes it difficult to exert the impact on the wall portion when the liquid container drops down in error as described above, it is difficult that the storage medium disposed on the wall is damaged and also that the operating failure of the storage medium occurs due to the impact.

Still further, when a convex portion or a concave portion is defined on a side surface of the connecting portion of the liquid container, and a concave portion or a convex portion which is engaged with the convex portion and the concave portion defined on the side surface of the connecting portion is formed on the printing apparatus main body, in the case where the liquid container is installed in the printing apparatus main body, the connecting portion of the liquid container can be surely guided to a position to be installed.

Yet still further, when the connecting portion is formed in such a manner that the height of the connecting portion from the face on which the connecting portion of the liquid container is disposed is changed for each of the kinds of the liquid containers, and a connecting base is formed in such a manner that the height of the connecting base of the printing apparatus which is connected to the connecting portion is changed for each of the kinds of the liquid containers to be attached in correspondence with the height of the connecting portion, even if one liquid container different from another liquid container to be intentionally connected is going to be inserted into the printing apparatus main body, the one liquid container cannot be inserted into the main body, thereby being capable of preventing the mis-attaching of the liquid container.

Yet still further, when the connecting portion is formed in such a manner that the height of the leading edge of the connecting portion of the liquid container which is projected from the wall is changed for each of the kinds of the liquid containers, and the connecting base is formed in such a manner that the height of the connecting base of the printing apparatus which is connected to the connecting portion is changed for each of the kinds of the liquid containers to be attached in correspondence with the height of the above leading edge of the connecting portion, even if one liquid container different from another liquid container to be intentionally connected is going to be inserted into the printing apparatus main body, the one liquid container cannot be inserted into the main body, thereby being capable of preventing the mis-attaching of the liquid container.

The present invention is applicable to a liquid container that supplies a liquid to the printing apparatus main body, and a liquid container that retains the liquid that does not contribute to print, falls into disuse and is discharged from the printing apparatus main body.

BRIEF DESCRIPTION OF THE DRAWINGS

These and other objects, features and advantages of this invention will become more fully apparent from the following detailed description taken with the accompanying drawings in which.

DESCRIPTION OF THE PREFERRED EMBODIMENTS

Figure 1:
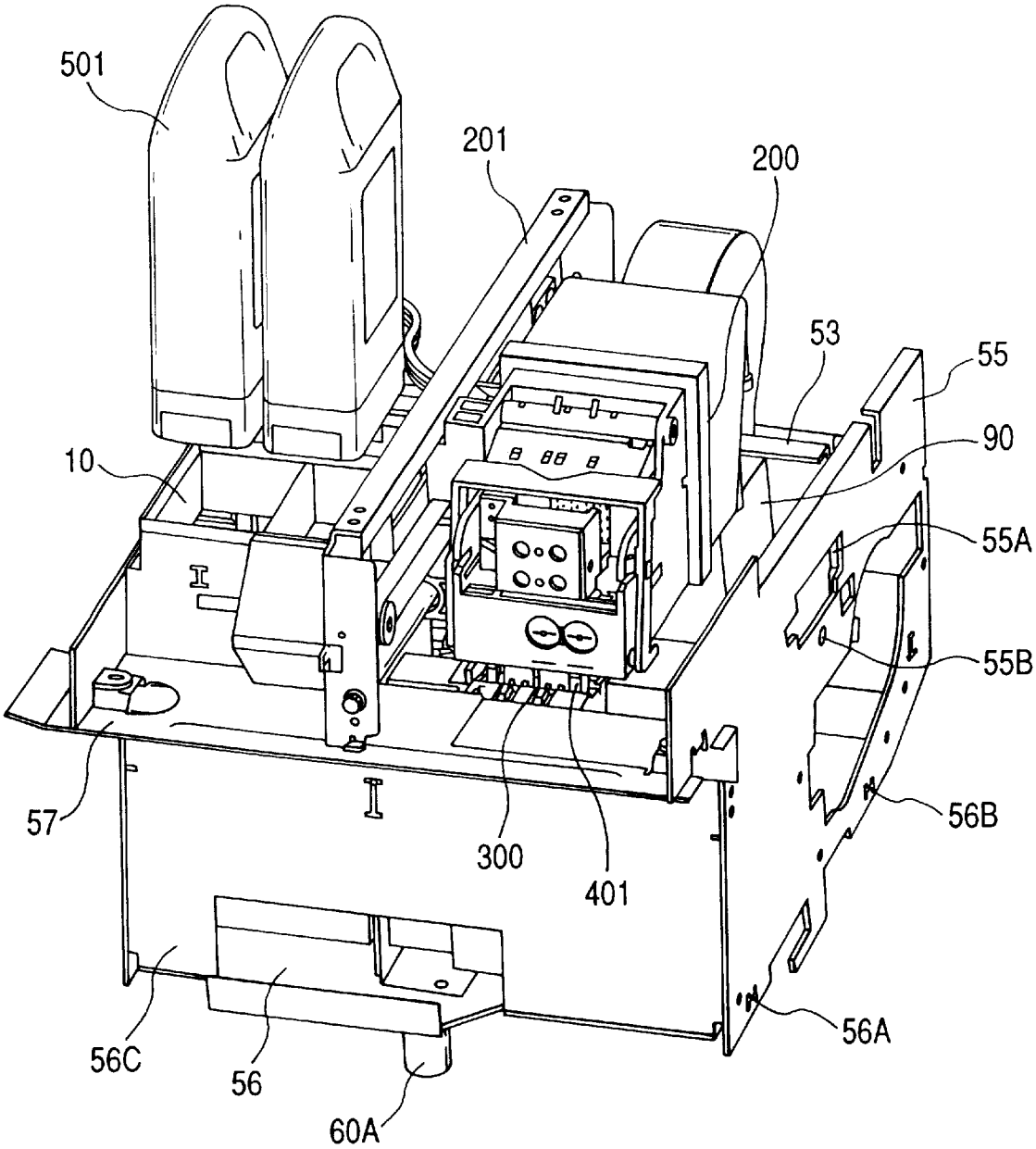
FIG. 1 is a perspective view showing the main portion of a printing apparatus in accordance with the present invention.

Hereinafter, a description will be given in more detail of preferred embodiments of the present invention with reference to the accompanying drawings.

(Entire Structure)

First, a printing apparatus to which the structure of the present invention is applied will be described. The printing apparatus has a plurality of print positions so fixed as to correspond to two kinds of printing medium such as an envelope and a continuous sheet which can be appropriately cut, and continuously prints a given print pattern. The printing apparatus is detachably attached on a printing machine main body.

The printing apparatus includes a liquid jet head unit 401 that conducts print by discharging an ink, a cartridge unit that moves the liquid jet head unit 401 to the print positions and a standby position, an ink supply system unit 10 for supplying the ink to the liquid jet head unit 401 and a main tank 501 detachably attached onto the ink supply system unit 10. The printing apparatus also includes a recovery system unit 300 for recovering a trouble such as a discharge failure of the liquid jet head unit 401, a frame unit 70 that receives the above respective units, a control board 80 that conducts the electric control of the print and a power supply unit 90.

Hereinafter, the detailed structure of the printing apparatus will be described for each of the above-described units.

(Frame Unit)

First, the frame unit 70 will be described with reference to FIGS. 1 and 2.

A bottom plate 56 is formed of a sheet metal bent in a substantially L-shape, and a plurality of right and left parallel bump portions (not shown) for holding a distance constant are disposed on the bottom portion. Positioning protrusions 56A and 56B are projected from both ends of the bottom portion, and a plurality of threading portions are defined on both ends of the bottom portion. A left side plate 54 and a right side plate 55 have positioning holes into which positioning protrusions 56A and 56B are inserted. Threading portions of the bottom plate 56 are screwed into corresponding tapped holes-up to the bump portions of the bottom plate 56 in a state where the positioning protrusions 56A and 56B are inserted into the positioning holes, to thereby assemble the left and right side plates 54 and 55 in parallel together with the bottom plate 56 as a center stay. A front surface portion 56C that erects substantially in the form of L and a rear plate 53 positioned opposite to the front surface portion 56C are screwed to each other, to thereby form an outer shell of the box-shaped printing apparatus which is opened upward.

One front cylindrical leg and two rear cylindrical legs, that is, three cylindrical legs in total are attached onto the bottom portion of the bottom plate 56 by caulking. Those legs are inserted into screw protrusions (not shown) of the printing machine main body, thereby being capable of fixedly screwing the bottom plate 56 to the printing machine main body. In addition, a slender hole (not shown) is defined in the bottom portion and associated with the front leg 60A to position the bottom plate 56 with respect to the printing machine main body.

The printing apparatus has two spaces through which two kinds of printing medium are conveyed. One of those spaces are structured as follows: An L-angle resist plate 57 is fixedly screwed so as to extend over the left and right side plates 54 and 55 above the substantially L-shaped front surface portion (rising portion) 56C. The envelope which is a printing medium of the printing machine is interposed between an upper surface of an envelope conveying belt of the printing machine main body and a lower surface of the resist plate 57 and conveyed from the left side toward the right side in FIG. 1 along an inner bending portion of the resist plate 57.

The other space is structured as follows: In FIG. 2, a position which connects a recess 54A of the center portion of the left side plate 54 and a rectangular window 55A of the right side plate 55 is a position at which a conduit that forms a conveying space of the continuous sheet is formed. Although being not shown, the conduit is located at a container of the continuous sheets and at a leading edge of the continuous sheet conveying unit on which a conveyance driving system is mounted. A positioning dowel formed at the leading edge of the conduit is inserted into a positioning hole 55B of the right side plate 55, to thereby decide the positions of the printing apparatus and the continuous sheet conveying unit, and the conduit is screwed to the left side plate 54, to thereby integrate the printing apparatus with the continuous sheet conveying unit.

(CR Frame and Cartridge Unit)

A CR frame 201 is fixedly erected from the bottom portion of the bottom plate 56 in the vicinity of the middle portion between the left and right side plates 54 and 55. Inserting holes of the CR frame 201 are defined at regular distances at the dump portions for assembling the left and right side plates 54 and 55 in parallel, and a groove 53B that regulates the CR frame 201 in a vertical direction is formed at the upper portion of the rear plate 53 and above the substantially L-shaped front surface portion (rising portion) 56C of the bottom plate 56. The groove 53B allows the CR frame 201 to erect from the bottom portion of the bottom plate 56. The indication of CR in the component names means that those components pertain to the cartridge.

A carriage 200 on which the liquid jet head unit 401 for conducting print is mounted is installed downstream side of the printing medium conveying direction at the right side of the CR frame 201 and is movable between the above-described conveying spaces of two systems.

(Ink Supply System Unit)

Figure 2:
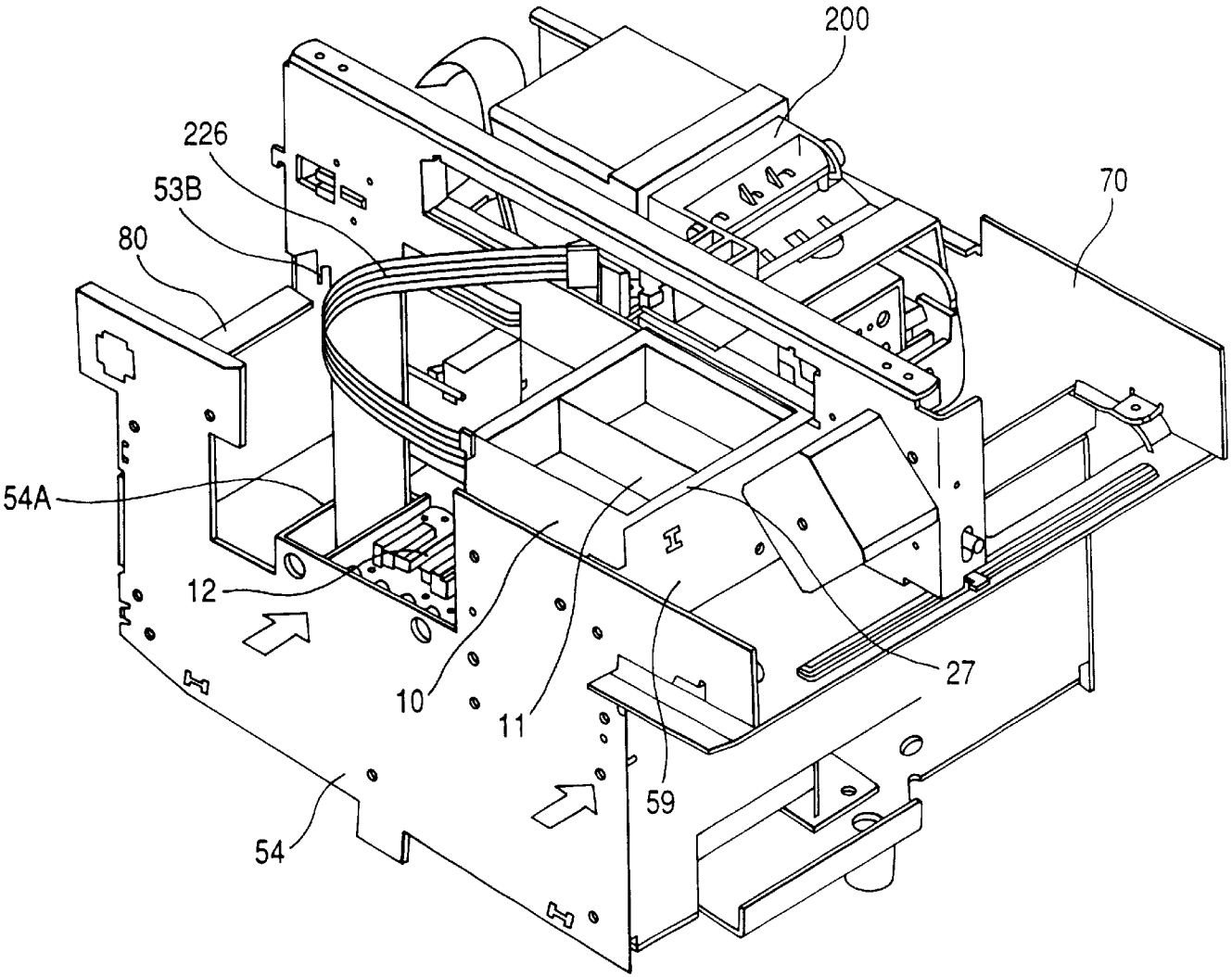
FIG. 2 is a perspective view showing the main portion of the printing apparatus in accordance with the present invention, viewed from a direction different from that in FIG. 1.

As shown in FIG. 1, an ink supply system unit 10 for supplying the ink to the liquid jet head unit 401, which receives a plurality of large-capacity main tanks 501, is disposed upstream side of the printing medium conveying direction at the left side of the CR frame 201. The ink supply system unit 10 is made up of a tank receiving portion 11 which receives the plurality of main tanks 501 and has a function of deriving the ink from the main tanks 501 to the exterior, and a sub-tank unit 12 for supplying the derived ink to the liquid jet head unit 401. The detailed structure will be described later.

(Recovery System Unit)

As shown in FIG. 1, a recovery system unit 300 for recovering the discharge trouble of the liquid jet heat unit 401 is located between the above-described two conveying spaces downstream side of the printing medium conveying direction at the right side of the CR frame 201. The recovery system unit 300 is so designed as to forcibly discharge the ink from the liquid jet head unit 401 in order to recover the discharge trouble, and a waste ink consumed at this time is expeled to a waste ink reservoir within the printing machine main body from a hole formed on a lower portion of the recovery system unit 10 which is opened toward the bottom plate 56.

(Control Board and Power Supply Unit)

A control board 80 that controls the printing operation and the system of the printing apparatus is fixed onto a back surface of the outer rear plate 53 of the box-shaped frame unit 70. Although being not shown, the control board 80 is covered with a cover in a state where a connecting connector that receives a signal from the printing machine main body is exposed from the frame unit. The cover includes a cable for transmitting a control signal of the control board 80 to the liquid jet head unit 401 within the carriage 200, and an opening for connection to the carriage 200 and the control board 80.

The power supply unit 90 is fixed onto the rear plate 53 inside of the frame unit 70 on the opposite side of the control board 80. A power supply receptacle that receives an external power supply is installed in a rectangular hole opened in the left side plate 54 and connected from the external of the frame unit. The power supply unit 90 is so wired as to supply a power supply to the control board 80 and a board on the carriage 200.

(Tank Receiving Portion)

Figure 3:
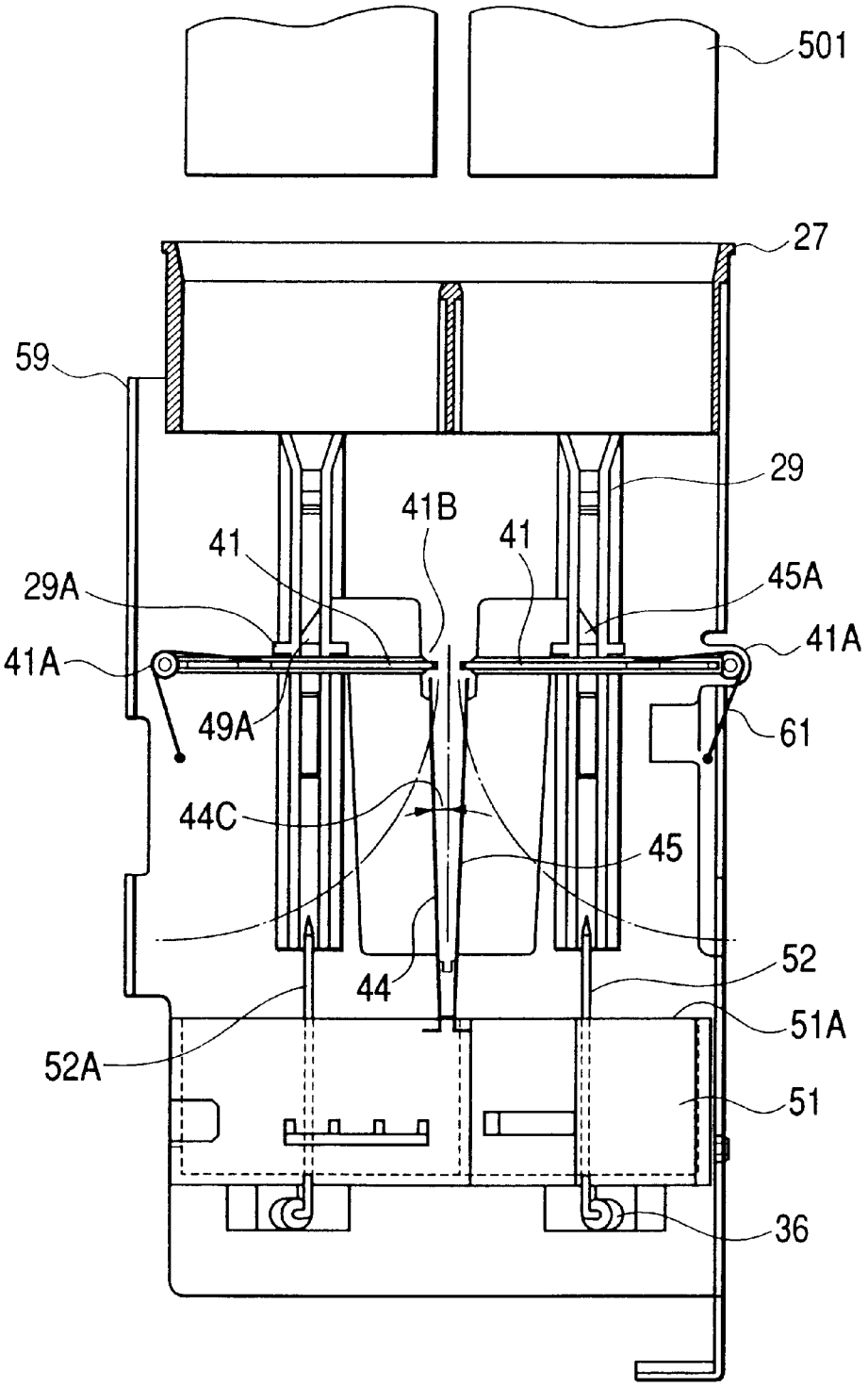
FIG. 3 is a cross-sectional view showing a main tank non-receiving state of a tank receiving portion.
Figure 4:
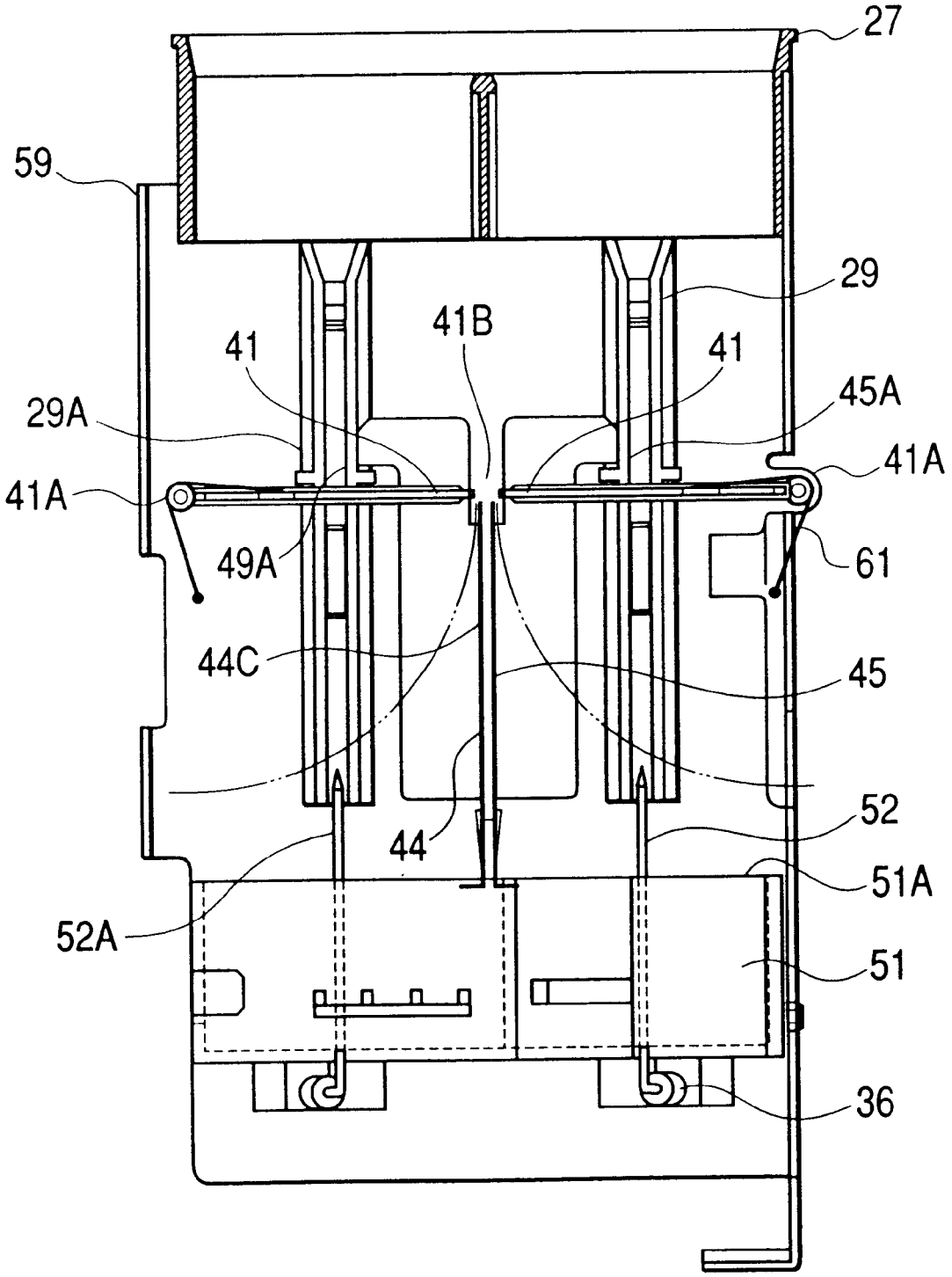
FIG. 4 is a cross-sectional view showing a main tank receivable state of the tank receiving portion shown in FIG. 3.

Subsequently, the tank receiving portion 11 will be described with reference to FIGS. 3 to 5. The tank holder 59 is a frame for receiving and holding the main tanks 501 and has an inserting port from which the main tanks 501 are inserted opened upward. One side surface of the tank receiving portion 11 is fixedly screwed to the left side plate 54 in a state where the tank receiving portion 11 is U-shaped, and one side surface of the tank receiving portion 11 is in contact with the bottom plate 56. A tank slot 27 is inserted into the upper opening portion of the tank receiving portion 11 and shaped such that the opening area of the tank slot 27 is large at the inserting port of the main tank 501 and narrower toward the receiving portion so as to approach to the cross section of each of the main tanks 501. Positioning rails 29 for positioning the main tanks 501 and tank guides (not shown) are disposed below the tank slot 27 so as to nip the plurality of main tanks 501 therebetween in an opposed state. A rib 524 (see FIG. 5) formed on one shorter side of the inserting cross-section of each of the main tanks 501 and extending along the inserting direction is inserted into the groove of the positioning rail 29, to thereby position one side of each of the main tanks 501. Other sides are positioned so as to nip the shorter sides therebetween to decide the inserting position.

A needle base 51 constitutes a receiving bottom 51A of each of the main tanks 501, and hollow needles 52 which are ink deriving ports are fixed onto the receiving bottom 51A so as to be directed vertically upward. Each of the hollow needles 52 is a metal tube having a sharp tip and a side with holes. The hollow needles 52 are fixed by an ink detection plate (not shown) in a state where the half of the straight portion of the hollow needle 52 is embedded in the ink detection plate, and two hollow needles 52 are disposed for one of the main tanks 501.

Although will be described later, communicating ports are formed in the bottom portion of each of the main tanks 501 at positions which can be opposed to the hollow needles 52, and the communicating ports are shut by rubber stopcocks 513. At the time of installing each of the main tanks 501, when the bottom portion of the main tank 501 reaches the receiving bottom 51A, each of the hollow needles 52 penetrates the rubber stopcocks 513 that shuts the communicating port of the main tank 501, as a result of which the ink within the main tank 501 can be derived to the external through the hollow needle 52 (ink supply system unit which will be described later). One set of communicating port and hollow needle 52 serves as an ink deriving port, and the other set of communicating port and hollow needle 52 forms a flow path that returns an air to the main tank 501 and functions to smooth the air-liquid exchange in the main tank 501. One end of the above-described ink detection plate is electrically connected to the control board 80 by a conductor. A current value between those two hollow needles 52 the tip of which is exposed to the interior of the main tank 501 is measured through the ink detection plate, thereby being capable of detecting the presence/absence of the ink within the main tank 501.

Danger preventing doors 41 of the same number as that of the main tanks 501 for protecting an operator from being injured by the tip portions of the hollow needles 52 are disposed in the vicinity of the center of the tank receiving portion 11.

First, a state in which each of the main tanks 501 is not installed in the tank receiving portion 11 will be described with reference to FIG. 3.

Each of the danger preventing doors 41 has a rotating center 41A on the side portion of the tank receiving portion 11 and is urged toward a direction of the tank inserting port by a torsion coil spring 61. Then, since the rotation caused by the urging force is stopped by a convex portion 29A of each of the positioning rails 29, one end of the rotating range of the danger preventing doors 41 is regulated at a posture where its posture is substantially in a horizontal state. Stoppers 44 and 45 for regulating the open/close of the danger preventing doors 41 are disposed below the free ends 41B of the danger preventing doors 41. The stoppers 44 and 45 are symmetrical with each other and rotatably disposed. The rotating centers of those stoppers 44 and 45 are positioned below a portion of a clearance between two main tanks 501 when those main tanks 501 are installed in the printing apparatus. The stoppers 44 and 45 are fixed by inserting supporting point arms into two sides of the tank holder 59 and sloped with an angle 44C which is slightly inclined with respect to a right angle so that the upper one end is positioned engageably with the free end within the rotating radius of the danger protecting door 41.

End portions 44A and 45A of the stoppers 44 and 45 at the positioning rail side enter the groove portions of the rails to keep their posture in a state where the main tanks 501 are not installed in the printing apparatus. In this state, even if the danger preventing doors 41 are pushed down, the rotation of the free end of the danger preventing doors 41 is stopped by the upper portions of the stoppers 44 and 45, and the danger preventing doors 41 is opened.

When the insertion of each of the main tanks 501 starts, the rib of the main tank 501 pushes away the end portions 44A and 45A of the stoppers 44 and 45 that enter the positioning rails. As shown in FIG. 4, the inclinations of the stoppers 44 and 45 become substantially right angle by pushing away the stoppers 44 and 45, as a result of which, because the stoppers 44 and 45 go out of the rotating radius of the free end of the danger protecting door 41, the door 41 becomes rotatable downward. Accordingly, the main tank 501 is further inserted toward the receiving bottom without being obstructed by the danger protecting door 41.

[Sub-tank Unit]

(Outline of Ink Supply System Flow Path)

Subsequently, a flow path through which the ink is supplied from the main tanks 501 to the liquid jet head unit 401 and its structure will be described with reference to FIGS. 51 to 54.

Figure 51:
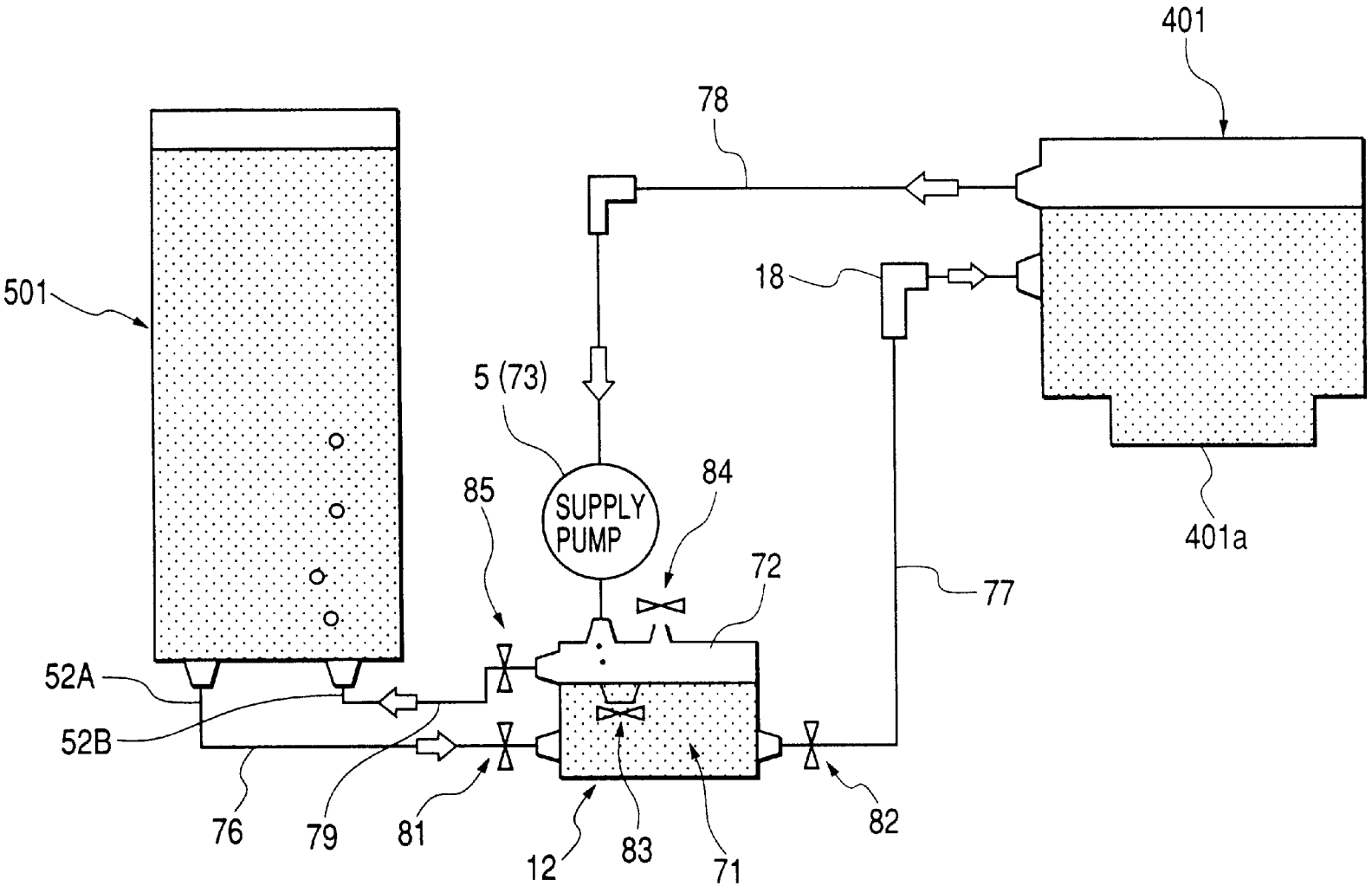
FIG. 51 is a block diagram showing an ink supply system flow path used in the printing apparatus in accordance with an embodiment of the present invention.

In order to give a negative pressure caused by a water head difference to the ink within the liquid jet head unit 401 so that the meniscus on a nozzle surface 401*a* of the liquid jet (ejection) head unit 401 is prevented from being damaged by pressurization, a sub-tank unit 12 is located at a position lower in level than the nozzle surface 401*a* in a flow path extending between each of the main tanks 501 and the liquid jet head unit 401 (refer to FIG. 51). Also, pressure generating means 5 (73) for giving a negative pressure to a common liquid chamber of the liquid jet head unit 401 is connected to the liquid jet head unit 401. The sub-tank unit 12, the liquid jet head unit 401 and the pressure generating means 5 are coupled to each other through rubber joints and tubes.

Figure 52:
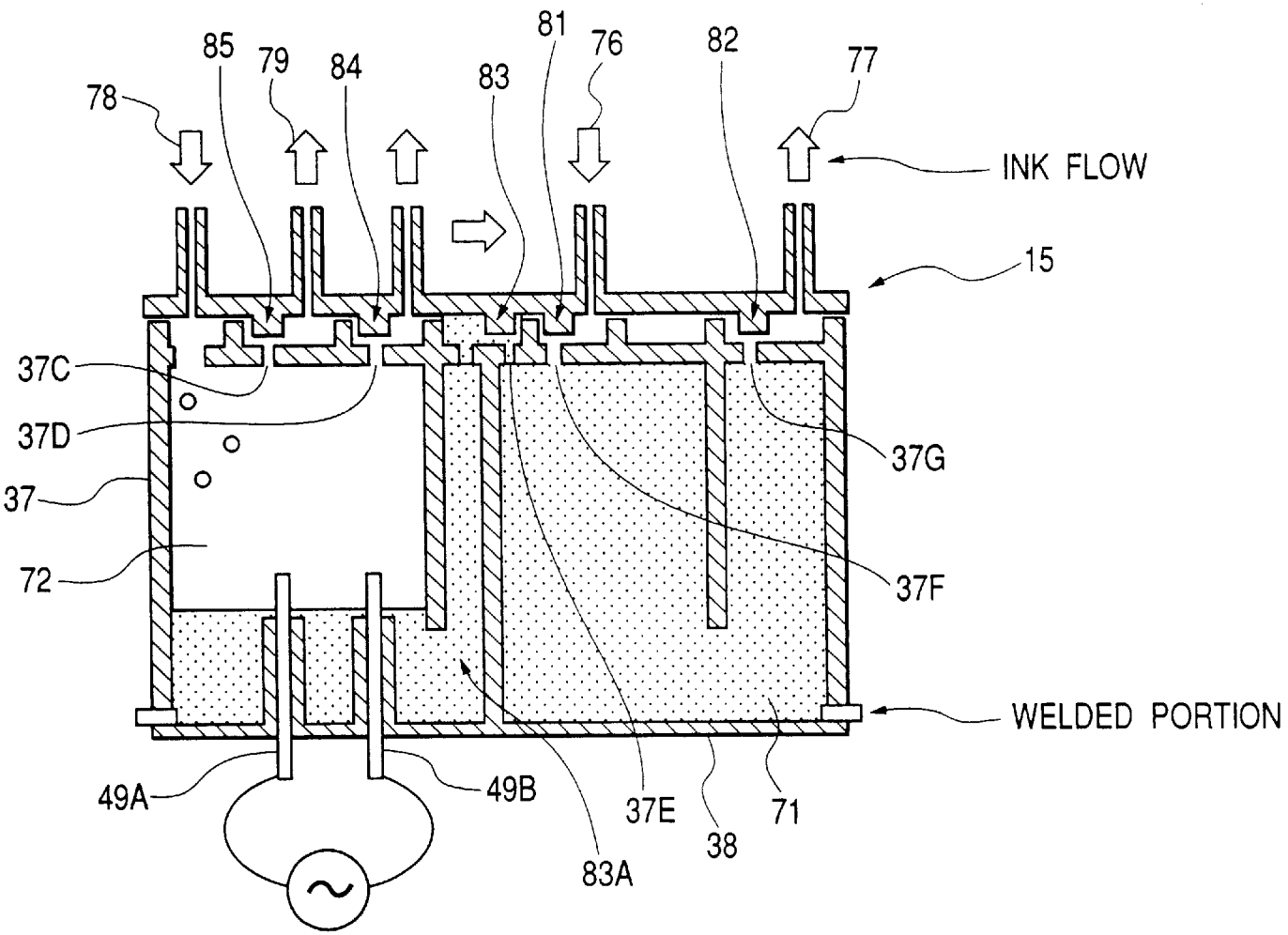
FIG. 52 is a block diagram showing a valve switch mechanism in the ink supply system used in the printing apparatus in accordance with the embodiment of the present invention.

As shown in FIG. 52, the sub-tank unit 12 includes a sub-tank base 37 and a sub-tank cover 38 which form a plurality of cells. The sub-tank unit 12 is roughly made up of a first cell 71 (hereinafter referred to as "water head difference generating chamber") for generating a water head difference, a second cell 72 (hereinafter referred to as "full (fill-up) detection chamber") which is provided with an electrode for detecting that the liquid jet head unit 401 is full of the ink, pressure generating means 73 for generating a suction negative pressure, and five kinds of valves openably and closeably disposed on the ink entrance ports of the respective cells. The flow path is changed by the combination of the open/close states of the respective valves, to thereby realize the various modes pertaining to the ink supply.

In other words, the ink derived from the main tank 501 by the first hollow needle 52A is temporarily reserved in the water head difference generating cell 71 through a supply valve 81 by a needle joint 36 which is connected to each of the needle (refer to FIG. 3) and by a first supply tube 76. A print valve 82 is disposed on the ink deriving port of the water head difference generating chamber 71, and the flow path is directed vertically upward through the print tube 77, and an ink flow direction is changed to a carriage moving direction at a joint portion (not shown) where a plurality of rubber joints-L18 having an L-shaped flow path are disposed at substantially the same level as that of the carriage 200. Further, the flow path is connected to a tube extending from the carriage 200, to thereby supply the ink to the liquid jet head unit 401 (ink circulation at the carriage 200 and the liquid jet head unit 401 will be described later).

The tube coupled to the upper portion of the liquid jet head unit 401 for extracting a bubble pool from the common liquid chamber of the liquid jet head unit 401 is returned to the joint portion (not shown) again and connected to the pressure generating means 73 from the suction tube 78 directed vertically downward through the rubber joint-L.

The pressure generating means 73 generates a negative pressure by driving a pump and produces a negative pressure in the common liquid chamber of the liquid jet head unit 401, to thereby draw out the ink in the main tank 501 at the most upstream side of the ink flow path and supply the ink to the liquid jet head unit 401. The structure will be described later.

The flow path back side (discharge (expel) side) of the pressure generating means 73 is coupled to the full detection chamber 72. If the above coupling port is a flow-in port of the full detection chamber 72, there are three discharge ports. A first discharge port is a first discharge port connected to the water head difference generating chamber 71 through a communication valve 83, a second discharge port is an atmosphere valve 84 that conducts atmosphere release, and the communication valve 83 and the atmosphere valve 84 are released to generate a water head difference between the nozzle surface of the liquid jet head unit 401 and the liquid surface of the sub-tank unit 12. A third discharge port is an air-liquid exchange valve 85 and its extension reaches the main tank 501 through the second hollow needle 52B in the rear of a circulation tube 79. The second hollow needle 52B is mainly employed for air-liquid exchange within the main tank 501 by circulating the air.

A plurality of sub-tank units 12 are disposed in each of the plural main tanks 501 that supplies the ink to each of the plural liquid jet head units 401, independently.

(Pressure Generating Portion)

Figure 53:
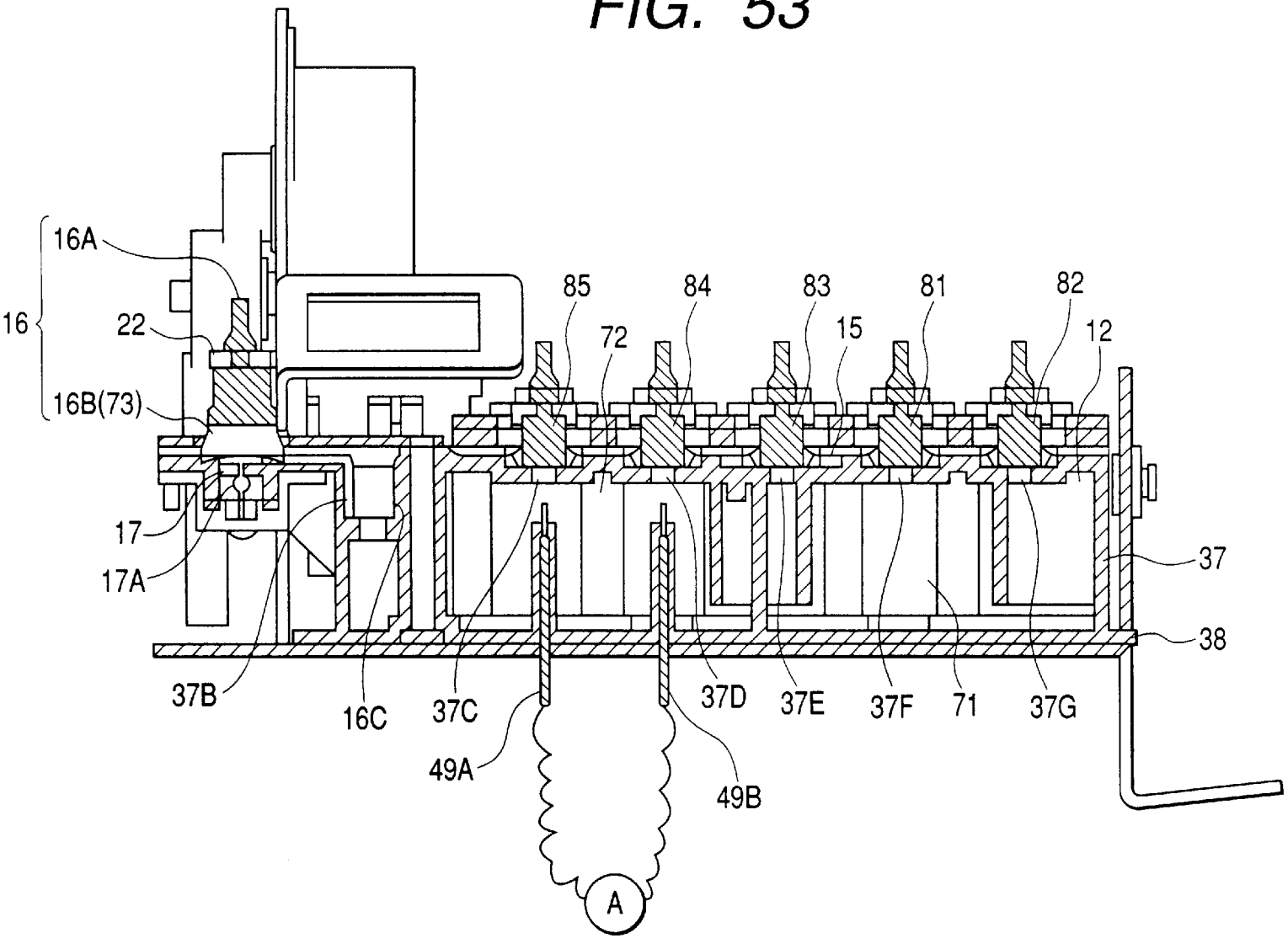
FIG. 53 is a cross-sectional view showing the structure of a sub-tank in the ink supply system used in the printing apparatus in accordance with the embodiment of the present invention.
Figure 54:
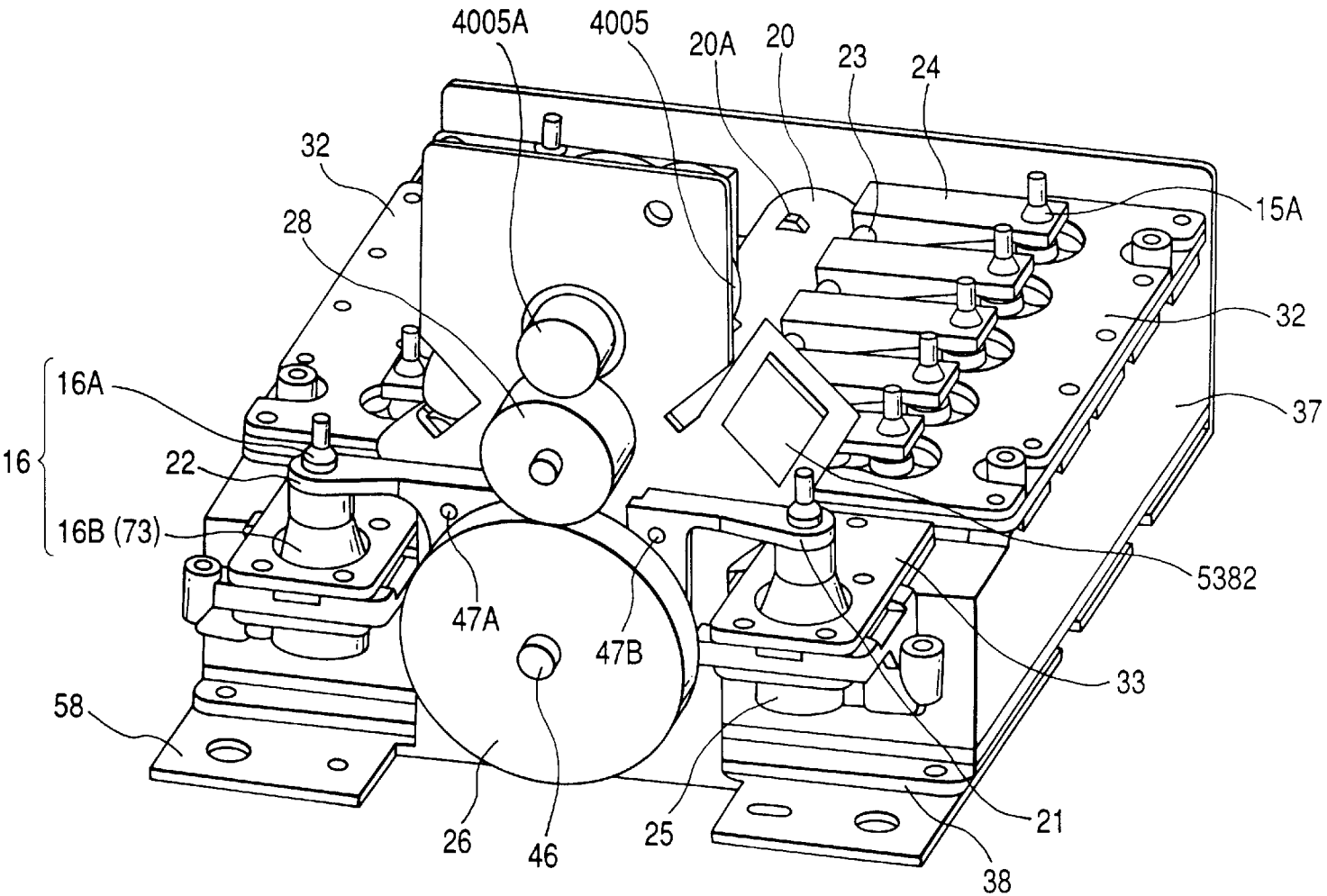
FIG. 54 is a perspective view showing the structure of the sub-tank in the ink supply system used in the printing apparatus in accordance with the embodiment of the present invention.

Subsequently, the above-described pressure generating means will be described with reference to FIGS. 53 and 54.

Reference numeral 4005 denotes a supply motor which is screwed to a sub-tank holder 58, and the normal rotation of the supply motor 4005 allows an eccentric groove cam within a pump cam 26 while it is being decelerated by a pinion gear 4005A, an idler gear 28 and the outer peripheral gear of the pump cam 26 which constitute a gear train.

A pump lever L22 and a pump lever R21 are disposed at symmetric positions with respect to the above gear train, and both of the pump lever L22 and the pump lever R21 are rotatable with pump lever shafts 47A and 47B fixed to the sub-tank holder 58 through rotation holes formed substantially in the center of those pump levers 21 and 22 by caulking as rotating axes, respectively. One ends of the pump levers L and R are slidable in the eccentric groove cam through a roller (not shown), and one revolution of the pump cam 26 is converted into the reciprocating motion of the other ends of the pump levers L and R.

The other end of each of those pump levers L and R grips a round knob 16A of a pump rubber 16 by its thin tip groove. The pump rubber 16 is made up of the round knob 16A disposed in the center thereof, a bowl-shaped thin cylinder portion 16B and a cylindrical portion 16C with a bottom. The bowl-shaped cylinder portion 16B forms a pressure generating chamber by a round spot facing (not shown) of the sub-tank base 37. A bevel valve 17 having a bevel at the pressure generating chamber side is fixed to the center hole of the round spot facing by a stopper 17A. The ink flow path is appropriately opened at a bevel inner diameter position of the round spot facing. A cell is further formed by an L-joint 25 at the above opening side (an opposite side of the bevel) and connected with a suction tube 78 extending from the liquid jet head unit 401.

The round spot facing further includes a groove 37B connected to the full detection chamber 72, and the circumstance of a thin cylindrical portion 16C with a bottom of the pump rubber 16 is sealed by the cylindrical inlet of the sub-tank base 37, and the tip of the groove is also closed. Since the pump rubber 16 is sandwiched by the pump plate 33, the sub-tank base 37 and the L-joint 25, they are screwed to fix the bowl-shaped cylinder portion 16B in a sealed state.

It is assumed that the pump cam 26 is half rotated by driving the supply motor 4005, and the pump levers L and R move (normal movement) in a direction of crushing the interior of the bowl-shaped cylinder 16B through the round knob 16A. Because a pressure raised in the interior of the bowl-shaped cylinder 16B is also applied to the bevel valve 17, the opening below the bevel looks for another escape way without communicating with the atmosphere. Because the cylindrical portion 16C with a bottom which shuts the tip of the groove 37B is thin, the rubber falls down toward the inside because the outside is high in pressure and the inside is low in pressure, and the pressurized gas within the bowl-shaped cylinder 16B is discharged to the full detection chamber 72.

Subsequently, it is assumed that the pump levers L and R move (backward movement) in a direction of expanding the bowl-shaped cylinder 16B due to the remaining half rotation of the pump cam 26. A negative pressure is produced in the interior of the cylinder. The inside of the cylindrical portion 16C with a bottom of the pump rubber is of the atmosphere, the outer groove 37B is of the negative pressure, and the tip of the groove 37B is in a sealed state. The negative pressure in the interior of the cylinder leads the bevel valve 17 to a release state due to the atmospheric pressure in the cell of the L-joint 25. As a result, the negative pressure in the interior of the cylinder sucks the common liquid chamber direction of the liquid jet head unit 401.

In the above way, the continuous rotation of the pump cam 26 allows the negative pressure in the interior of the liquid jet head unit 401 to increase.

(Change of Flow Path)

In this embodiment, the flow path of the ink supply system is changed due to a change in the open/close states of the five kinds of valves, to thereby realize various functions.

The upper portion of the sub-tank base 37 has five grooves that form flow paths and open/close holes 37C, 37D, 37E, 37F and 37G which are opened in the respective grooves, respectively. The grooves have members which cover the opening portion to form the flow paths and dowels that shut the five open/close holes, and the open/close of the plural valves are realized by a multi-valve rubber 15 which is formed of a single rubber member rich in sealing property and elasticity and having a vertically movable diaphragm portion.

The multi-valve rubber 15 is preferably made of chlorinated butyl rubber low in gas permeability and excellent in ink resistance.

Thick-tip protrusions 15A that move the dowels vertically are disposed outside of the flow path of the diaphragm in the center of which the dowels that shut the open/close holes are disposed, respectively, and one end of each the swingable valve lever 24 grips each the protrusion 15A in an interlocking manner. The number of valve levers 24 is identical with that of the open/close holes, and the valve levers 24 are arranged in a rotating direction where the open/close holes of the sub-tank base 37 are arranged. The fulcrum of each the valve lever 24 is formed by the lever arm 23, and the sub-tank cover 38, the sub-tank base 37, the multi-valve rubber 15, the lever arm 23 and a lever spring (not shown) are fastened together with the sub-tank plate 32 by a continuous thread so as to be integrally fixed together. The dowel of the multi-valve rubber 15 is so shaped as to shut the open/close hole in a natural configuration. The lever spring (not shown) fastened together with other members is urged in a direction of shutting the open/close direction.

The arranging position of the valve levers 24 are arranged symmetrically inside of the respective two sub-tanks where those two sub-tanks are arranged. The valve levers 24 are uniformly bent downward in the form of L at the rotating fulcrums and have sliding force points at the other ends (not shown). The center of the arrangement of two-line sliding force points is the center of the above pump cam. A valve shaft 46 which is interlocked with the pump cam having the center hole of the D-cut is pivotally supported by the sub-tank holder 58 in parallel with the arrangement of the sub-tank units 12. The valve shaft 46 is coaxially rotatably installed with a timing drum 20 with a one-way clutch. The timing drum 20 is formed with a protrusion 20A that pushes the respective sliding force points of the valve levers 24 in accordance with a required rotation angle. When the protrusion 20A pushes the sliding force point of the valve lever 24, another end of the valve lever 24 operates to open the open/close hole of the sub-tank base 37. If no protrusion 20A is provided, the open/close hole is left close.

The rotation of the timing drum 20 is conducted by the reverse rotation of the supply motor 4005. The supply motor 4005 is formed of a pulse motor and can stop at a required rotation angle. That is, since the one-way clutch built in the timing drum 20 is rotated in association with the reverse rotation of the motor 4005 when the motor 4005 is reversely rotated, the pumping operation is conducted during the open/close operation of the valve. However, when the angle of the timing drum 20 and the state of the valve is decided, if the motor 4005 is normally rotated as occasion demands the negative pressure generating operation due to the pump is conducted without changing the flow path.

Also, a light shield plate (not shown) for indicating a reference position (angle) is projected from the timing drum 20. The reference position is recognized by a photosensor 5382 fixed to the sub-tank holder 58, and the rotation angle of the timing drum 20 is operated by the number of steps corresponding to the required angle from the reference position, to thereby realize various flow paths.

(State of Flow Path and its Function)

Subsequently, the states of the flow path which is realized by the combination of the open/close states of the valves and their functions will be described. The functions include five kinds of "supply 1", "supply 2", "print", "circulation" and "exchange".

It is assumed that the combination at the left side when being viewed from the envelope conveying side is "supply 1", and the respective parts are the main tank 501(L), the sub-tank unit 12(L) (the unit inner pressure generating portion 73(L)) and the liquid jet head unit 401(L), and the valve train is 81(L) to 85(L). Also, it is assumed that the combination at the right side is "supply 2", and the respective parts are the main tank 501(R), the sub-tank unit 12(R) (the unit inner pressure generating portion 73(R)) and the liquid jet head unit 401 (R), and the valve train is 81(R) to 85(R).

In the "supply 1" which is the first combination, the opened valves are 81(L), 82(L), 85(L) and 85(R) whereas the closed valves are 83(L), 84(L), 81(R), 82(R), 83(R) and 84(R). The negative pressure generated by the pressure generating portion 73L sucks the ink from the common liquid chamber of the upstream-side liquid jet head unit 401(L), the water head difference generating chamber 71(L) and the main tank 501(L) in the stated order and in the reverse order. In this situation, it is needless to say that a cap that tightly closes the nozzle surface is required in order to prevent the meniscus on the nozzle surface of the liquid jet head unit 401(L) from being destroyed. After the ink within the main tank 501(L) reaches the pressure generating portion 73(L), the ink reaches the full detection chamber 72(L) having the full detecting means therein by the discharge force of the cylinder.

The full detecting means allows a current to flow between two electrodes 49A and 49B which are projected from the sub-tank cover and measures a resistance, to thereby detect that the full detection chamber is full of the ink. Two deriving port atmosphere valve 84(L) and air-liquid exchange valve 85(L) from the full detection chamber are the open/close holes formed above the electrodes 49A and 49B which stop the rotation of the motor to suspend the more suction of the ink. The remaining deriving port communication valve 83(L) is a flow path communicating with the water head difference generating chamber 71(L), and its inlet 83A is positioned below the exposed portion of the above electrodes.

It is apparent that the close of the valve 81(R) does not allow the ink to be supplied to the liquid jet head unit 401(R) side in this mode.

In the "supply 2", the opened valves are 85(L), 81(R), 82(R) and 85(R) whereas the closed valves are 81(L), 82(L), 83(L), 84(L), 83(R) and 84(R). As described in the "supply 1", the ink is supplied to the liquid jet head unit 401(R), but the ink is not supplied to the liquid jet head unit 401(L).

In the "print", the opened valves are 82(L), 83(L), 84(L), 82(R), 83(R) and 84(R) whereas the closed valves are 81(L), 85(L), 81(R) and 85(R). This ink supply system realizes the print state of both the liquid jet head units 401. The supply of the ink from the main tank to the sub-tank is cut off. The atmosphere valves 84(L) and 84(R) are opened into the atmosphere release state. The open of the communication valves 83(L) and 83(R) renders the ink in the water head difference generating chamber and the ink in the full detection chamber communicative, and when the full detection chamber is full of the ink, the ink surface in the full detection chamber becomes a reference of the water head difference.

In the "circulation", the opened valves are 82(L), 83(L), 82(R) and 83(R) whereas the closed valves are 81(L), 84(L), 85(L), 81(R), 84(R) and 85(R). The common liquid chamber of the liquid jet head unit 401 and the sub-tank unit conduct the ink circulation for each of the head units 401, independently. Similarly, in this case, a cap tightly closes the nozzle surface in order to prevent the orifice from being destroyed.

In the "exchange", the valves are not opened at all, and all the valves are closed. In the exchange of the ink tank, all the valves are closed, and ink drop due to the water head difference in the respective tubes is prevented.

[Carriage]

Subsequently, the structure of the carriage 200 will be described in more detail.

(Carriage Retaining Frame)

Figure 6:
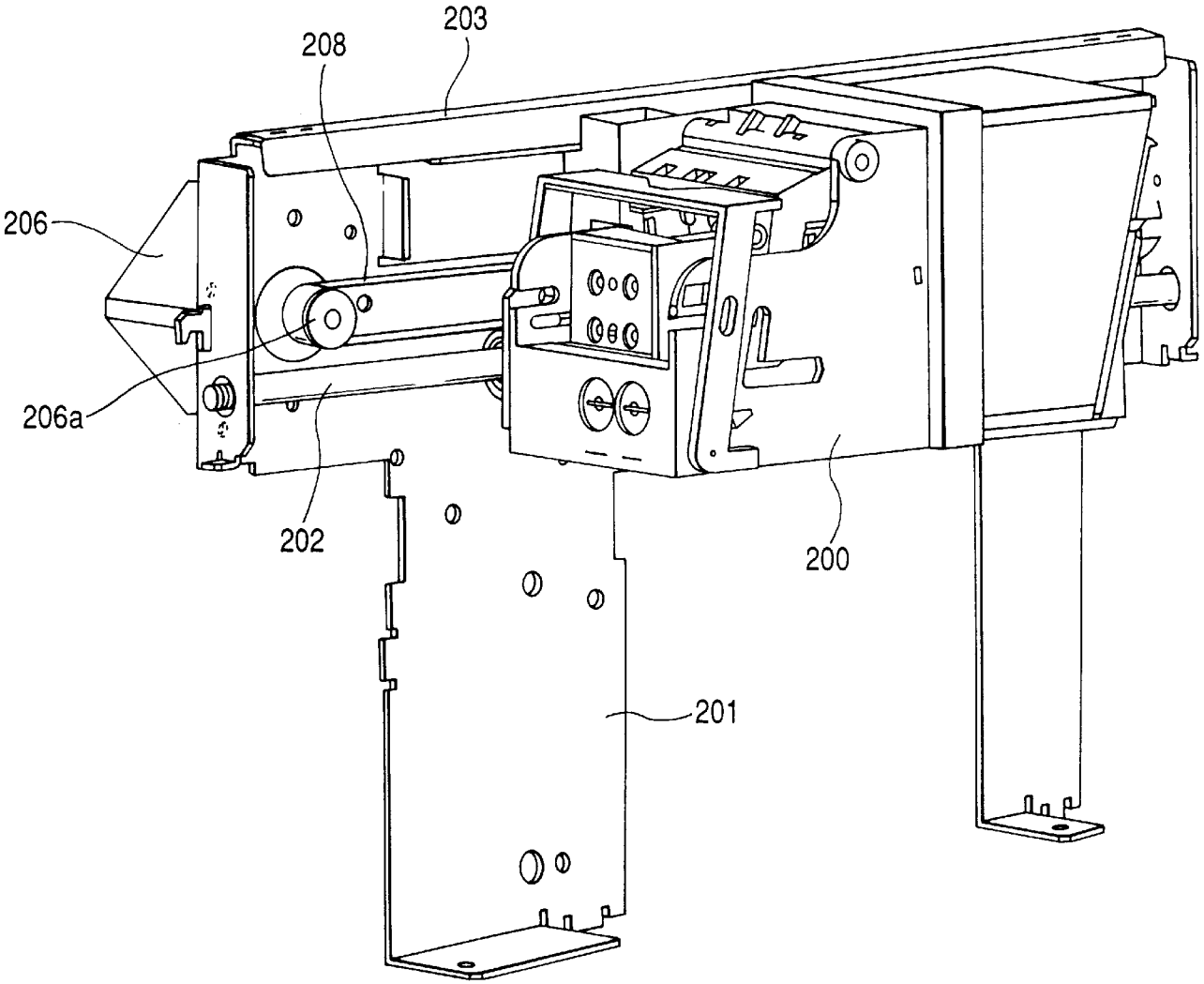
FIG. 6 is a perspective view showing a cartridge unit.
Figure 7:
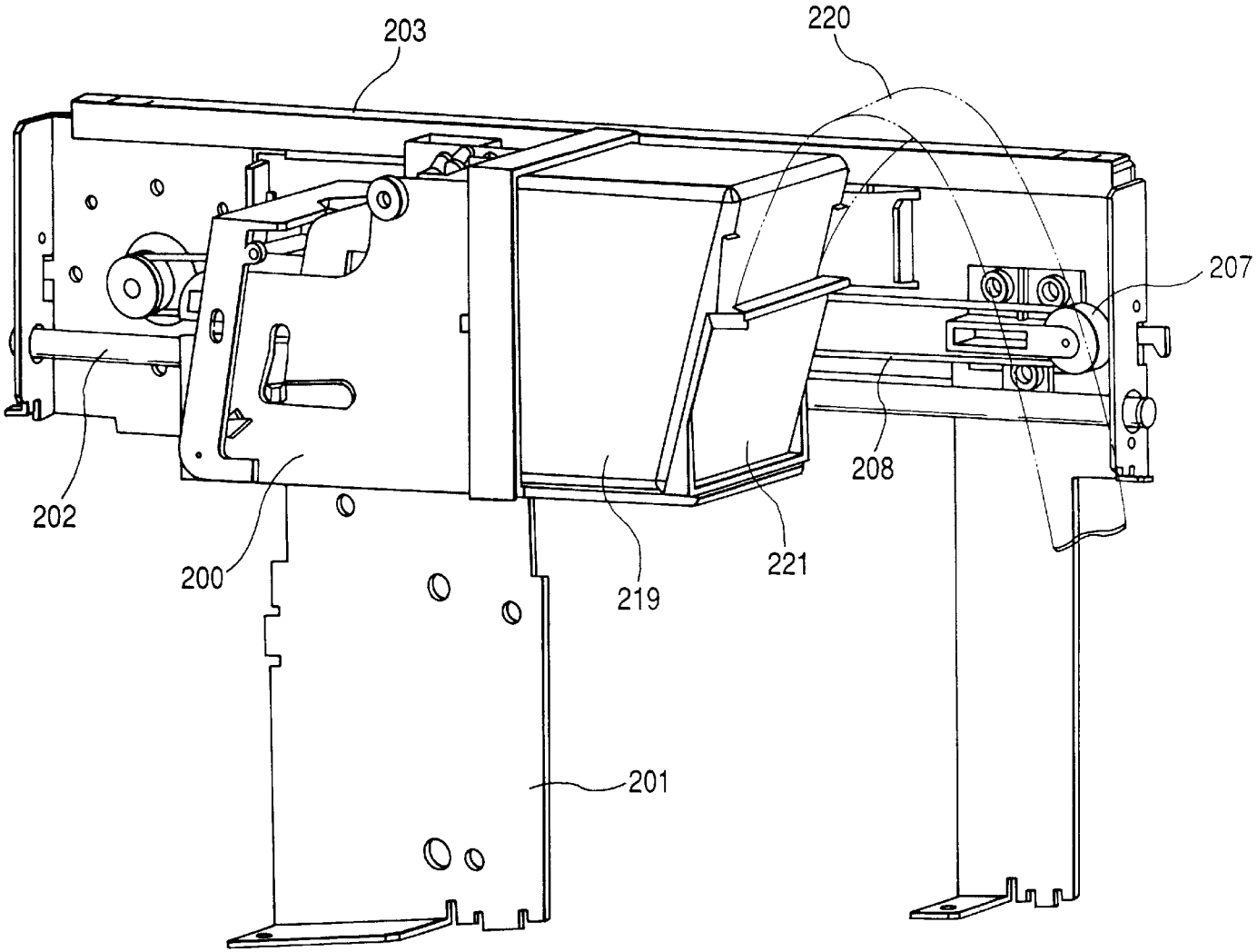
FIG. 7 is a perspective view showing the cartridge unit viewed from a direction different from that in FIG. 6.

The printing apparatus according to the present invention includes the carriage 200 that detachably retains the liquid jet head unit 401. As shown in FIGS. 6 and 7, the carriage 200 is slidably supported by a CR shaft 202 and a guide rail 203 both end portions of which are fixed to a CR frame 201 and which are arranged in parallel with each other in a direction which is orthogonal to the conveying direction of the envelope and the continuous sheets and in parallel with the nozzle train of the liquid jet head unit 401 mounted on the carriage 200. Also, the carriage 200 is supported in such a posture that the nozzle surface 401*a* of the liquid jet head unit 401 becomes substantially in parallel with the print surface of the printing medium (envelope and continuous sheet) when the liquid jet head unit 401 is mounted on the carriage 200.

Figure 8:
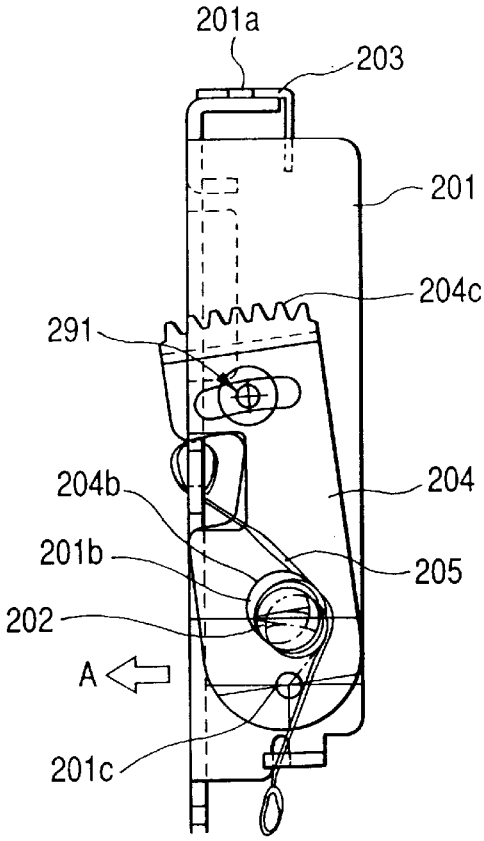
FIG. 8 is a front view showing a coupling state of a CR frame, a CR gap plate, etc.

As shown in FIG. 8, the guide rail 203 is formed of a thin sheet metal bent in an L-shape and attached to the upper bent portion of the CR frame 201. The guide rail 203 is positioned by two embosses 201*a* of the CR frame 201 and two holes of the guide rail 203 and fixed to the CR frame 201 by two vises.

Figure 9:
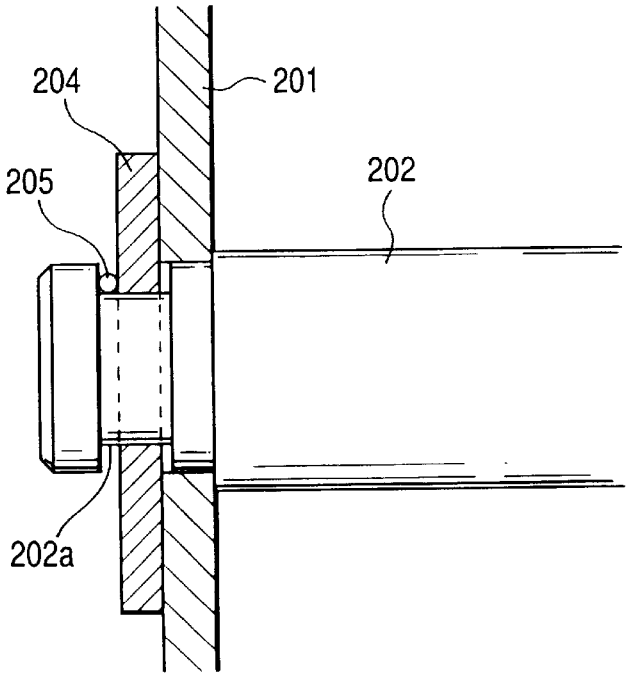
FIG. 9 is an enlarged cross-sectional view showing a coupling state of the CR frame, the CR gap plate, etc.

The CR frame 201 is bent at the front and rear portions and has a slot 201*b* for fixing the CR shaft 202. In addition, as shown in FIGS. 8 and 9, CR gap plates 204 each formed of a sheet metal are attached to the front and rear portions of the CR shaft 202 for adjustment of the position (paper-interval distance) of the CR shaft 202 in the heightwise direction. Each of the CR gap plates 204 has a hole into which an emboss 201*c* disposed on the CR frame 201 is inserted and is rotatable around the emboss 201*c*. A vis 291 fixes the upper portion of the CR gap plate 204 to the CR frame 201. A slot 204*b* is defined in the vicinity of the center of the CR gap plate 204, and the CR shaft 202 penetrates the slot 204*b* and the slot 201*b* of the CR frame 201. Therefore, the CR shaft 202 inserted into both of the slots 204*b* and 201*b* moves vertically with the rotation of the CR gap plate 204. Also, gear teeth 204*c* are disposed on the upper portion of the CR gap plate 204. The teeth 204*c* is meshed with teeth of a jig not shown, and when the jig is operated, the CR gap plate 204 rotates about which the CR shaft 202 moves vertically to adjust the position of the CR shaft 202 in the heightwise direction (paper-interval distance).

In addition, the front and rear portions of the CR frame 201 are bent in the form of L, from which a bar-shaped CR shaft lock spring 205 is hung. The CR shaft 202 is positioned in the center of the CR shaft lock spring 205, and the CR shaft 202 is always urged in one direction (indicated by an arrow A) by the CR shaft lock spring 205. As a result, the CR shaft 202 is fixed without shaking with respect to the CR frame 201.

Also, as shown in FIG. 9, a groove 202*a* is cut in one end portion of the CR shaft 202, and since the CR shaft lock spring 205 is inserted into the groove 202*a*, there is no case in which the CR shaft 202 is drawn in the thrust direction (axial direction).

Further, as shown in FIGS. 6 and 7, the carriage 200 is coupled to a part of a CR belt 208 put between a CR drive pulley 206*a* rotationally driven by a CR motor 206 fixed onto the CR frame 201 and an idler pulley 207 slidably movable in a parallel with the CR shaft 202 and rotatably fixed on the CR frame 201 by two vises. The CR belt 208 is rotated by driving the CR motor 206, and the carriage 200 is reciprocated in a direction along the CR shaft 202 and the guide rail 203.

Although will be additionally described in the item of recovery system unit, the recovery system unit 300 is attached to the CR frame 201, and the structure is made so that a variation of a distance between the liquid jet head unit 401 mounted on the carriage 200 and the recovery system unit 300 becomes as small as possible.

(Carriage Stop Position)

Figure 10:
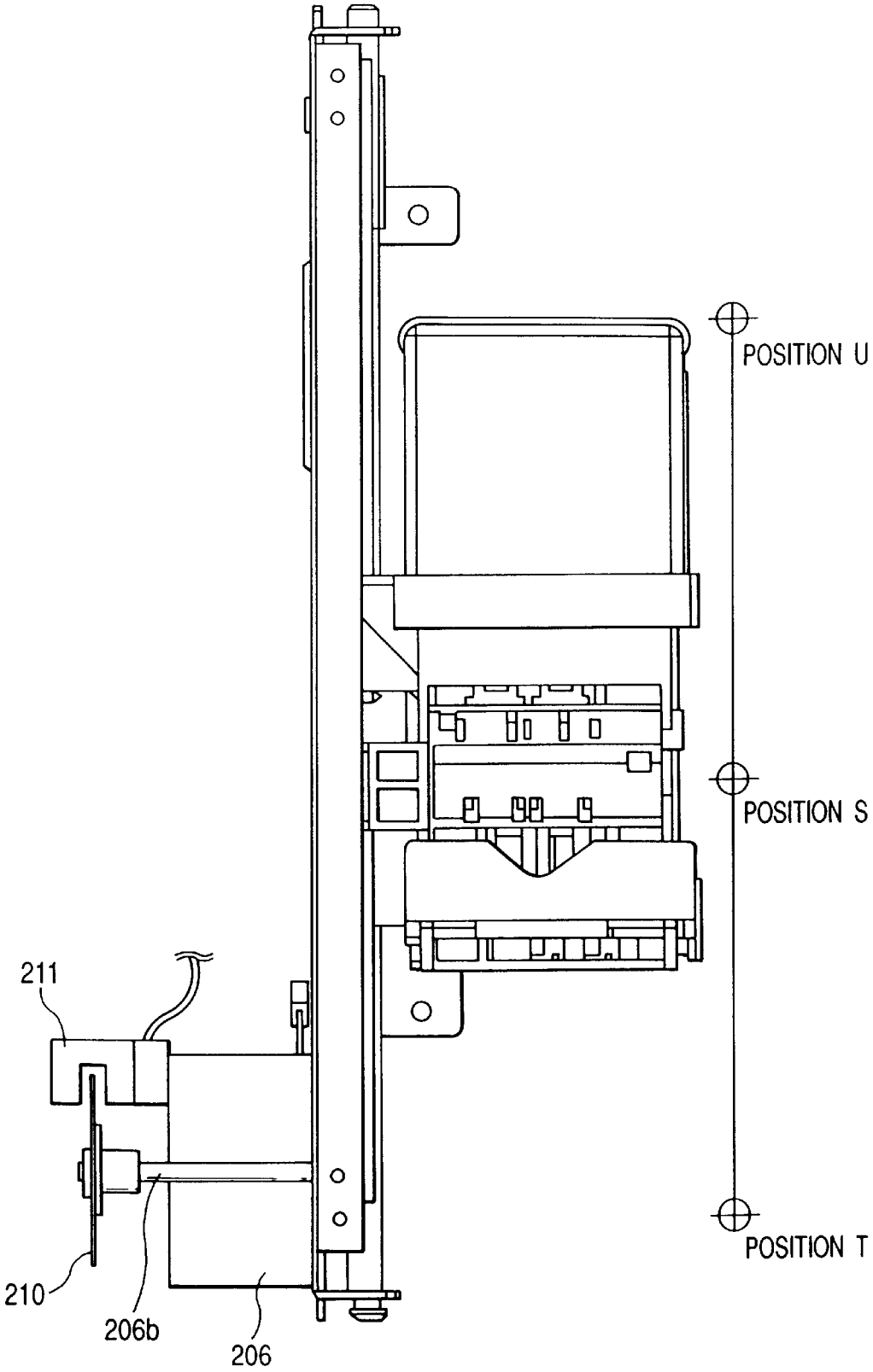
FIG. 10 is a plan view showing a moving range of the cartridge.

As shown in FIG. 10, in the printing apparatus according to the present invention, there are provided three stop positions of the carriage 200. A home position S is provided substantially in the center of the printing apparatus, and a cap of the recovery system unit which will be described later moves vertically at the home position S and covers the nozzle portion of the liquid jet head unit 401 mounted on the carriage 200. Print positions are so provided as to interpose the home position S therebetween, and a front-side print position is an envelope print position T and a rear-side print position is a continuous-sheet print position U.

(Carriage Control)

The CR frame 201 is attached with a home position sensor (hereinafter referred to as "HP sensor") of the photonic sensor type not shown. The HP sensor is disposed at the position of the home position S and detects the passage of a shielding plate 200*a* (refer to FIGS. 11 and 13) disposed on the carriage 200, thereby being capable of detecting the position of the carriage 200.

As shown in FIG. 10, a shaft 206*b* extends on an opposite side of the CR drive pulley 206*a* of the CR motor 206, and a disc-shaped encoder slit 210 is attached to the shaft 206*b*. Upon the operation of the CR motor 206, the encoder slit 210 also rotates in synchronism with the CR motor 206. The slits of the same number as steps per one revolution of the CR motor 206 are cut in the encoder slit 210. In this embodiment, since the CR motor 206 has 200 steps per one revolution, 200 slits are cut in the encoder slit 210. Then, a photonic sensor 211 is attached so as to interpose the encoder slit 210, and since the encoder slit 210 rotates upon the actuation of the CR motor 206, the rotary momentum of the CR motor 206 is transmitted to the board from the photonic sensor 211 as a signal. Then, as described above, since one step of the CR motor 206 corresponds to one step of the encoder slit 210, every time the CR motor 206 rotates one step (in this case, one step is 1.8° since one round is composed of 200 steps), the photonic sensor 211 detects the passage of one slit and transmits a signal to the board. That is, if the number of slits of the encoder 210 that passed through the sensing position of the photonic sensor 211 is notified of, the rotation of the CR motor 206, that is, the moving distance of the carriage 200 is accurately obtained so as to feed back the detected movement distance.

Figure 14:
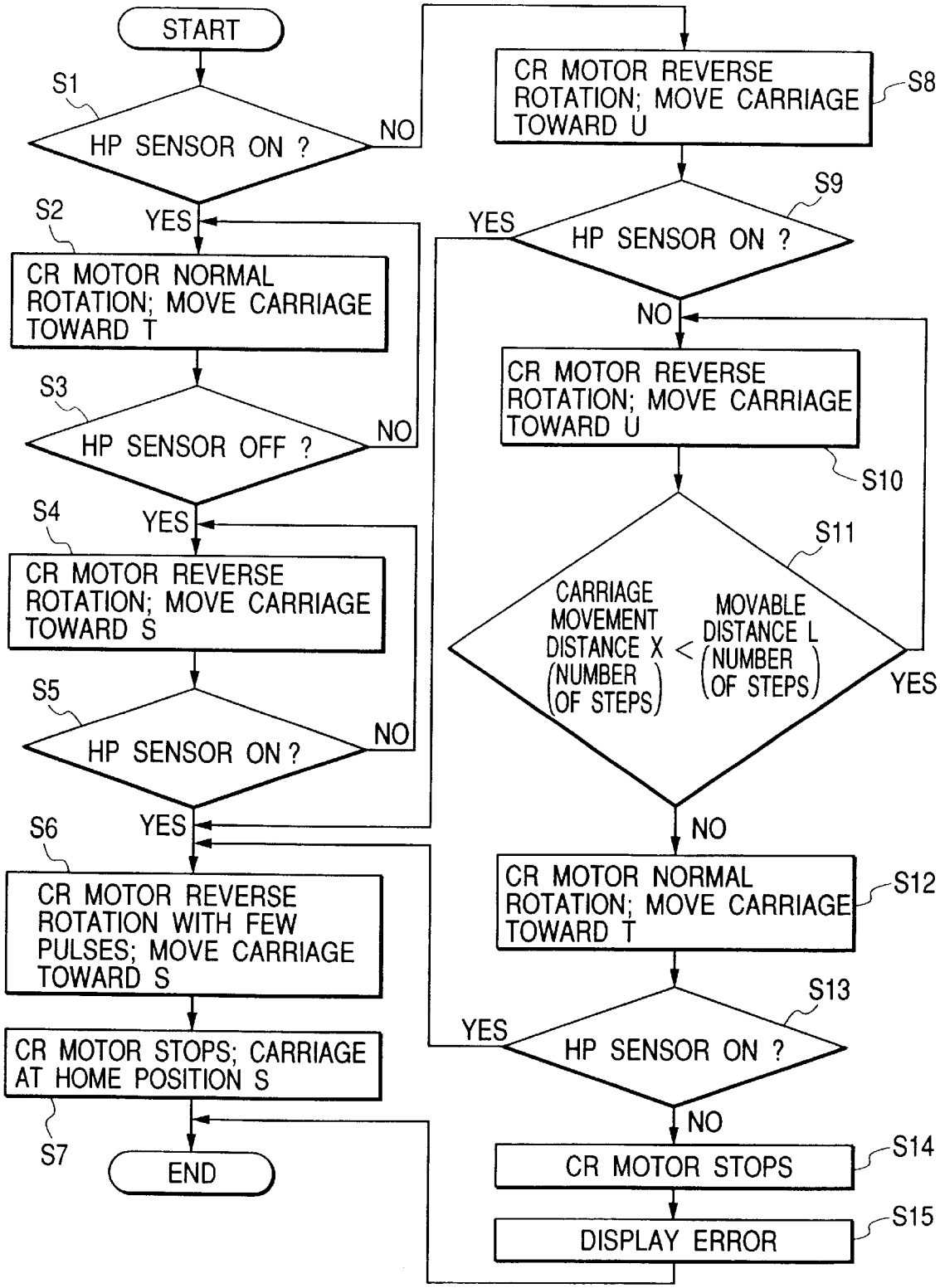
FIG. 14 is a flowchart showing the moving operation of the cartridge.

Now, the moving operation of the carriage 200 will be described in more detail with reference to a flowchart of FIG. 14. As described above, the CR motor 206 is controlled by the combination of the HP sensor, the encoder slit 210 and the photonic sensor 211.

First, in an initial state, when the HP sensor which is at the home position S detects the carriage 200 (on-state) (step S1), the CR motor 206 is rotated normally to move the carriage 200 toward the envelope print position T (step S2). Then, at the time when the HP sensor does not detect the carriage 200 (off-state) (step S3), the CR motor 206 is rotated reversely to move the carriage 200 toward the home position S (step S4). Then, at the time when the HP sensor turns on again (step S5), that is, from the time when the carriage 200 moves up to a position where an edge portion of the shielding plate 200*a* of the carriage 200 shields the HP sensor, the CR motor 206 is further driven a given number of pulses (step S6), and the carriage 200 is positioned at the home position S at which the CR motor 206 stops (step S7). With the above operation, the initial operation of the carriage 200 is completed. The number of pulses supplied to the CR motor 206 in step S6 is determined by a distance between the edge portion of the shielding plate 200*a* and the center portion of the carriage 200 and the positional relationship between the HP sensor and the home position S.

On the other hand, in the initial state, when the HP sensor does not detect the carriage 200 (off-state) (step S1), the CR motor 206 is rotated reversely to move the carriage 200 (step S8). When the HP sensor detects the carriage 200 (off-state) (step S9), the above-described steps S6 to S7 are executed.

Incidentally, even if the carriage 200 is moved in step S8, the HP sensor does not detect the carriage 200 (step S9), and the carriage 200 further continues to be moved (step S10). Then, in the case where the pulses continue to be supplied such that it is judged that the movement distance X of the carriage 200 is equal to or longer than the movable distance L of the carriage 200 (step S11), the CR motor 206 is rotated normally (step S12). Then, when the HP sensor detects the carriage 200 (step S13), the above-described steps S6 to S7 are executed. However, when the HP sensor does not detect the carriage 200 in step S13, the CR motor 206 is stopped (step S14) and an error message is displayed (step S15).

Subsequently, the operation of moving from the home position S to the print position (the envelope print position T and the continuous-sheet print position U) will be described.

First, the CR motor 206 is driven so that the carriage 200 moves from the home position S toward the print position, and from the time when the shielding plate 200*a* of the carriage 200 does not shield the HP sensor (at the time of the off-state where the HP sensor does not detect the carriage 200), the number of pulses of the CR motor 206 is counted by the encoder slit 210 and the photonic sensor 211. Then, when a predetermined number of pulses (corresponding to a distance to the envelope print position or the continuous-sheet print position) are counted, the CR motor 206 stops. Under that control, the carriage 200 always reaches a desired print position.

If the CR motor 206 steps out or the carriage is caught by something so as not to move, because the number of counts is short, the user is warned of this fact as an error.

When the carriage 200 moves from the print position (the envelope print position T and the tape print position U) to the home position S, the CR motor 206 is driven so that the carriage 200 first moves toward the home position S, and from the time when the edge of the shielding plate 200*a* of the carriage 200 reaches a position where it shields the HP sensor, the CR motor 206 is further driven a predetermined number of pulses, and the carriage 200 is positioned at the home position S and stops.

(Carriage Structure: Bearing Portion)

Figure 11:
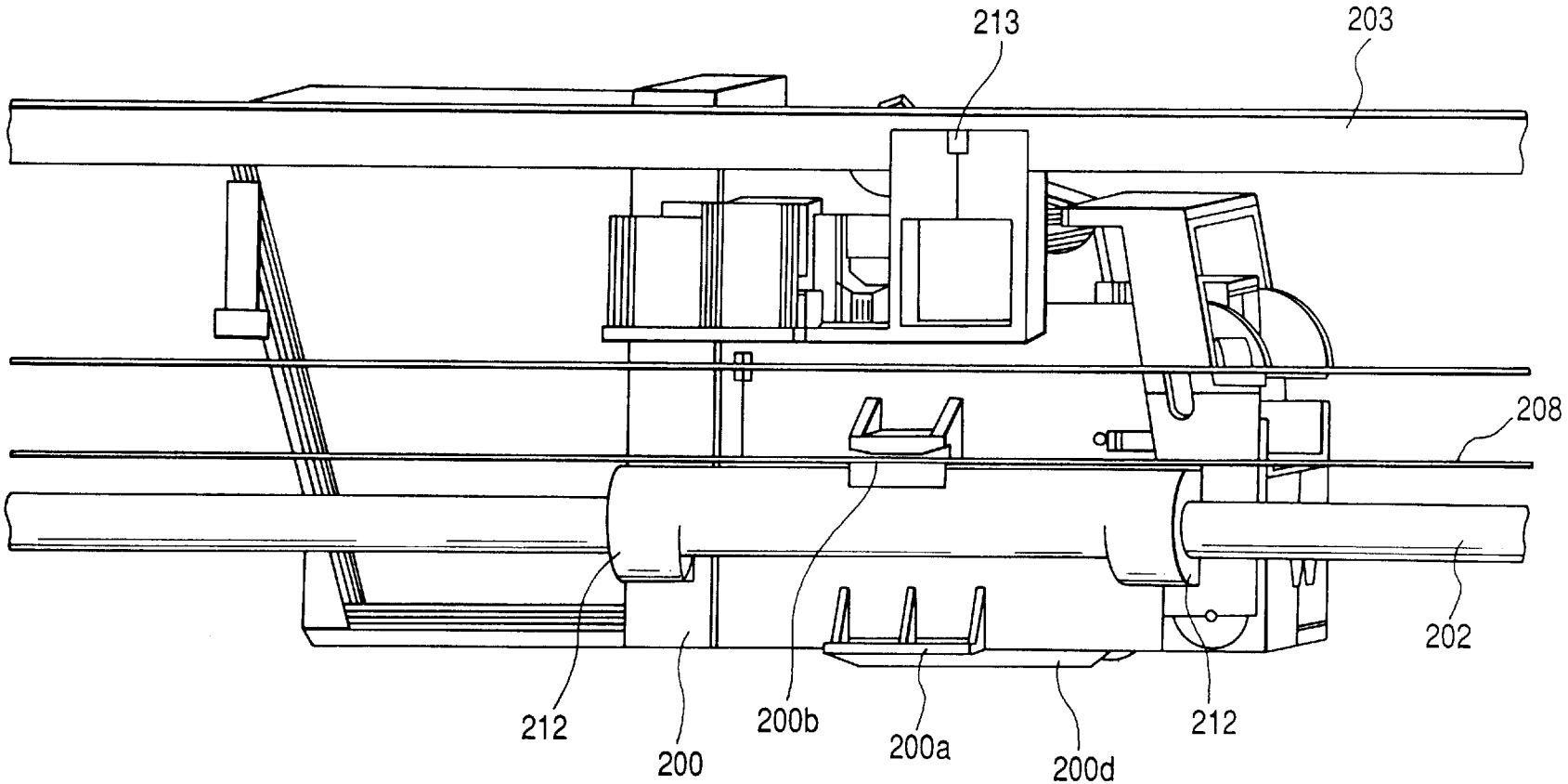
FIG. 11 is a side view showing the moving mechanism of the cartridge.

As shown in FIG. 11, because the carriage 200 slides in a direction which is orthogonal to the conveying direction of the envelope and the continuous sheet and in parallel with the nozzle train of the liquid jet head unit 401 mounted on the carriage 200, two CR bearings 212 into which the CR shaft 202 are inserted are disposed. The CR bearings 212 are fixed onto the front and rear portions of the left side surface of the carriage 200.

The CR bearings 212 are made of a material that does not require grease and prevent power powders or ink mist from being stuck onto the CR shafts 202 or the CR bearings 212. Also, a CR slider 212 which is excellent in sliding property and so fitted as to interpose the guide rail 203 is fixed on the upper and center portion of the CR bearings 212.

As described above, the carriage 200 is supported at three points by two CR bearings 212 positioned at the lower portion and one CR slider 213 positioned at the upper portion.

(Carriage Structure: HP Sensor Shielding Plate)

Figure 13:
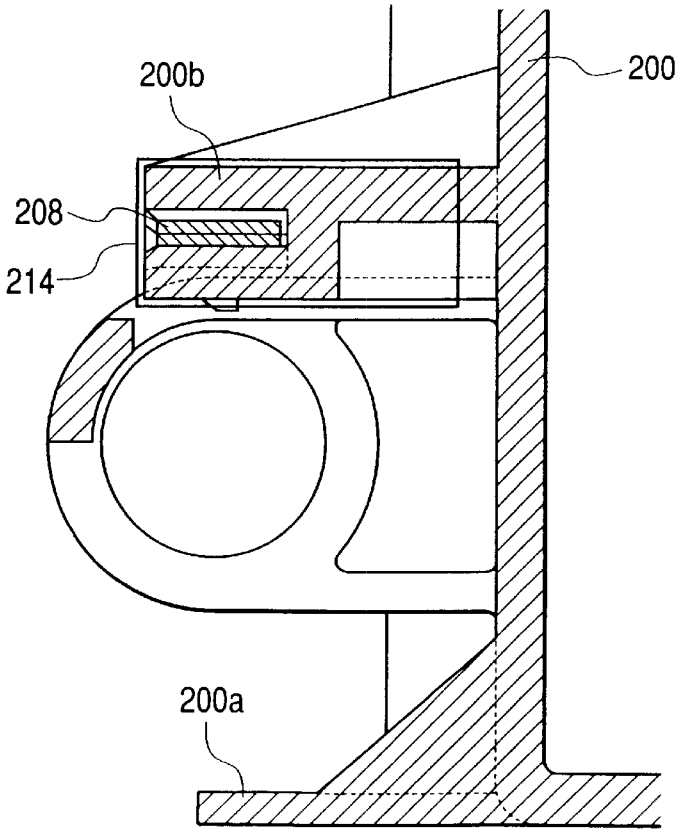
FIG. 13 is an enlarged front view showing a fixing state of the cartridge and the CR belt.

As shown in FIGS. 11 and 13, a HP sensor shielding plate 200*a* necessary to control the position of the carriage 200 is attached in the vicinity of the center of the left side surface of the carriage 200 and below the vicinity of the center position of the fixing portion of the two CR bearings 212.

(Carriage Structure: CR Belt Fixing Portion)

Figure 12:
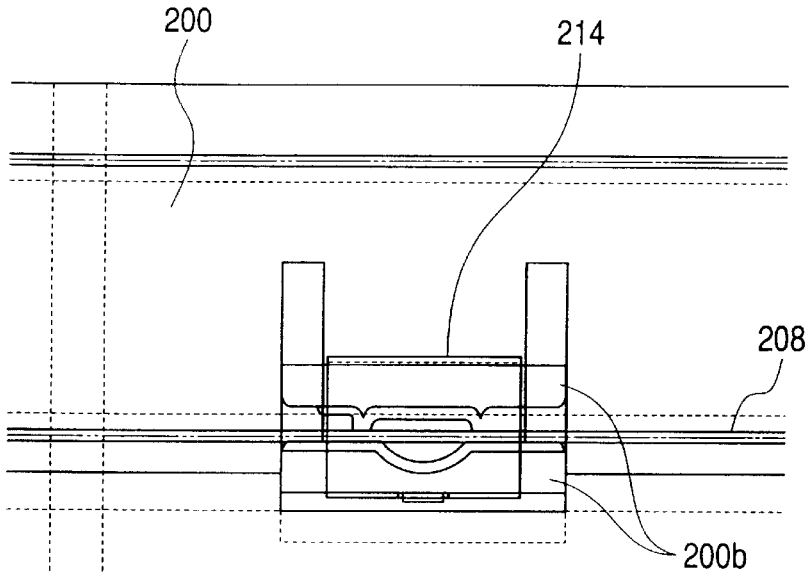
FIG. 12 is an enlarged side view showing a fixing state of the cartridge and a CR belt.

As shown in FIGS. 12 and 13, a fixing portion 200*b* of the CR belt 208 is disposed in the vicinity of the center of the left side surface of the carriage 200 and above the vicinity of the center position of the fixing portion of the two CR bearings 212. The CR belt fixing portion 200*b* is so structured as to nip the CR belt 208, and the nipping portion of the CR belt fixing portion 200*b* is slightly thinner than the thickness of the CR belt 208, and the CR belt 208 is fixed onto the carriage 200 without any backlash because the CR belt 208 is inserted into the nipping portion under pressure. Since the CR belt 208 is thus fixed, the carriage 200 is moved by the CR motor 206.

In addition, as a stopper of the CR belt 208, a CR belt stopper 214 formed of a U-shaped sheet metal is attached onto the CR belt fixing portion 200*b* of the carriage 200, and a convex portion of the carriage 200 is inserted into a hole portion of the CR belt stopper 214 so that the CR belt stopper 214 is fixed onto the CR belt fixing portion 200*b*.

(Carriage Structure: Board Retaining Portion)

Figure 15:
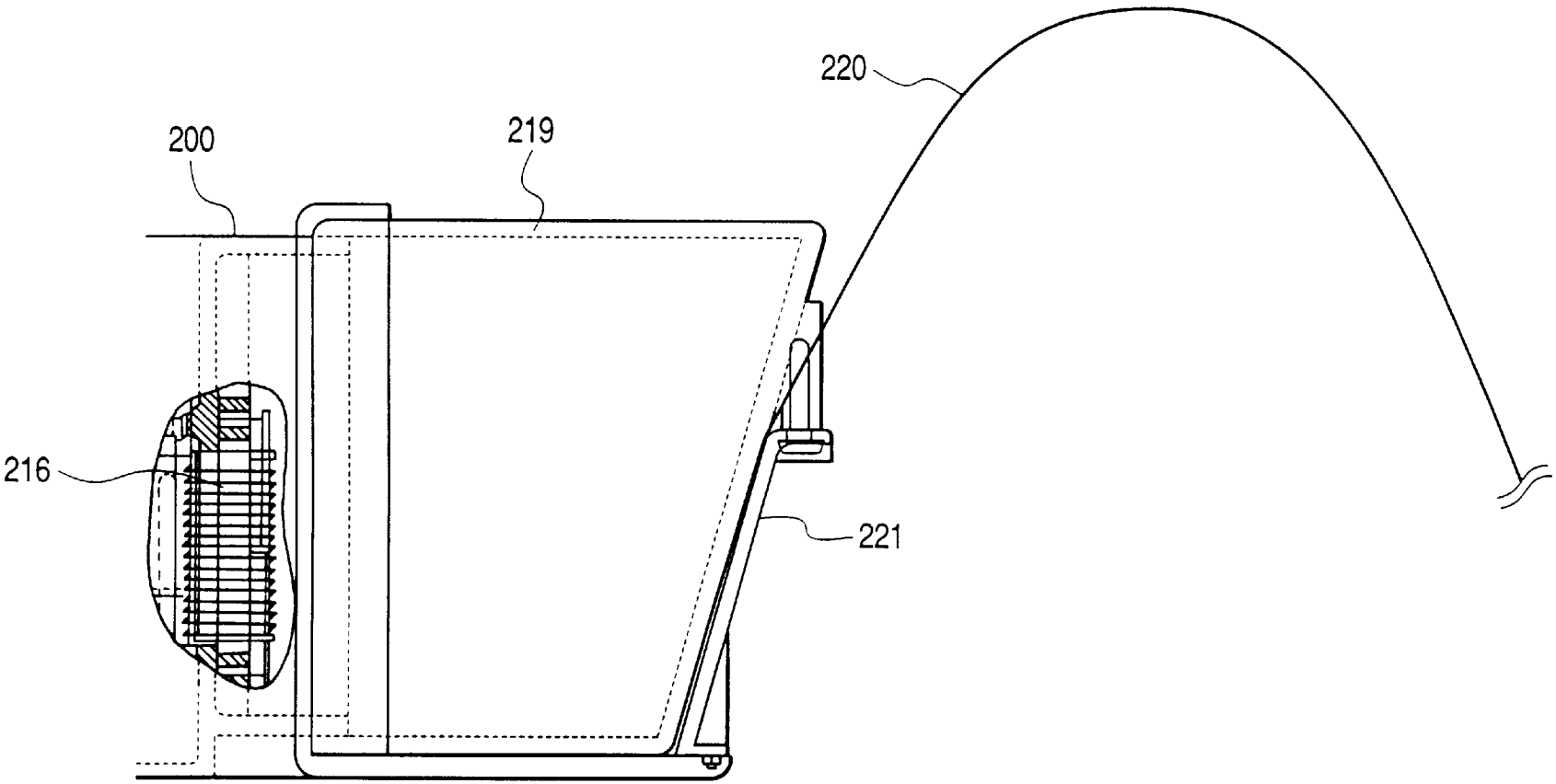
FIG. 15 is a front view showing a connecting state of the cartridge, a CR connector, etc.
Figure 16:
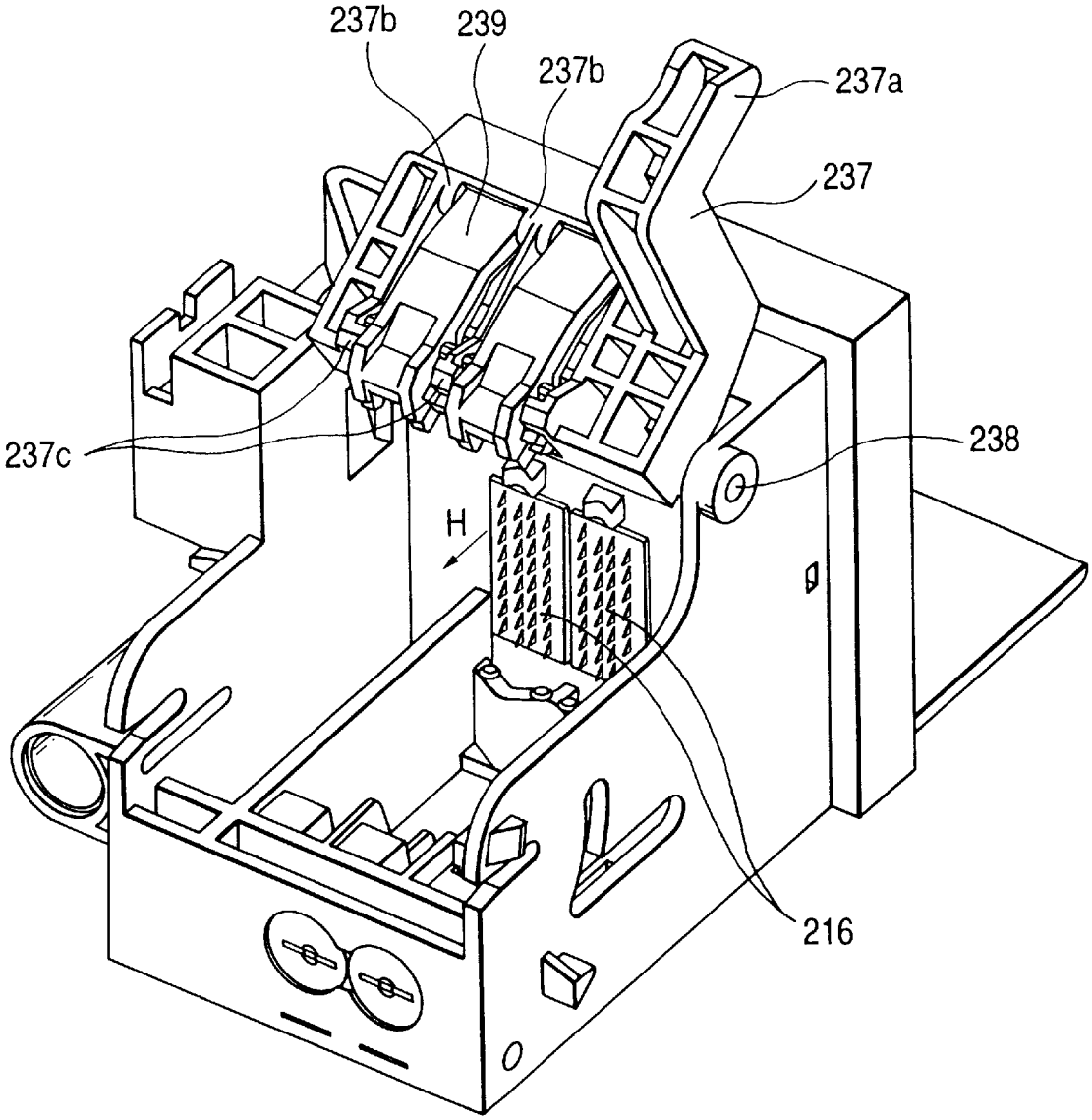
FIG. 16 is a perspective view showing a liquid jet head unit non-attaching state of the cartridge.

As shown in FIGS. 15 and 16, a board or the like such as a CR printed wiring board on which two CR connectors 216 that receive and send a signal with respect to the liquid jet head unit 401 is mounted on the carriage 200.

The CR connector 216 is fixed in the inner depth (the depth of a space wherein the liquid jet head unit 401 is mounted) of the carriage 200 so as to be disposed vertically and opposed to one face of the liquid jet head unit 401. Then, as shown in FIG. 7, the substrate or the like is covered with a CR printed wiring board cover 219.

Also, the board or the like is connected with a flexible cable (hereinafter referred to as "FPC") 220 to which an electric signal or a power supply is transmitted from a control board (not shown) which is in the exterior of the carriage 200. The FPC 220 is so connected as to extend from a gap between the carriage 200 and the CR printed wiring board cover 219 to the external of the carriage 200. The FPC 200 is fixed by an FPC stopper 221 attached onto the carriage 200 and the CR printed wiring board cover 219 so as to be nipped between the CR printed wiring board cover 219 and the FPC stopper 221. With above structure, the FPC 220 is fixed so as not to fall out even if an external force is applied to the FPC 220.

The FPC 220 is connected to the control board of the printing machine main body, and as the carriage 200 moves, an interval between the carriage 200 and the control board of the printing machine main body is varied. For that reason, the FPC 220 is sufficiently long to be loosened, and an excessive stress is not applied to the FPC 220 due to the loosening even if the carriage 200 moves and stands at any position.

(Carriage Structure: Recovery System Unit Related Portion)

Figure 17:
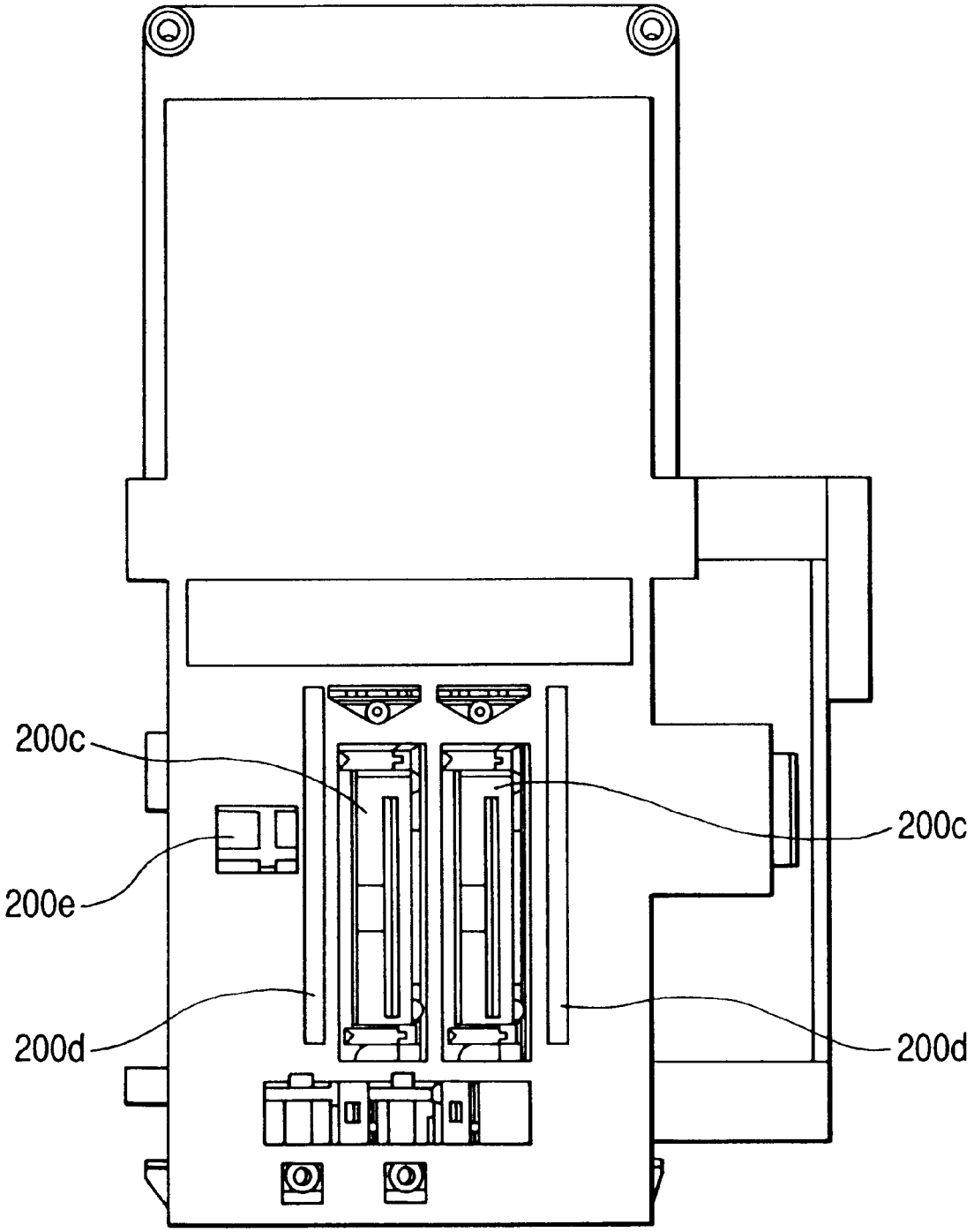
FIG. 17 is a bottom view showing the cartridge.
Figure 18:
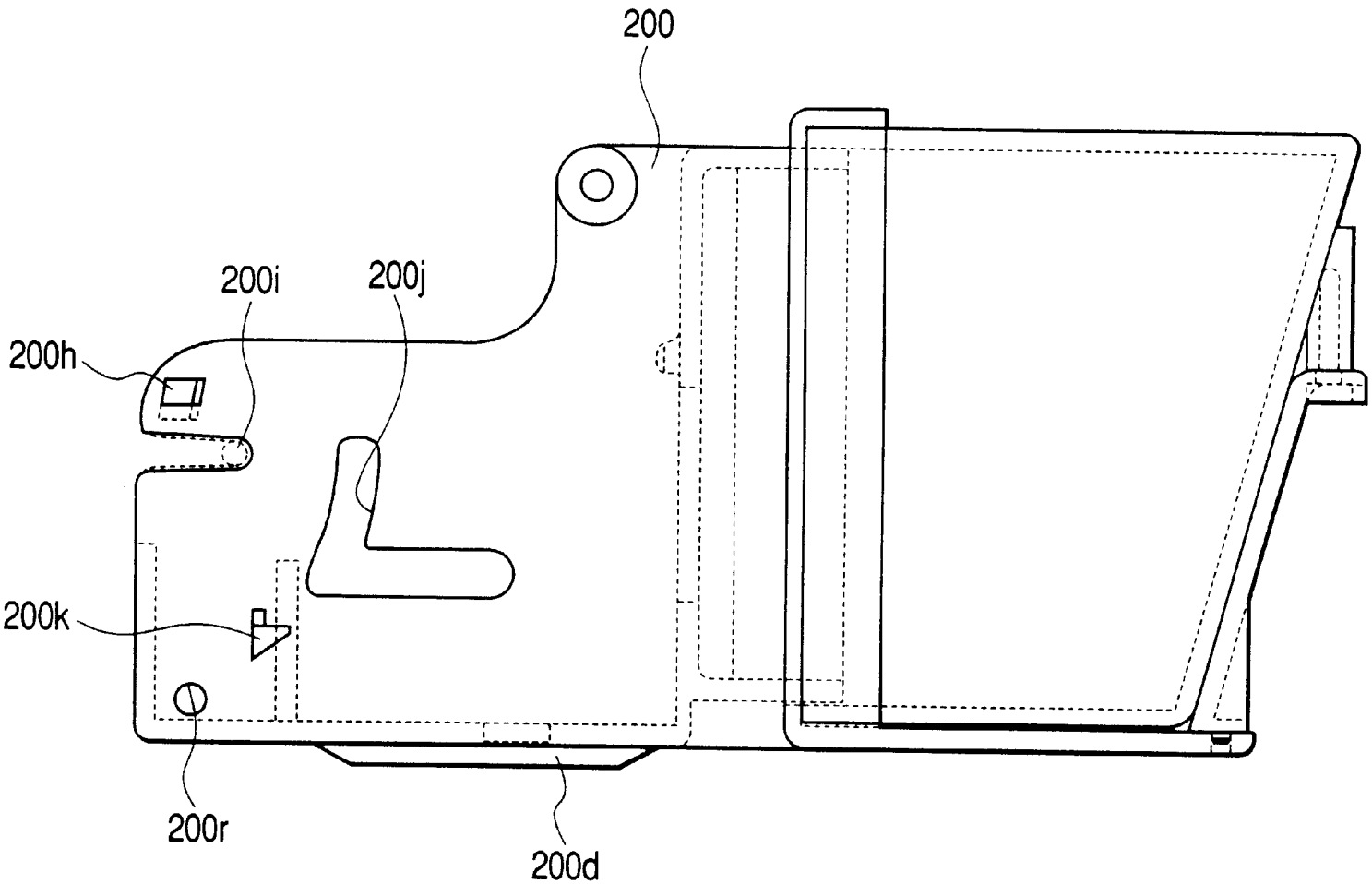
FIG. 18 is a front view showing the cartridge.
Figure 19:
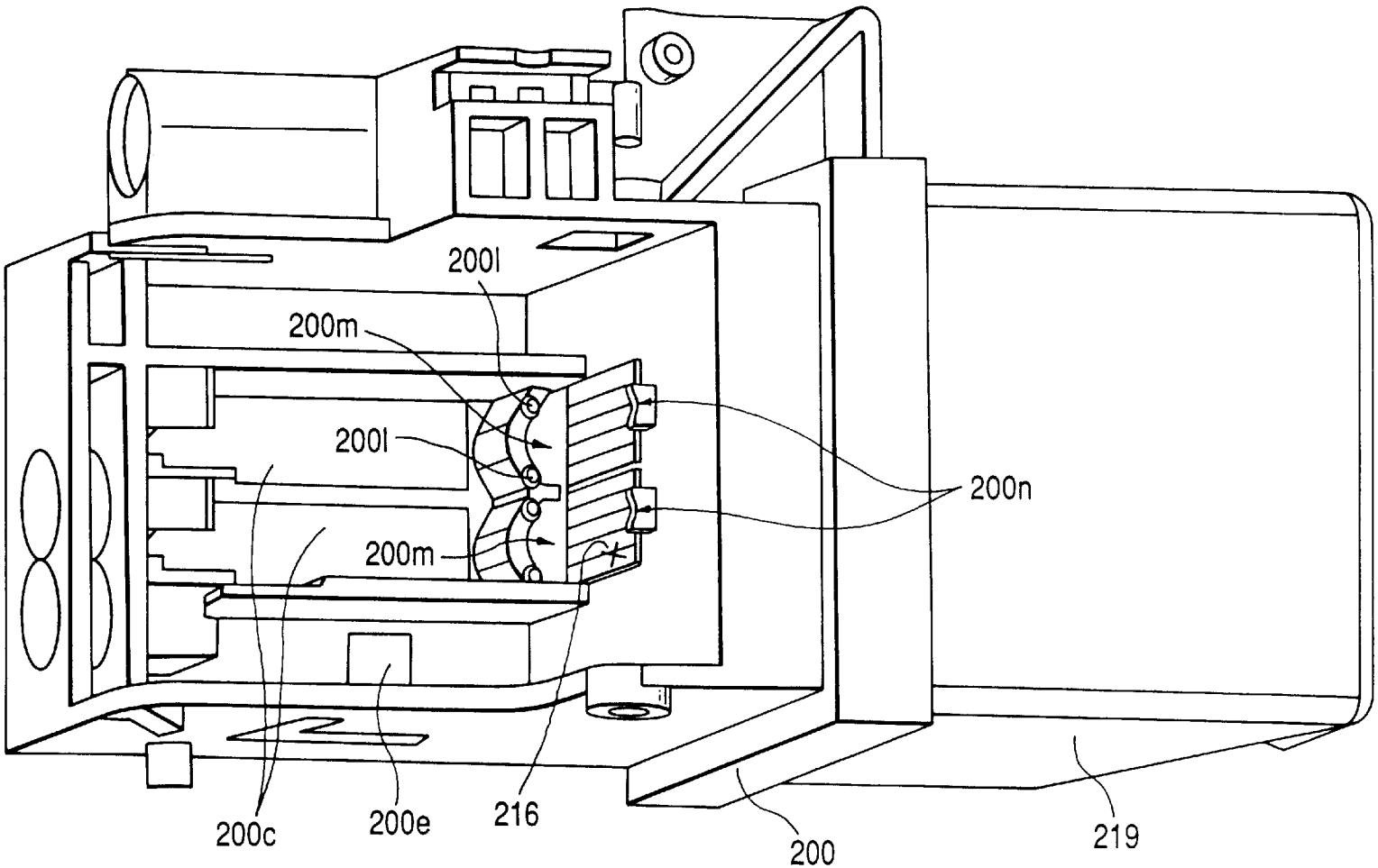
FIG. 19 is a perspective view showing the cartridge viewed from the upper.

As shown in FIG. 17 showing a bottom view of the carriage 200, FIG. 18 showing a side view of the carriage 200 and FIG. 19 showing a perspective view of the carriage 200, two hole portions 200*c* from which the nozzles of the liquid jet head unit 401 are exposed are formed in the lower portion of the bottom surface of the carriage 200, and a CR blade rib 200*d* is disposed in parallel with the moving direction of the carriage 200 on the right and left sides of those hole portions 200*c*. The action of the CR blade rib 200*d* will be separately described on the item of the recovery system unit 300.

A square hole 200*e* is defined in the bottom surface portion of the carriage 200 at the right side of a portion where the liquid jet head unit 401 is mounted. A carriage lock arm 390 of the recovery system unit 300 is inserted into the hole 200*e*, and prevents the carriage 200 from being moved due to the vibrations of the entire printing machine when the nozzles of the liquid jet head unit 401 are covered with the cap 308 of the recovery system unit 300. The detailed structure will be separately described on the item of the recovery system unit.

(Carriage Structure: Ink Supply Portion)

Figure 20:
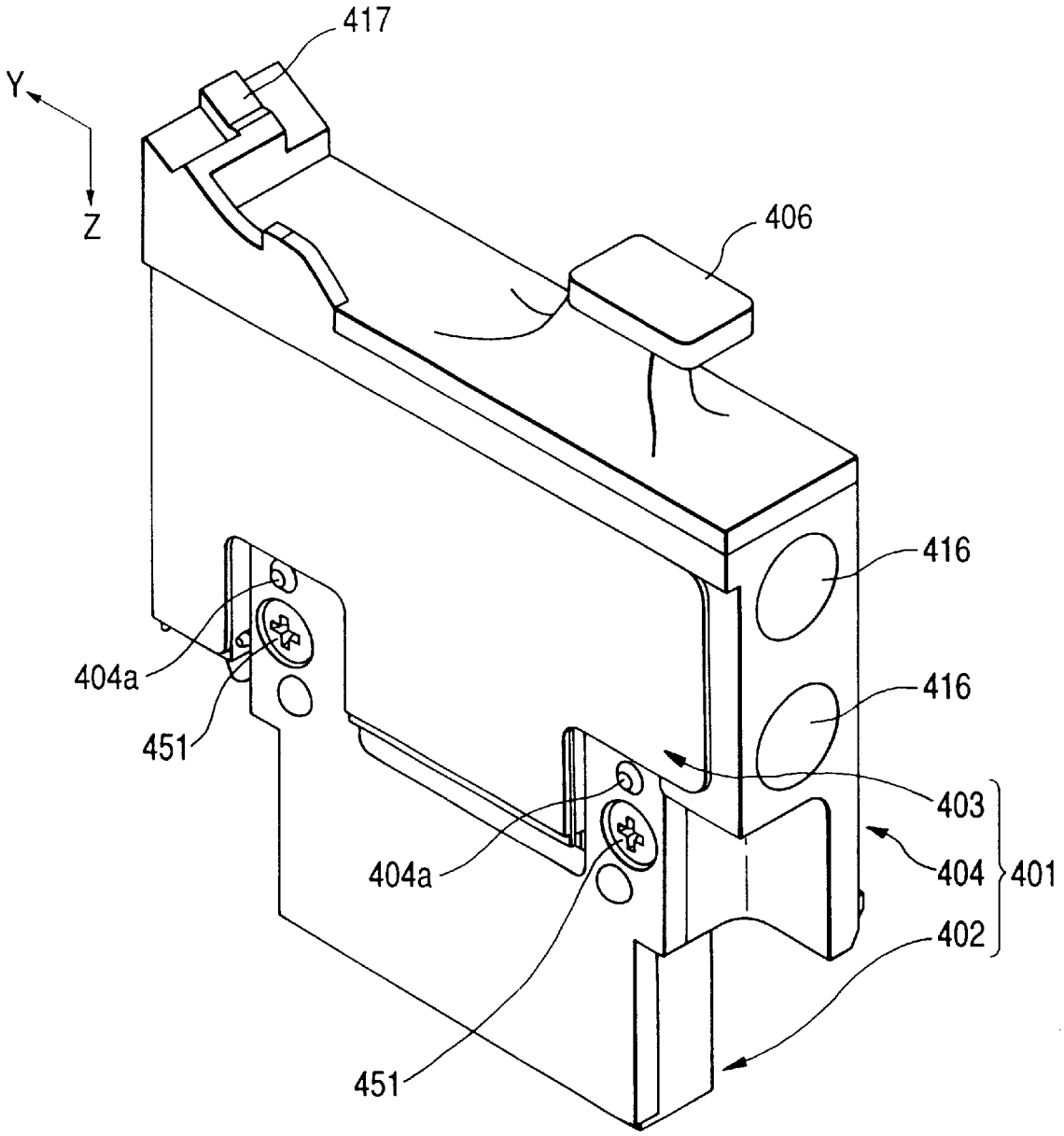
FIG. 20 is a perspective view showing the liquid jet head unit.

As shown in FIG. 20, two joint rubbers 416 are disposed on this side surface of the liquid jet head unit 401. When a tip of a CR needle 222 (refer to FIG. 21) is inserted into the surface of each the joint rubber 416 and penetrates the interior of the tank of the liquid jet head unit 401, an ink is supplied to the interior of the tank of the liquid jet head unit 401 from a supply system which is upstream side of the CR needles 222 and coupled to the CR needles 222 by connecting means such as the CR tubes 226.

A mechanism for supplying the ink to the liquid jet head unit 401 is disposed on this side of a portion where the liquid jet head unit 401 is mounted on the carriage 200. This structure will be described below.

Figure 21:
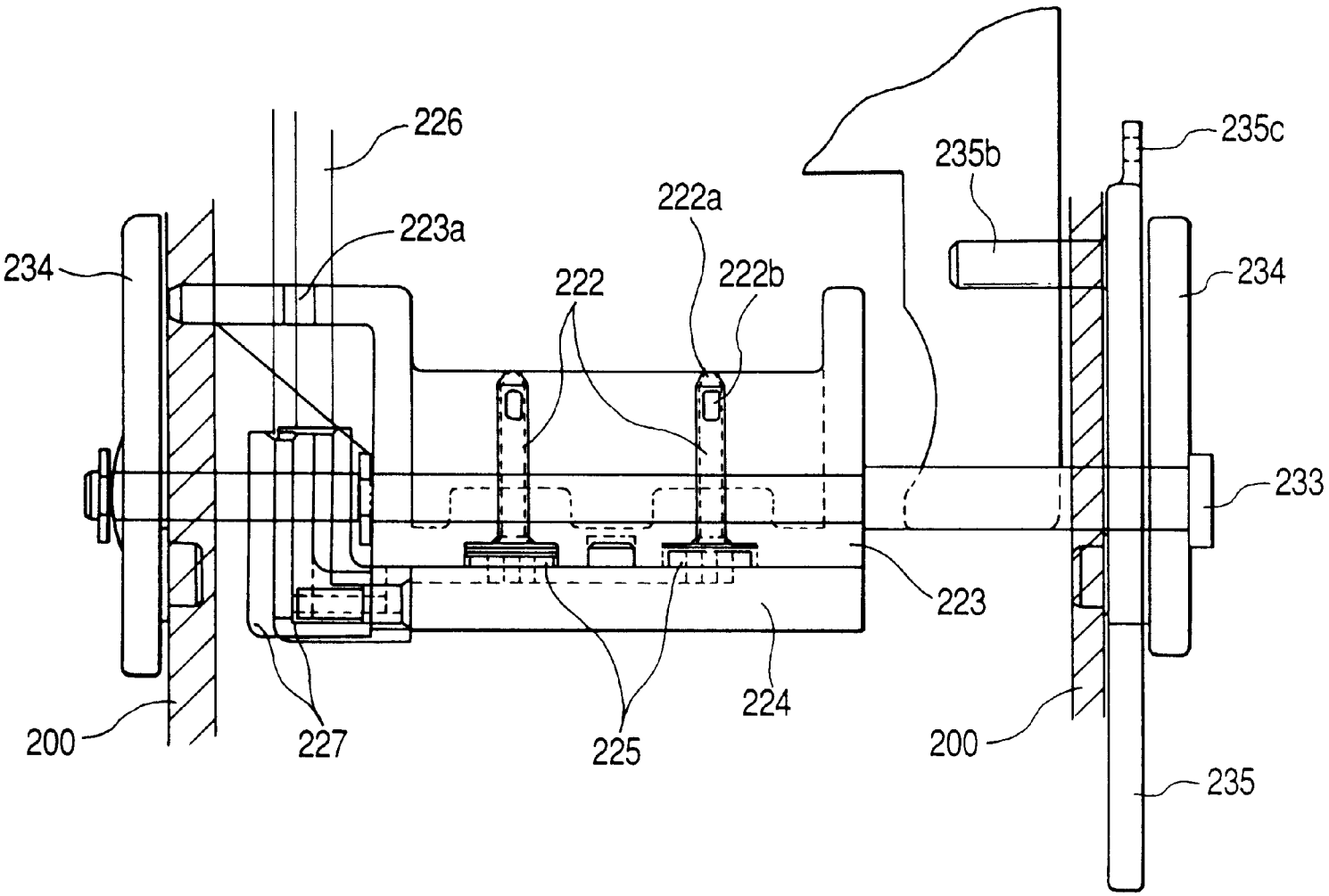
FIG. 21 is a front view showing a CR needle attaching portion.
Figure 22:
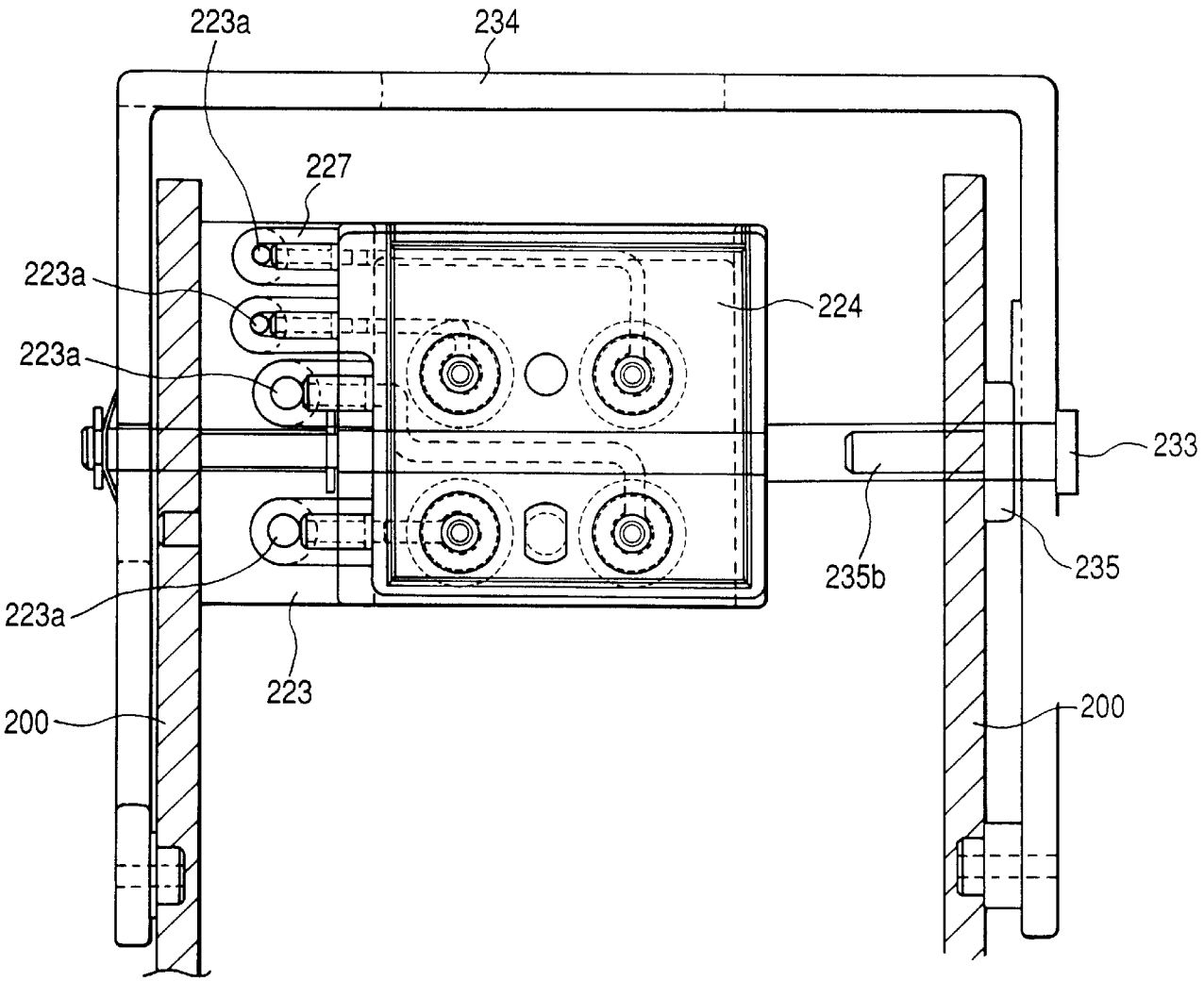
FIG. 22 is a plan view showing the CR needle attaching portion.

First, as shown in FIGS. 21 and 22, four CR needles 222 are shaped in a slender hollow pipe, respectively, and directed forward of the liquid jet head unit 401 from this side. The tip of each the CR needle 222 has a closed spherical portion 222*a*, and a small rectangular hole 222*b* is defined in the vicinity of the tip spherical portion 222*a* from the middle portion of the hollow portion of the pipe toward the upper side. Each of the CR needles 222 is fixed by a plastic CR joint support 223 and a CR tube joint 224. The CR joint support 223 and the CR tube joint 224 are integrated together by welding, and a route of each the CR needle 222 is sandwiched by a CR needle seal 225 which is shaped in a doughnut and made of rubber so as to prevent the ink from being leaked. Then, in the CR joint support 223 and the CR tube joint 224, a flow path is formed in each of the four CR needles 222 and communicates with four pipe-shaped portions disposed on the CR tube joint 224, respectively.

Those four pipe-shaped portions disposed on the CR tube joint 224 are covered with one ends of L-shaped pipe-shaped CR joint rubbers 227, respectively, and the CR tubes 226 are inserted into the other ends of the CR joint rubbers 227, respectively. That is, the CR joint rubbers 227 serve as couplings of the CR tube joints 224 and the CR tubes 226.

Those four CR tubes 226 penetrate four holes 223*a* defined in the side plate of the CR joint support 223 in a press fitting state, and even if the CR joint support 223 which will be described later moves, the CR tubes 226 are fixed so as not to fall out from the CR joint rubbers 227. Although being not shown, those four CR tubes 226 are loosened for the movement of the CR joint support 223.

In addition, those four CR tubes 226 penetrate the hole portions of CR tube rubbers not shown, and each of the CR tube rubbers is nipped between the carriage 200 and a CR tube stopper not shown so as to be fixed therebetween. Those CR tubes 226 extend to the external of the carriage 200. Although being not shown, those four CR tubes 226 are integrated into a band, and each of their tips is connected to a joint plug with a rubber CR joint as a coupling. The joint plug is detachably coupled to the CR joint and also coupled to the ink supply system unit.

The CR tubes 226 are loosened for the movement of the carriage 200 between the carriage 200 and the ink supply system unit 10. An excessive stress is not applied to the CR tubes 226 due to the loosening even if the carriage 200 moves and stands at any position.

(Carriage Structure: Ink Supply Joint Portion)

Subsequently, a mechanism of inserting or drawing out the above-described four CR needles 222 into or from the liquid jet head unit 401 will be described with reference to FIGS. 18 and 21 to 26. The liquid jet head unit 401 is omitted from those figures.

As shown in FIGS. 21 and 22, a CR joint shaft 233 is fixed onto the CR needles 222, the CR joint support 223 and the CR tube joint 224 which are integrated together. Also, as shown in FIGS. 18 and 23 to 26, a slot 234*a* is defined in the middle portion of a CR joint lever 234 which rotates about holes 200*r* defined on the right and left side surfaces of the carriage 200, and the CR joint shaft 233 is inserted into the slot 234*a* and fixed so as not to fall out. With the above structure, when the CR joint lever 234 rotates, the CR joint shaft 233 moves forward and backward (between this side and the depth side) while being interlocked with the CR joint lever 234. Also, the CR needles 222, the CR joint support 223 and the CR tube joint 224 move forward and backward (between this side and the depth side) while being interlocked with the CR joint lever 234.

Figure 25:
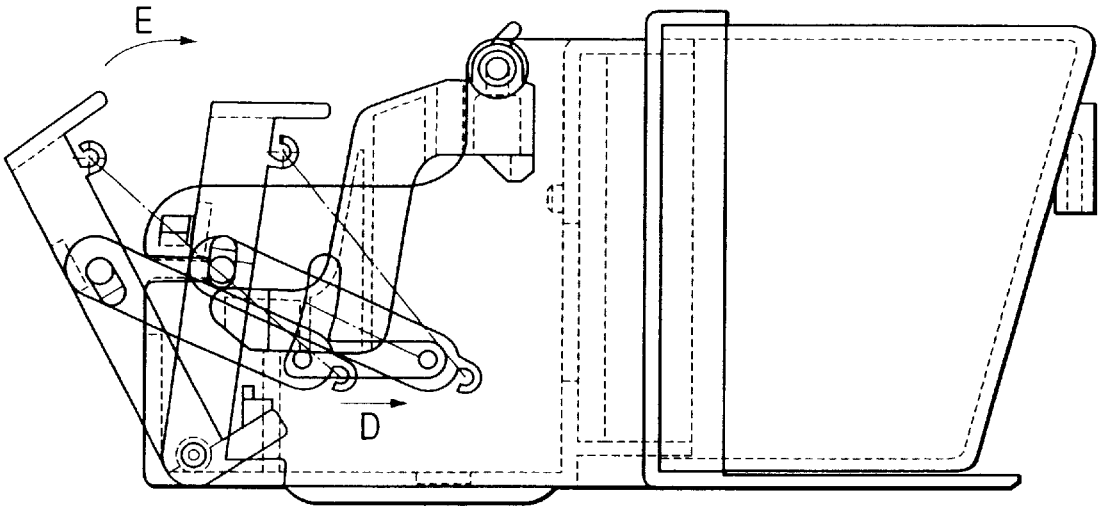
FIG. 25 is a side view showing a procedure of attaching the liquid jet head onto the cartridge.
Figure 26:
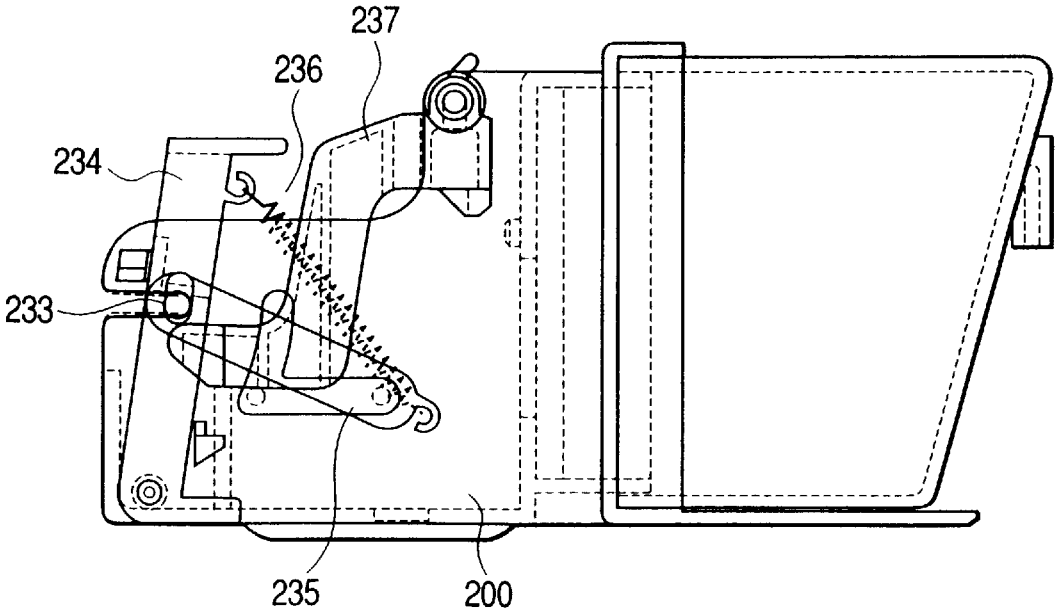
FIG. 26 is a side view showing a procedure of attaching the liquid jet head onto the cartridge.

As a result, when the CR joint lever 234 falls down toward the depth side (a direction indicated by an arrow E in FIG. 25), because the CR needles 222 are inserted into the two joint rubbers 416 disposed on the front surface portion of the liquid jet head unit 401, and the CR joint lever 234 jumps beyond the convex portion 200*h* of the carriage 200 during the rotating motion. As a result, as shown in FIG. 26, the CR joint lever 234 is fixed so as not to move when the CR joint lever 234 completely falls down toward the depth side. In this situation, because the CR joint shaft 233 is inserted into groove portions 200*i* (refer to FIG. 18) defined on the right and left side surfaces of the carriage 200, the CR joint shaft 233 is positioned without any backlash.

When the CR joint lever 234 is allowed to jump beyond the convex portion 200*h* of the carriage 200 and fall down toward this side (in a direction indicated by an arrow C in FIG. 24; refer to FIG. 18), the CR needles 222 are drawn out from the joint rubbers 416 disposed on this side (front surface side) of the liquid jet head unit 401. In this situation, since an L-shaped portion 234*c* disposed on a lower end of the CR joint lever 234 is abutted against a rib 200*k* (refer to FIG. 18) of the carriage 200, the CR joint lever 234 stops to rotate at this position.

Figure 23:
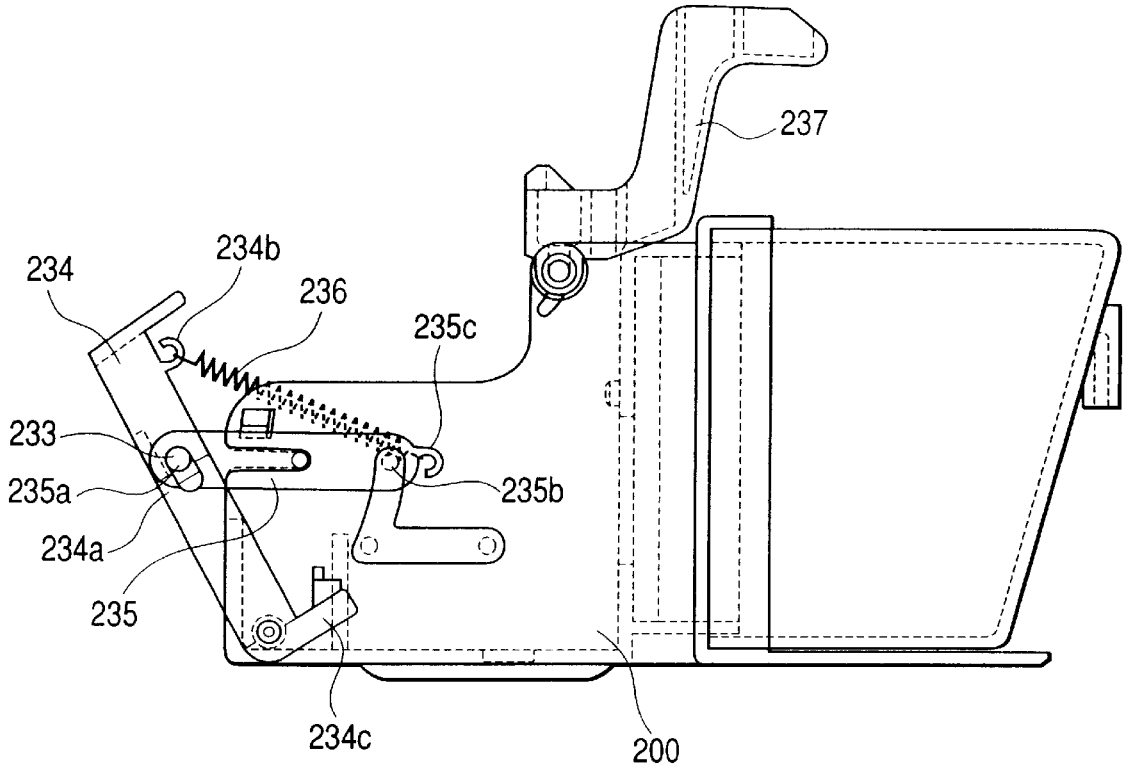
FIG. 23 is a side view showing a procedure of attaching the liquid jet head onto the cartridge.

Subsequently, the CR joint lever stopper 235 will be described. As shown in FIG. 23, a hole 235*a* is defined in one end portion of the CR joint lever stopper 235, the CR joint shaft 233 is inserted into the hole 235*a,* and the CR joint lever stopper 235 moves in association with the CR joint lever 234. The other end portion of the CR joint lever stopper 235 is equipped with a shaft 235*b,* and the shaft 235*b* penetrates an L-shaped slot 200*j* defined on the right side surface of the carriage 200 and is inserted into the carriage 200 so as to be movable along the-L-shaped slot 200*j*. In addition, the other end portion of the CR joint lever stopper 235 is equipped with a spring latch portion 235*c,* and a CR joint lever spring 236 which is formed of an extension spring is hooked between the spring latch portion 235*c* and a spring latch portion 234*b* disposed on the upper portion of the CR joint lever 234.

Subsequently, a description will be given of a mechanism of preventing an error in the operating procedures of the CR lever 237 for retaining and fixing the liquid jet head unit 401 mounted on the carriage 200, and the CR joint lever 234 that moves the CR needles 222 for supplying the ink to the liquid jet head unit 401 mounted on the carriage 200, when the liquid jet head unit 401 is detached or attached from or to the carriage 200.

FIG. 23 shows a state in which the liquid jet head unit 401 is not mounted on the carriage 200, where the CR lever 237 which will be described later is positioned above whereas the CR joint lever 234 is positioned at this side. In this state, the CR joint lever stopper 235 is pulled up by the CR joint lever spring 236, the shaft 235*b* abuts against an upper edge of the L-shaped slot 200*j* of the carriage 200, and the CR joint lever 234 does not move. As a result, in the state where the liquid jet head unit 401 is not mounted on the carriage 200, the CR needles 222 cannot be moved to the portion on which the liquid jet head unit 401 is mounted.

Figure 24:
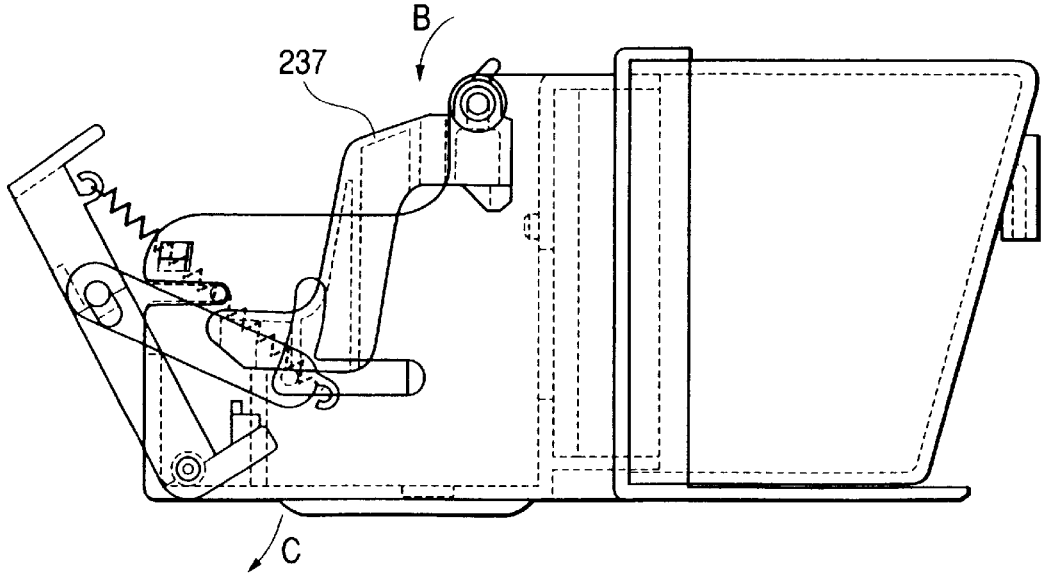
FIG. 24 is a side view showing a procedure of attaching the liquid jet head onto the cartridge.

Then, as shown in FIG. 24, when the CR lever 237 is rotated in a direction indicated by an arrow B and the liquid jet head unit 401 is mounted on the carriage 200, the shaft 235*b* of the CR joint lever stopper 235 abuts against the CR lever 237 and is then pushed down against a force of the CR joint lever spring 236 in a direction indicated by an arrow C along the L-shaped slot 200*j* of the carriage 200. In this situation, since the shaft 235*b* of the CR joint lever stopper 235 is positioned at the lower portion of the L-shaped slot 200*j* of the carriage 200, as shown in FIG. 25, the shaft 235*b* of the CR joint lever stopper 235 is movable in a direction indicated by an arrow D along the straight portion of the L-shaped slot 200*j* of the carriage 200. Accordingly, the CR joint lever 234 can fall down toward the depth side (in a direction indicated by an arrow E), and the CR needles 222 can be inserted into the liquid jet head unit 401.

Also, in a state where the liquid jet head unit 401 is inserted and fixed as shown in FIG. 26, since the CR joint lever 234 falls down toward the depth side, and the CR joint shaft 233 is above the lever portion 237*a* of the CR lever 237, an operator cannot touch the lever portion 237*a* and cannot operate the lever portion 237*a*. Therefore, in the state where the liquid jet head unit 401 is inserted and the CR needles 222 are inserted, the liquid jet head unit 401 cannot be drawn out.

(Carriage Structure: Liquid Jet Head Unit Fixing Portion)

As shown in FIG. 16, a rectangular hole is formed in the depth side wall of the carriage 200, and two CR connectors 216 for receiving and transmitting a signal with respect to the liquid jet head unit 401 are arranged and fitted into that hole portion. Each of the CR connectors 216 has a large number of contacts, and the respective contacts are moved forward and backward, independently. According to this structure, when the liquid jet head unit 401 is mounted on the carriage 200, a contact portion of the liquid jet head unit 401 comes to a surface of the contact pad 421 (in more detail refer to the item of the liquid jet head unit which will be described later), a contact of the CR connector 216 is drawn, and due to its reaction, a force of pushing back the contact portion of the liquid jet head unit 401 is exerted on the contact of the CR connector 216 in a direction indicated by an arrow H.

Above the carriage 200, the CR lever 237 is rotatably supported by the CR lever shaft 238 supported by the right and left side surfaces of the carriage 200. The CR lever 237 is provided with a lever portion 237*a* for rotating the CR lever 237.

Figure 55:
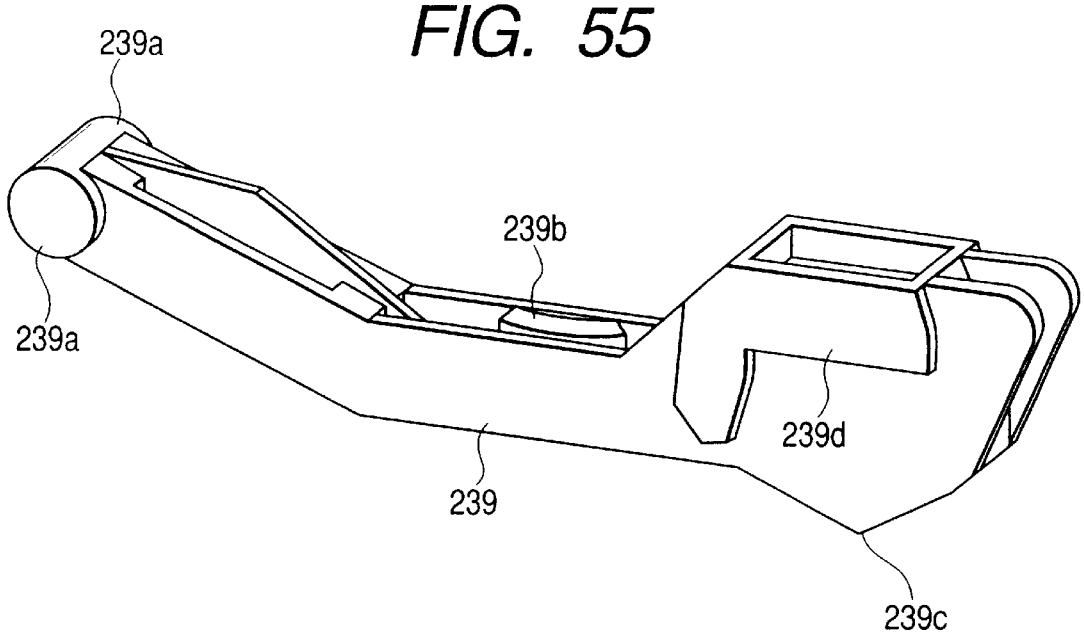
FIG. 55 is an enlarged view showing a head set plate.

Two head set plates 239 shown in FIG. 55 are retained in the center of the carriage 200. One of those head set plates 239 is disposed for each of the liquid jet head units 401. In this example, because two liquid jet head units 401 are mounted on one carriage 200, those two head set plates 239 are disposed in the carriage 200. The numbers of liquid jet head units 401 and head set plates 239 can be appropriately changed depending on the design.

A shaft 239*a* disposed at the right and left in the rear of the head set plate 239 is inserted into a U-shaped bearing 237*b* disposed on the CR lever 237, and the head set plate 239 rotates about the U-shaped bearing 237*b* as a center. Also, a spring bearing 239*b* is disposed in the center of the head set plate 239, and a CR set plate spring 240 formed of a compression spring not shown is disposed between the spring bearing 239*b* and a spring bearing portion not shown. Due to the action of the CR set plate spring 240, the tip portion 239*c* of the head set plate 239 is going to rotate downward toward the depth side with a shaft 239*a* disposed backward at the right and left as a center when the CR lever 237 is made in a set state. As a result, in the state where the liquid jet head unit 401 is set, the liquid jet head unit 401 is pushed downward toward the depth side by the head set plate 239. The CR lever 237 is equipped with a portion 237*c* that receives a rib 239*d* disposed at the right and left of the tip portion of the head set plate 239 so that the head set plate 239 is not disengaged from the CR lever 237 in the state where the liquid jet head unit 401 is not set.

Two trapezoidal bosses 2001 a top surface of which is flat are disposed for each of the liquid jet head units 401, that is, four trapezoidal bosses 2001 in total are disposed on a bottom surface of the carriage 200, as shown in FIG. 19. Two bosses disposed on the bottom surface of each the liquid jet head unit 401 (in more detail refer to the item of the liquid jet head unit which will be described later) are abutted against those bosses 2001, respectively, in the state where the respective liquid jet head units 401 are set, to thereby determine the position of the liquid jet head unit 401 in the heightwise direction. Also, one U-shaped rib portion 200*m* is disposed for each of the liquid jet head units 401, that is, two U-shaped rib portions 200*m* in total are disposed on the bottom surface of the carriage 200. The side surfaces of the bosses disposed on the bottom surface of the respective liquid jet head units 401 are abutted against those rib portions 200*m*, respectively, in the state where the respective liquid jet head units 401 are set.

Figure 56:
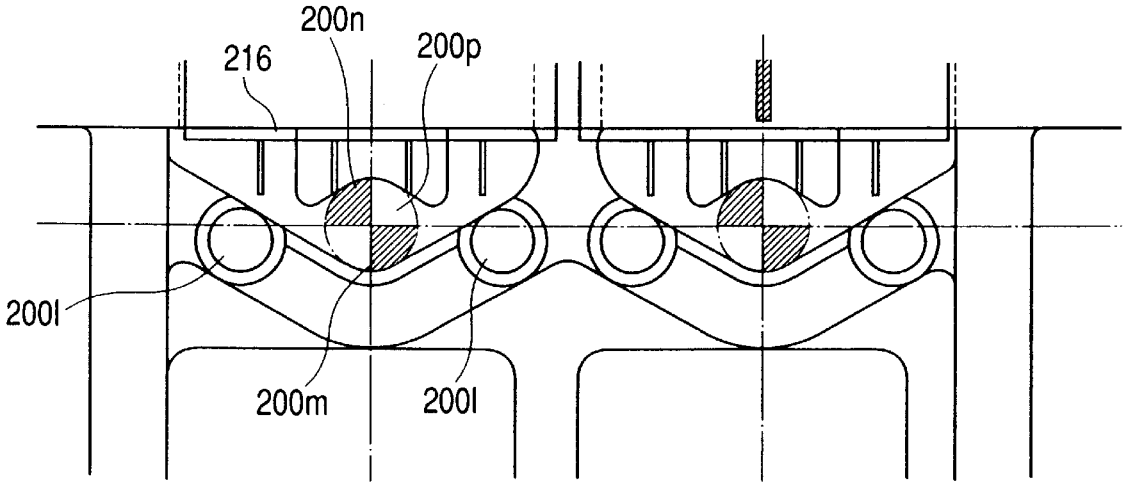
FIG. 56 is a plan view showing a rib portion of the CR connector.

Other U-shaped rib portions 200*n* are disposed on a vertical wall portion at the upper depth side of the CR connector 216 of the carriage 200 so as to be opposed to the above U-shaped rib portions 200*m*. When being viewed from the upper portion of the carriage 200, the U-shaped rib portions 200*n* are structured as shown in FIG. 56. That is, cylindrical shapes 200*p* are formed at portions where the U-shaped rib portions 200*m* on the bottom surface of the carriage 200 faces the U-shaped rib portions 200*n* disposed on the vertical wall. In the state where the liquid jet head unit 401 is set, spherical protrusions (in more detail refer to the item of the liquid jet head unit which will be described later) disposed above the contact portion contact pads 421 at the depth side of the liquid jet head unit 401 are abutted against the U-shaped rib portions 200*n* disposed on the vertical wall portion.

Figure 57B:
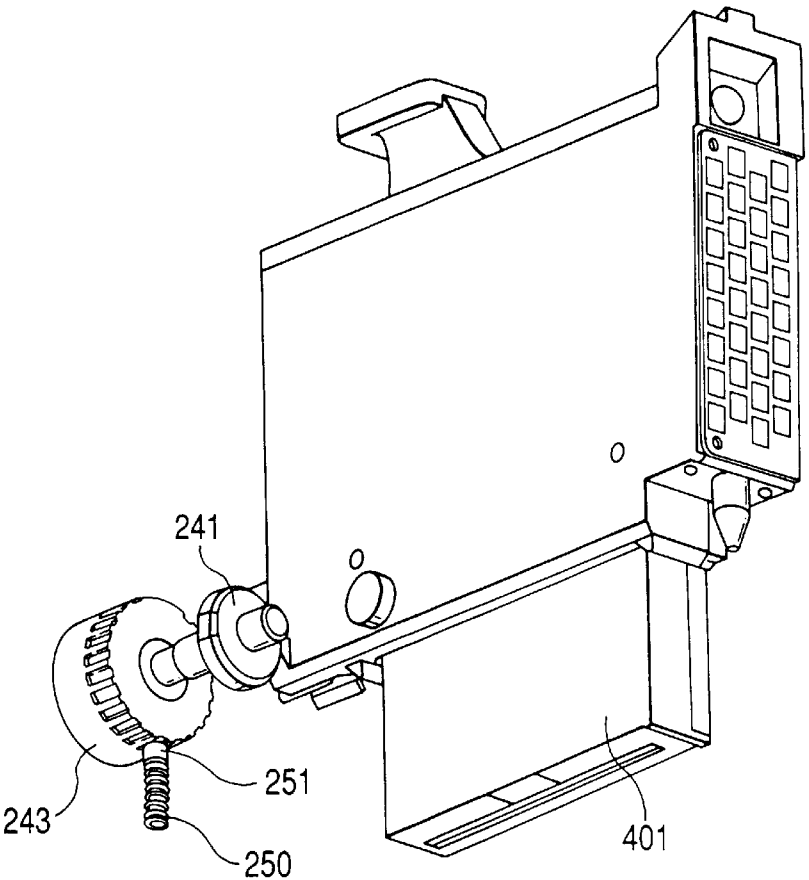
FIGS. 57A and 57B are perspective views showing a rotating direction adjusting mechanism of the liquid jet head.
Figure 57A:
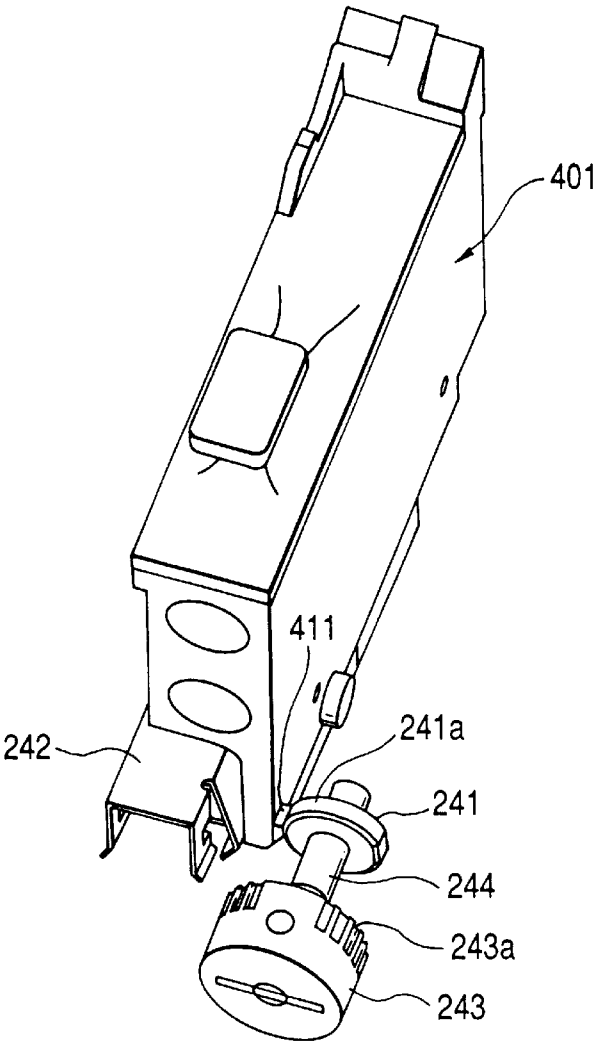

As shown in FIGS. 57A and 57B, a mechanism for adjusting the rotating direction of the liquid jet head unit 401 (an inclination of the nozzle train which constitutes the liquid jet head) (in more detail refer to the item of the liquid jet head unit rotating direction adjusting mechanical portion) is disposed on this side of the carriage 200. This mechanism is made up of a CR head spring 242 formed of a leaf spring and a CR head cam 241. The CR head cam 241 is so rotated as to finely adjust an abutting position of the left peripheral surface 241*a* of the cam, to thereby adjust the rotating direction of the liquid jet heat unit 401. The CR head spring 242 is disposed in such a manner that one surface of the liquid jet head unit 401 opposite to another surface which is in contact with the left peripheral surface 241 of the CR head cam 241 is pushed toward the CR head cam 241. A trapezoidal protrusion 411 is disposed on a portion of the liquid jet head unit 401 which is in contact with the left peripheral surface 241*a* of the CR head cam 241, and the liquid jet head unit 401 is positioned at that portion in the rotating direction (an inclination of the nozzles of the head). In FIG. 57B, reference numeral 251 denotes a small steel ball, and 250 is a spring.

Figure 61:
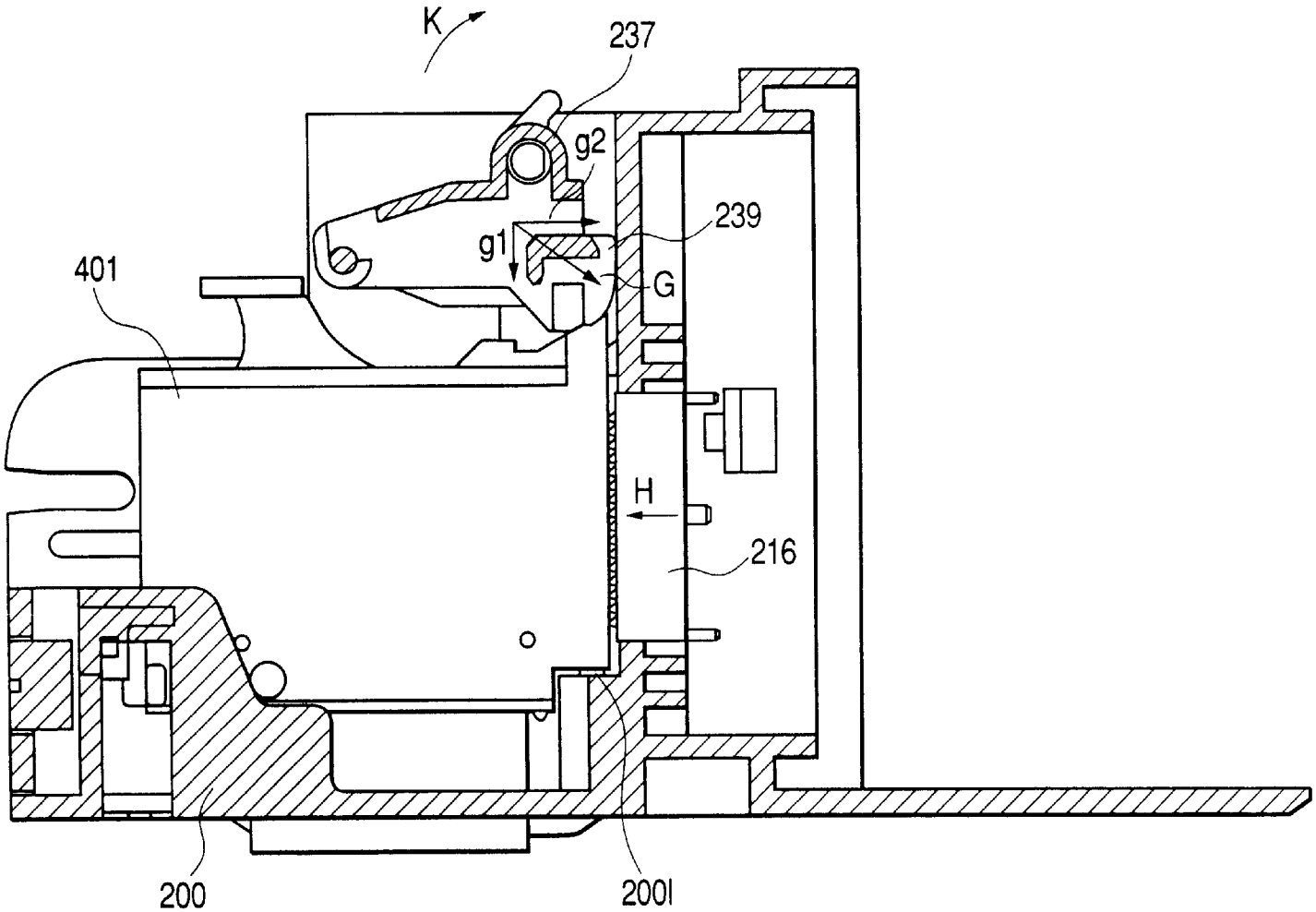
FIG. 61 is a diagram for explanation of the operation of attaching/detaching the head with respect to the cartridge.
Figure 62:
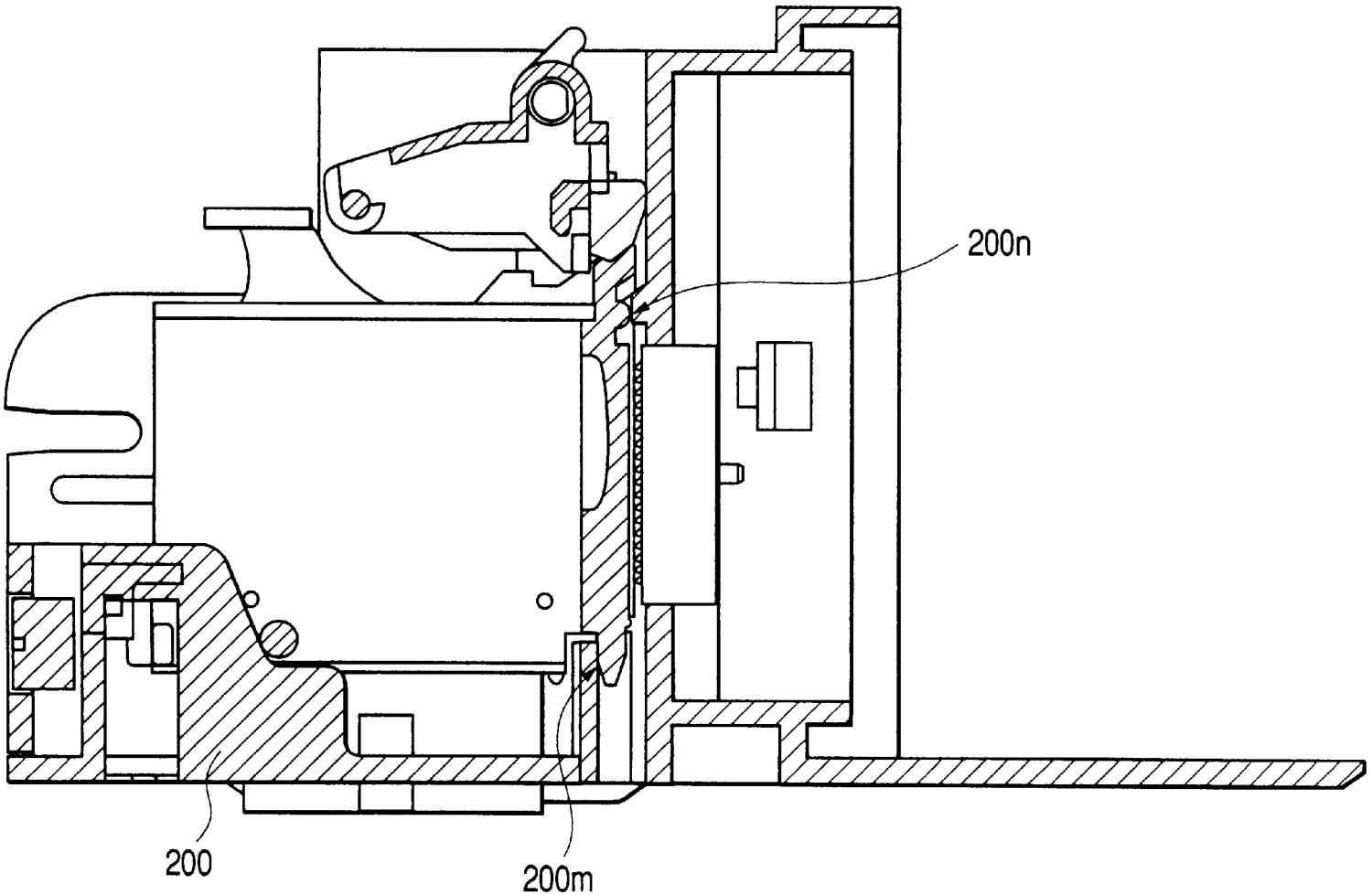
FIG. 62 is a cross-sectional view showing the cartridge in a state where the head is attached to the cartridge.

According to the above-described structure, the positioning of the liquid jet head unit 401 installed in the carriage 200 in the heightwise direction is determined by a downward pushing force g1 of a component force of the head set plate 239, and the abutment of two trapezoidal bosses 2001 whose top surfaces are flat which are disposed on the bottom surface of the carriage 200 against two bosses disposed on the bottom surface of the liquid jet head unit 401, as shown in FIGS. 61 and 62.

Also, the positioning of the liquid jet head unit 401 forward/backward and rightward/leftward is determined by the abutting portion of the U-shaped rib portions 200*m* disposed on the bottom surface of the carriage 200 and the side surfaces of the bosses disposed on the bottom surface of the liquid jet head unit 401, the abutting portion of the U-shaped rib portions 200*n* disposed on the vertical wall at the depth side of the carriage 200 and the spherical portions disposed above the contact portion at the depth side of the liquid jet head unit 401, and the balance of a reaction force H of the CR connector 216 toward this side and a force g2 downward at the depth side of the head set plate 239 due to the CR set plate spring 240 disposed on the CR lever 237. That is, in this embodiment, as shown in FIG. 56, the liquid jet head unit 401 is positioned forward/backward and rightward/leftward with the cylindrical portion 200*p* formed by the opposed U-shaped rib portions 200*m* and 200*n* disposed on the bottom surface of the carriage 200 and the vertical wall at the depth side, respectively, as a center.

Also, as described above, the liquid jet head unit 401 rotates about the cylindrical portion 200*p* formed by the opposed U-shaped rib portions 200*m* and 200*n* disposed on the bottom surface of the carriage 200 and the vertical wall at the depth side, respectively, as a center. The trapezoidal protrusion 411 disposed downward at this side of the liquid jet head unit 401 is inserted between the left peripheral surface 241*a* of the CR head cam 241 disposed at this side of the carriage 200 and the CR head spring 242, to thereby position the liquid jet head unit 401 in the rotating direction (an inclination of the nozzles of the head).

(Carriage Structure: Liquid Jet Head Unit Rotating Direction Adjusting Mechanical Portion)

As described above, the rotating direction adjusting mechanism of the liquid jet head unit 401 disposed at this side of the carriage 200 will be described in more detail with reference to FIGS. 57A and 57B.

The rotating direction adjusting mechanism of the liquid jet head unit 401 is rotatably retained by two pairs of bearing portion configuration disposed at this side of the carriage 200. The rotating direction adjusting mechanism is made up of the CR head cam 241 which is shaped in a disc and has a D-shaped hole in the center thereof and has an axial center, a CR head dial 243 which rotates the CR head cam 241, has grooves 243*a* formed on the outer peripheral surface at regular intervals and has a D-shaped hole in the center thereof, and a CR head shaft 244 which is shaped in a D-cut and connects the CR head cam 241 and the CR head dial 243. Although being not shown, a small steel ball is abutted against the grooves 243*a* defined on the outer periphery of the CR head dial 243 by a spring, as a result of which the rotation of the CR head dial 243 is retained while it is clicked at a given angle.

According to the above structure, when the CR head dial 243 is rotated while it is clicked at a given angle, the CR head cam 241 rotates through the CR head shaft 244, and the left peripheral surface 241*a* of the CR head cam 241 is finely moved. In this situation, the trapezoidal protrusion 411 disposed below this side of the head unit 401 is abutted against the left peripheral surface 241*a* of the CR head cam 241 by the CR head spring 242 which is in the form of a leaf spring and disposed on the carriage 200.

When the CR head cam 241 rotates and the position of the left peripheral surface 241*a* is finely moved as described above, the trapezoidal protrusion 411 disposed below this side of the liquid jet head unit 401 is moved in accordance with the rotating amount of the CR head cam 241, and the liquid jet head unit 401 rotates about the cylindrical portion 200*p* formed by the opposed U-shaped rib portions 200*m* and 200*n* disposed on the bottom surface of the carriage 200 and the vertical wall at the depth side, respectively, as a center. Accordingly, with the adjustment of the rotating amount of the CR head dial 243, the rotating direction (an inclination of the nozzles that discharge the ink in the head) of the liquid jet head unit 401 can be arbitrarily adjusted. In this embodiment, since the adjusting mechanism is provided for each of the liquid jet head units 401, the inclination of the nozzles that discharge the ink in the liquid jet head unit 401 can be finely adjusted for each of the liquid jet head units 401.

(Carriage Structure: Liquid Jet Unit Mounting Procedure)

Subsequently, the mounting procedure of the liquid jet head unit 401 will be described with reference to FIGS. 58 to 62.

Figure 58:
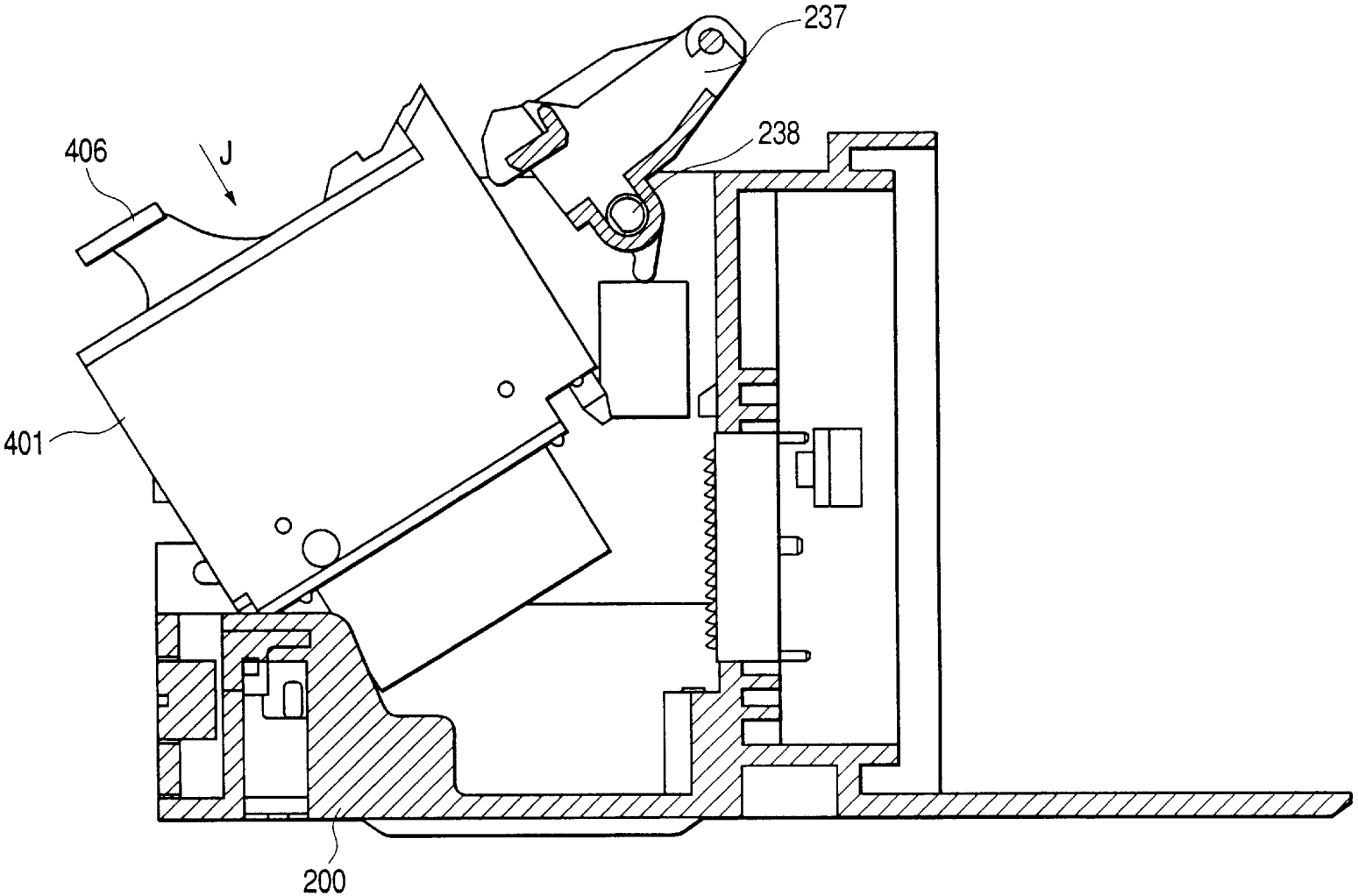
FIG. 58 is a diagram for explanation of the operation of attaching/detaching the head with respect to the cartridge.

First, as shown in FIG. 58, the CR lever 237 is rotated with the CR lever shaft 238 supported at the left and right side plates of the carriage 200 as a center, and the liquid jet head unit 401 is kept in a state where it can be inserted into the carriage 200. In this state, a grip 406 disposed on the upper portion of the liquid jet head unit 401 is held by operator's hand, and the liquid jet head unit 401 is inserted in a direction indicated by an arrow J from this side of the carriage 200 in the state where its nozzles are directed obliquely downward.

Figure 59:
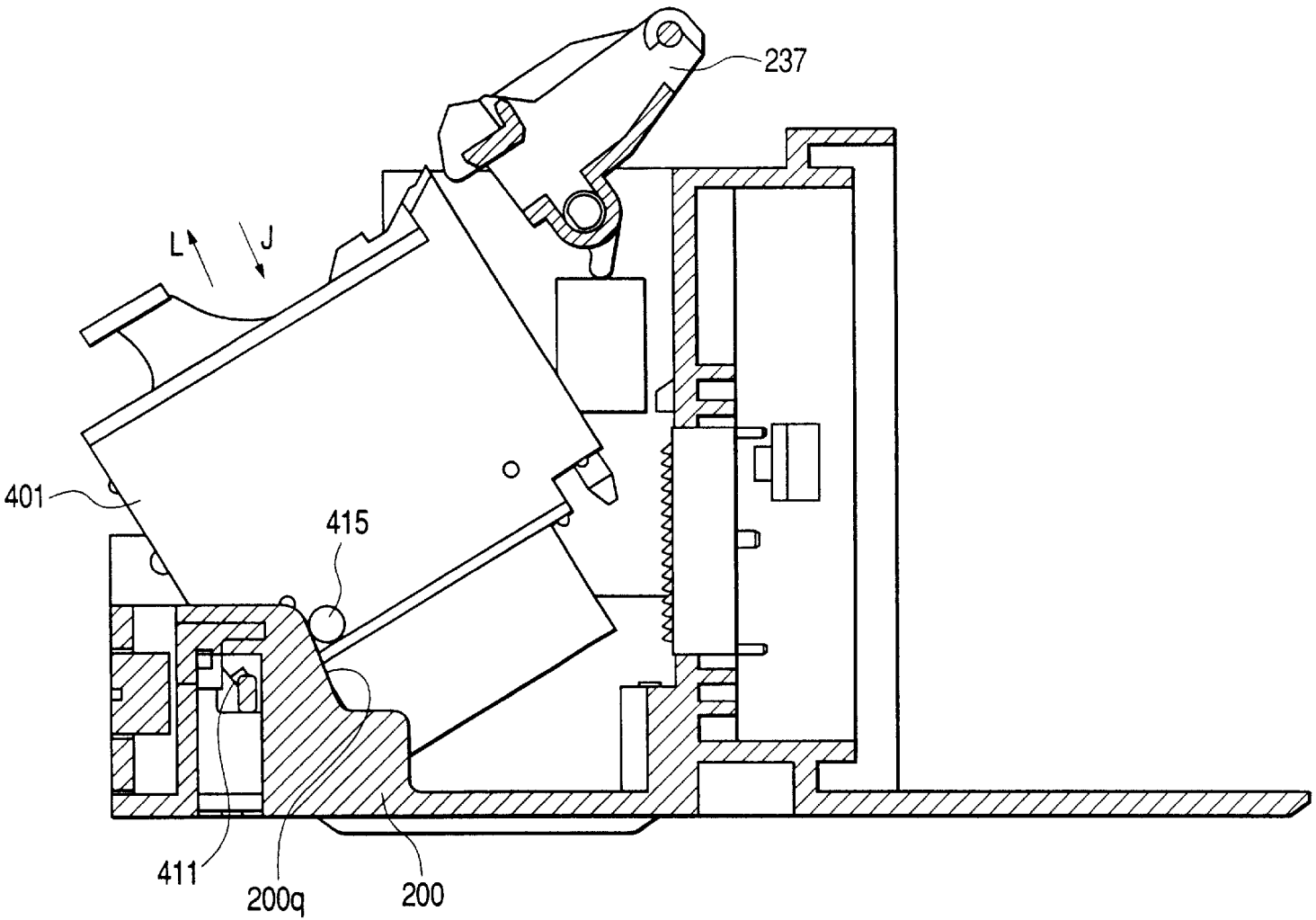
FIG. 59 is a diagram for explanation of the operation of attaching/detaching the head with respect to the cartridge.

When the liquid jet head unit 401 is further inserted into the carriage 200, as shown in FIG. 59, the side surface of the cylindrical protrusion 415 disposed on the right side surface of the liquid jet head unit 401 is abutted against a guide portion 200*q* for head unit insertion guide which is disposed on a wall positioned at the right side of the head unit insertion position of the carriage 200. Then, when the liquid jet head unit 401 is still further inserted into the carriage 200, the liquid jet head unit 401 is received at the head unit insertion position of the carriage 200 while the cylindrical protrusion 415 is guided by the guide portion 200*q*. Then, the trapezoidal protrusion 411 disposed downward at this side of the side surface of the liquid jet head unit 401 is inserted between the CR head cam 241 (refer to FIG. 57A) and the CR head spring 242 (refer to FIG. 57A).

Figure 60:
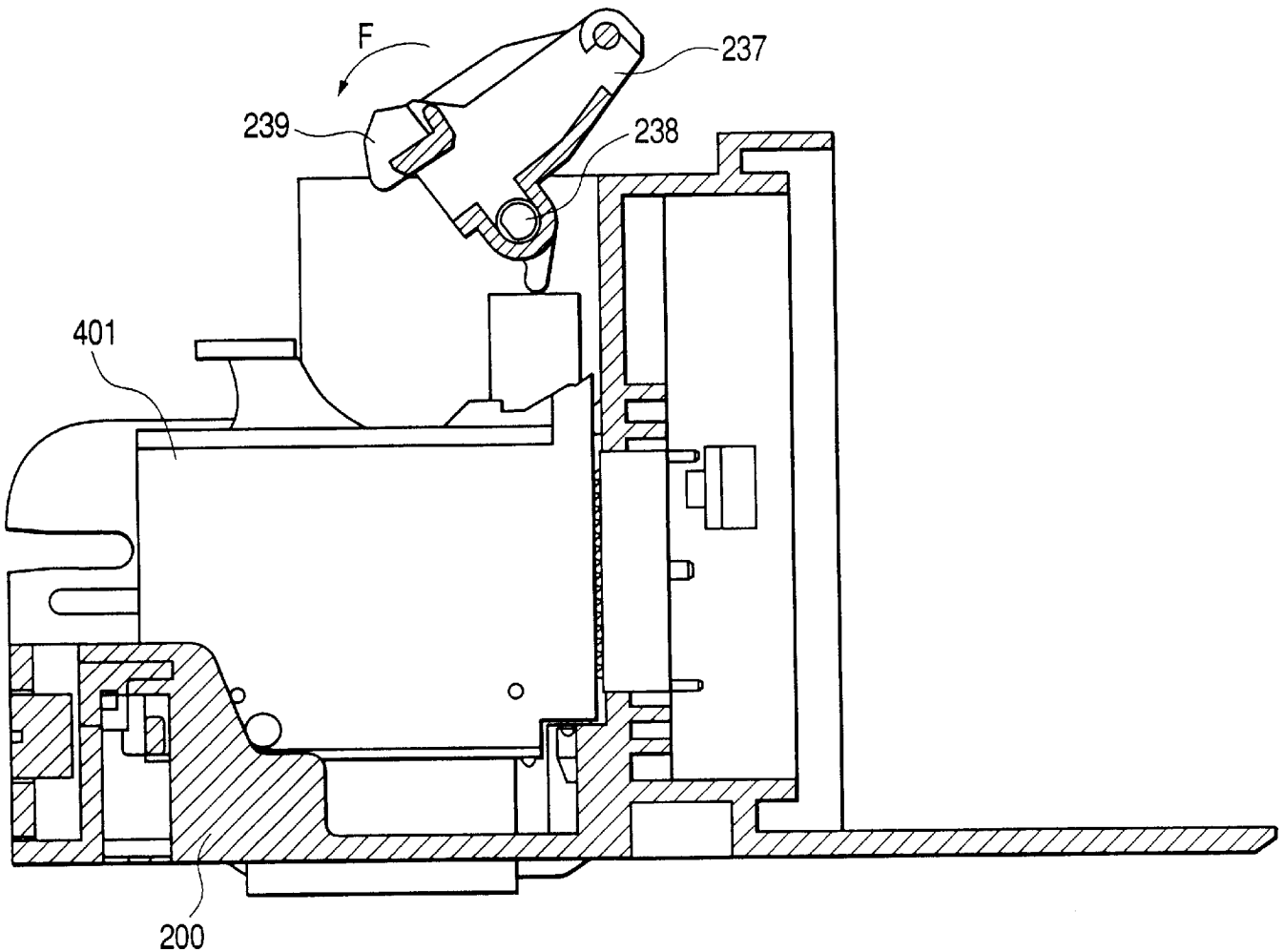
FIG. 60 is a diagram for explanation of the operation of attaching/detaching the head with respect to the cartridge.

After the liquid jet head unit 401 is inserted into the head unit insertion position of the carriage 200, as shown in FIG. 60, the CR lever 237 is rotated in a direction indicated by an arrow F about the CR lever shaft 238 as a center. As a result, the tip portion 239*c* (refer to FIG. 55) of the head set plate 239 retained by the CR lever 237 pushes the liquid jet head unit 401 downward toward the depth side.

As a result, as shown in FIGS. 61 and 62, the liquid jet head unit 401 is retained in a state where it is inserted into the head unit insertion position of the carriage 200, and the attachment of the liquid jet head unit 401 to the carriage 200 is completed.

(Carriage Structure: Liquid Jet Head Detaching Procedure)

The procedure of detaching the liquid jet head unit 401 from the carriage 200 is reverse to the above-described attaching procedure.

First, as shown in FIGS. 61 and 62, the CR lever 237 is rotated in a direction indicated by an arrow K with the CR lever shaft 238 as a center from a state where the liquid jet head unit 401 is received at the head unit insertion position of the carriage 200, and the pressurization of the tip portion 239*c* of the head set plate 239 toward the liquid jet head unit 401 is released.

As a result, the liquid jet head unit 401 is pushed toward this side by the reaction H of the CR connector 216 mounted on the carriage 200 in the direction of this side. In this situation, because an side surface of the cylindrical protrusion 415 of the liquid jet head unit 401 is abutted against the guide portion 200*q* of the carriage 200, the liquid jet head unit 401 obliquely erects and comes to a state shown in FIG. 59.

In this state, the operator holds the grip 406 of the liquid jet head unit 401 and draws out the liquid jet head unit 401 from the carriage 200 in a direction indicated by an arrow L shown in FIG. 59. As a result, the liquid jet head unit 401 is detached from the carriage 200.

(Recovery System Unit)

Subsequently, a description will be given of the recovery system unit 300 disposed for eliminating the discharge failure or a twist (the ink is discharged in an abnormal direction, and a position at which the ink droplet is landed is shifted) which is caused by attaching dusts onto the periphery of the nozzle of the liquid jet head unit 401 or drying the ink stuck on the interior of the nozzle or the nozzle surface 401*a* to increase the viscosity of the ink.

The discharge performance recovery means provided in the recovery system unit 300 in this embodiment is mainly made up of the following three means.

One of the discharge performance recovery means is preliminary discharge means for discharging the ink from all of the nozzles in a region except for the printing medium, in this embodiment, in a given region disposed in the recovery system unit 300 at the time of non-printing to discharge a thickener ink within the nozzles or around the nozzles or another kind of ink that enters the nozzles in the case where plural kinds of inks can be discharged in the same apparatus, and the discharged ink is carried to the waste ink tank.

Another discharge performance recovery means is wiping means disposed for removing a mist discharged together with the main ink droplet discharged for printing, a rebounded mist occurring when the main ink droplet is landed on the printing medium, an ink attached onto the nozzle formation surface through the suction recovery process which will be described later, etc. The wiping means is made up of, for example, a blade 303 formed of an elastic member such as rubber.

Still another discharge performance recovery means is the suction recovery means. The suction recovery means abuts a cap 308 made of an elastic material such as rubber against the nozzle surface 401*a* of the liquid jet head unit 401. so as to be in close contact with the nozzle surface 401*a,* reduces an air pressure within the cap 308 to the atmospheric pressure or lower by pumping means to forcibly discharge the ink from the nozzles, to thereby remove the discharge interruption elements such as the dusts within the nozzles, a dry ink or bubbles due to the ink flow. Thereafter, the sucked ink is carried to the waste ink tank and then processed.

Subsequently, the structure of the recovery system unit 300 in this embodiment will be described.

Figure 27:
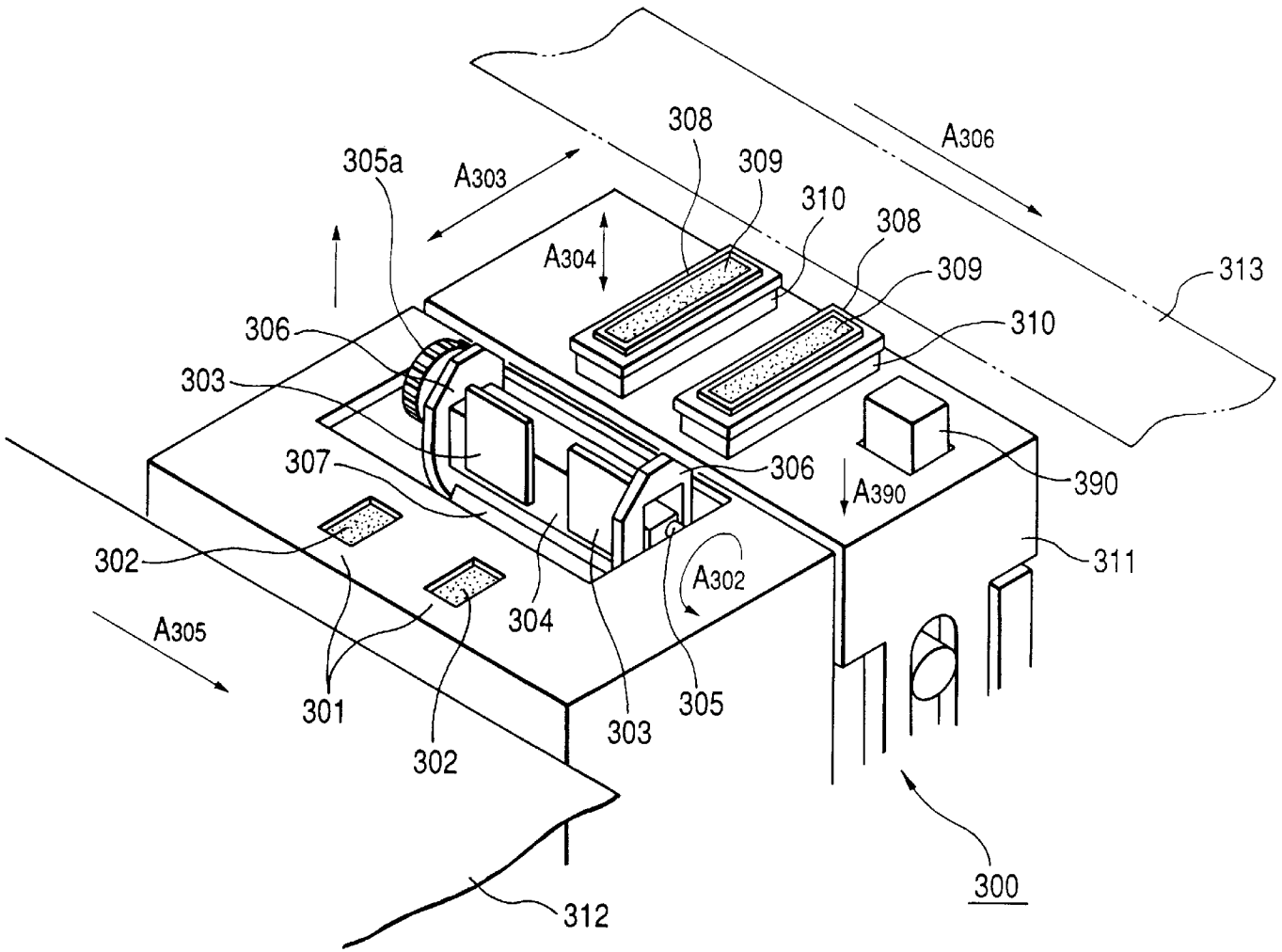
FIG. 27 is a perspective view showing a recovery system unit.

FIG. 27 shows a perspective view of the appearance of the recovery system unit 300. The recovery system unit 300 is fixed to the CR frame 201 where a carriage scanning guide member such as the CR shaft 202 which is inserted into the carriage 200 is disposed so that the relative position of the carriage 200 and the liquid jet head unit 401 is ensured with a high precision.

A preliminary discharge port (a preliminary discharge acceptance port 301) is so formed as to be shorter than the overall length of the nozzle train of the liquid jet head unit 401 in a direction of the nozzle train of the liquid jet head unit 401. This structure can be achieved by not conducting the preliminary discharge from all of the nozzles at the same time, but sequentially conducting the preliminary discharge from the nozzles little by little, separately. With this structure, the recovery system unit 300 is downsized. Also, in this embodiment, in order to prevent a preliminary discharge processing period of time from increasing due to the separate discharge, a so-called moving (flow) preliminary discharge method in which the discharge is conducted while the carriage 200 is being scanned is applied. In more detail, it is assumed that 616 nozzles disposed on the liquid jet head unit 401 are divided into, for example, 10 blocks in total, consisting of 9 blocks each having 62 nozzles and 1 block having 58 remaining nozzles. Also, the number of times of preliminary discharge for each of the nozzles in the preliminary discharge operation is 200, the discharge frequency is 8 kHz and the nozzle arrangement pitches are 600 dpi. Under the above conditions, if the ink discharge is sequentially conducted from the nozzle blocks in the moving direction of the carriage 200 while the carriage 200 is being moved at a given speed of 105 mm/sec, the ink is landed in an area of just twice as long as the 62 nozzles, that is, about 5.25 mm. Accordingly, in this embodiment, the length of the preliminary discharge port 301 is set to 8 mm slightly longer than the above-described landed area. That is, the length of the preliminary discharge port 301 becomes ⅓ or less with respect to the nozzle train about 26 mm in length. Also, within the preliminary discharge port 301 is disposed a preliminary discharge absorber 302 formed of a porous resin member so as to retain the discharged ink and collect the ink through a preliminary discharge port idle suction process which will be described later without remaining.

At the time of the above flow preliminary discharge operation, it is not always necessary to scan the carriage 200 at the given speed, and for example, in order to reduce the processing period of time, a ramp-up or ramp-down area of the carriage 200 may be employed to conduct the preliminary discharge operation.

Also, the carriage 200 may not conduct the discharge operation while the carriage 200 is being scanned as described above. That is, the carriage 200 may be moved not continuously but intermittently so that the preliminary discharge operation is conducted at a stop state in such a manner that after the carriage 200 is moved one by one for each of the nozzle blocks and then stopped above the preliminary discharge port 301, the preliminary discharge operation is conducted a given number of times.

One blade 303 formed of an elastic material plate which is made of rubber or the like is provided for each of two liquid jet head units 401. This has the effects of eliminating an adverse affect of a difference in the heights of the nozzle surfaces 401*a* of the two liquid jet head units 401, and preventing such a drawback that various inks are mixed together in the case where the kinds of inks discharged from those two liquid jet head units 401 are different from each other, as compared with the integral structure. Each of the blades 303 is fixed onto a blade holder 304, and the blade holder 304 is elastically urged through a blade spring which will be described later upward (in a direction indicated by an arrow $A_{301}$) with respect to a blade shaft 305 integrated with a blade gear 305*a*. Also, because the blade shaft 305 is rotatable in a direction indicated by an arrow $A_{302}$ by blade driving means which will be described later, the blade 303 engaged with the blade shaft 305 is rotatable likewise. In addition, the blade holder 304 is integrated with a blade cam 306, and when the carriage 200 is scanned on the wiping means in a direction indicated by an arrow $A_{303}$, the wiping means is elastically pushed down to a blade rib (not shown) on the carriage 200, thereby being capable of executing wiping operation while the overlapped amount (hereinafter called "entry amount") of the blade 303 and the nozzle formation surface of the liquid jet head is ensured with a high precision. With this structure, a stable entry amount can be ensured regardless of an error in the mounting position of the liquid jet head unit 401 and the recovery system unit 300 in the heightwise direction, and the excellent wiping operation can be always executed.

Also, in this embodiment, there are also provided a blade cleaner 307 which will be described later, a cap 308 formed of an elastic member such as rubber, a cap absorber 309 made of a porous material and disposed within the cap 308, a cap holder 310 that retains the cap 308, and a cap lever 311 which urges the cap holder 310 through a cap spring not shown in a direction indicated by an arrow $A_{304}$ and is vertically movable so as to open or close the cap by a cap level cam which will be described later. The respective conveying directions of the envelope 312 and the continuous sheet (tape) 313 which are printing medium are indicated by arrows $A_{305}$ and $A_{306}$. Also, the carriage lock arm 390 is a member which is engaged with a hole (not shown) disposed in the carriage 200 to fix the carriage when capping is conducted, that is, when the cap lever 311 climbs, and to prevent the positions of the liquid jet head unit 401 and the cap 308 from shifting due to an impact. Also, a carriage lock arm 390 can elastically drop in a direction indicated by an arrow $A_{390}$ since the carriage lock arm 390 is attached onto the cap lever 311 through a lock spring not shown. For that reason, even if the carriage lock arm 390 is abutted against a portion except for the hole portion of the carriage 200, the recovery system unit 300 and the carriage 200 are not damaged.

As described above, in this embodiment, since the envelope conveying space, the preliminary discharge port, the wiping means, the capping means, the continuous sheet conveying space are arranged in the stated order for the reasons stated below.

First, the cap 308 will be described. A drawback such as an ink leakage is caused when a foreign substance, a dry ink or the like is attached and deposited onto the close contact surface (normally, the tip surface of the annular rib disposed so as to cover the nozzle train) of the cap 308 with the nozzle surface 401*a* for preventing the ink within the nozzles from being dried or for forcibly discharging the ink from the nozzles through the suction means which will be described later. Also, the main foreign material in the printing apparatus according to the present invention is a fiber foreign material called "paper powder" which is derived from the printing medium which is being conveyed. However, in this embodiment, the paper powder is hardly produced from the continuous sheet, but a large amount of paper powder is produced from the envelope. Also, as to the ink mist, although the mist is flied from the print position, the amount of ink mist flied out from the blade during the wiping operation is remarkably more. For the above reason, in order to minimize the amount of paper powder and the amount of ink which are flied to the cap, the cap 308 is disposed at a position which is the farthest from the envelope print position and to which the ink is not flied from the blade 303 during the wiping operation.

Also, since the blade 303 flies the ink during the wiping operation as described above, in order to prevent the cap 308 as well as the printing medium from being stained, it is necessary that the blade 303 of the wiping means keeps apart from the print position more than a given distance. Therefore, the preliminary discharge port is disposed between envelope conveying space and the wiping means to keep a sufficient space from the print position (envelope conveying space).

Figure 28:
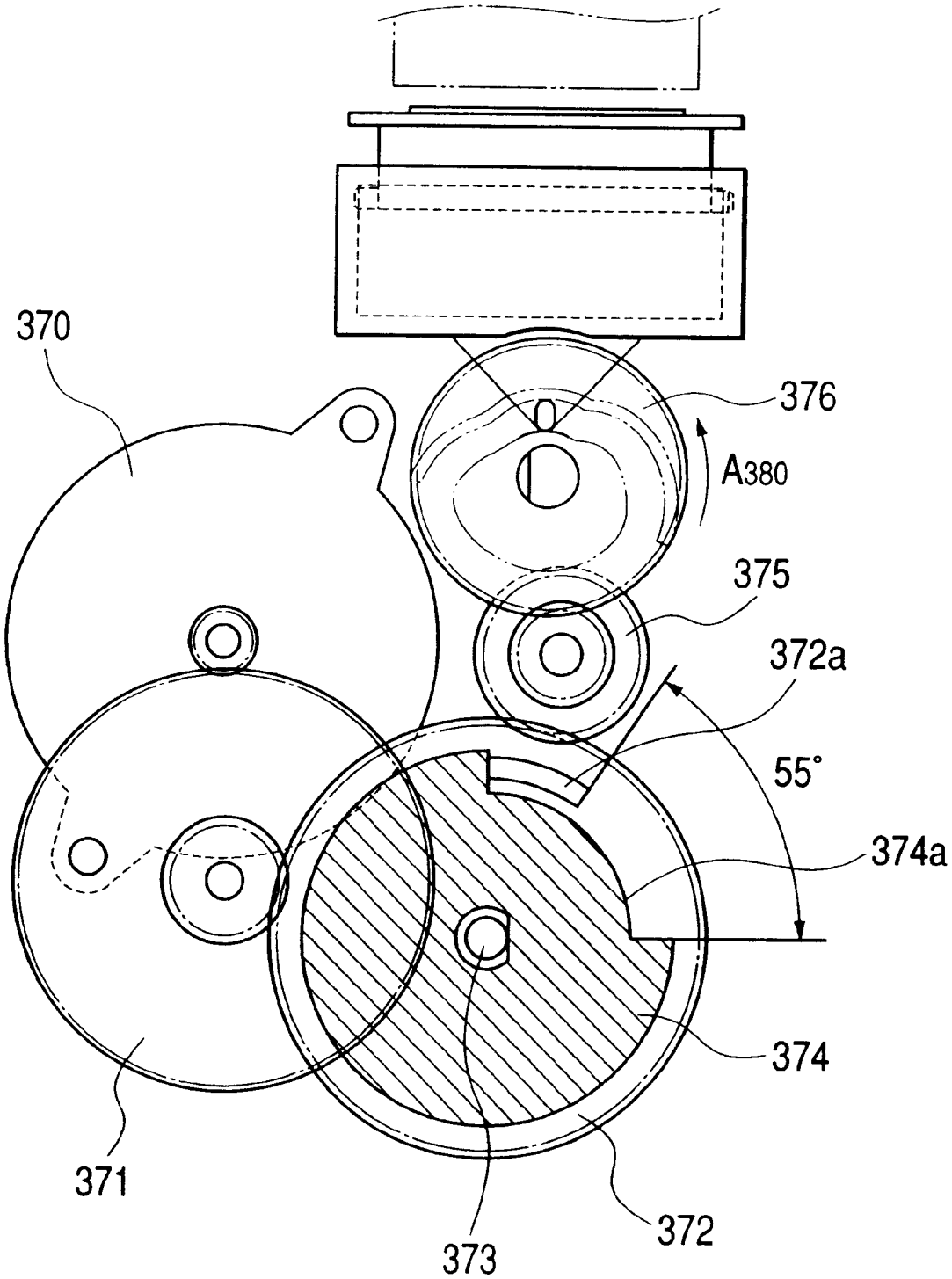
FIG. 28 is a schematic view showing a driving system of the recovery system unit.

FIG. 28 is a diagram showing the structure of the driving system of the recovery system unit 300.

The driving system is provided with a motor 370 exclusively for driving recovery system fitted to a rotating shaft of which is fitted to a gear, a first double gear 371 for deceleration which is a next-stage gear of the motor 370, an idler gear 372 which is engaged with the first double gear 371 and rotatable about a pump shaft 373 to which a roller guide which will be described later is fitted as a rotary center, and a pump cam 374 (indicated by oblique lines in the figure) which is fitted to the pump shaft 373 and has a notch portion 374*a* that is engaged with a rib 372*a* formed on the idler gear 372 as well as fitted to the pump shaft 373. Play is provided between the rib 372*a* and the notch portion 374*a* by a rotating angle of 55°. There are also provided a second double gear 375 which is engaged with the idler gear 372 and a one-way clutch 376 of the gear integral type which generates a fastening torque to a cam shaft to be described later which is its rotating center only when rotating in a direction indicated by an arrow $A_{380}$.

Figure 29:
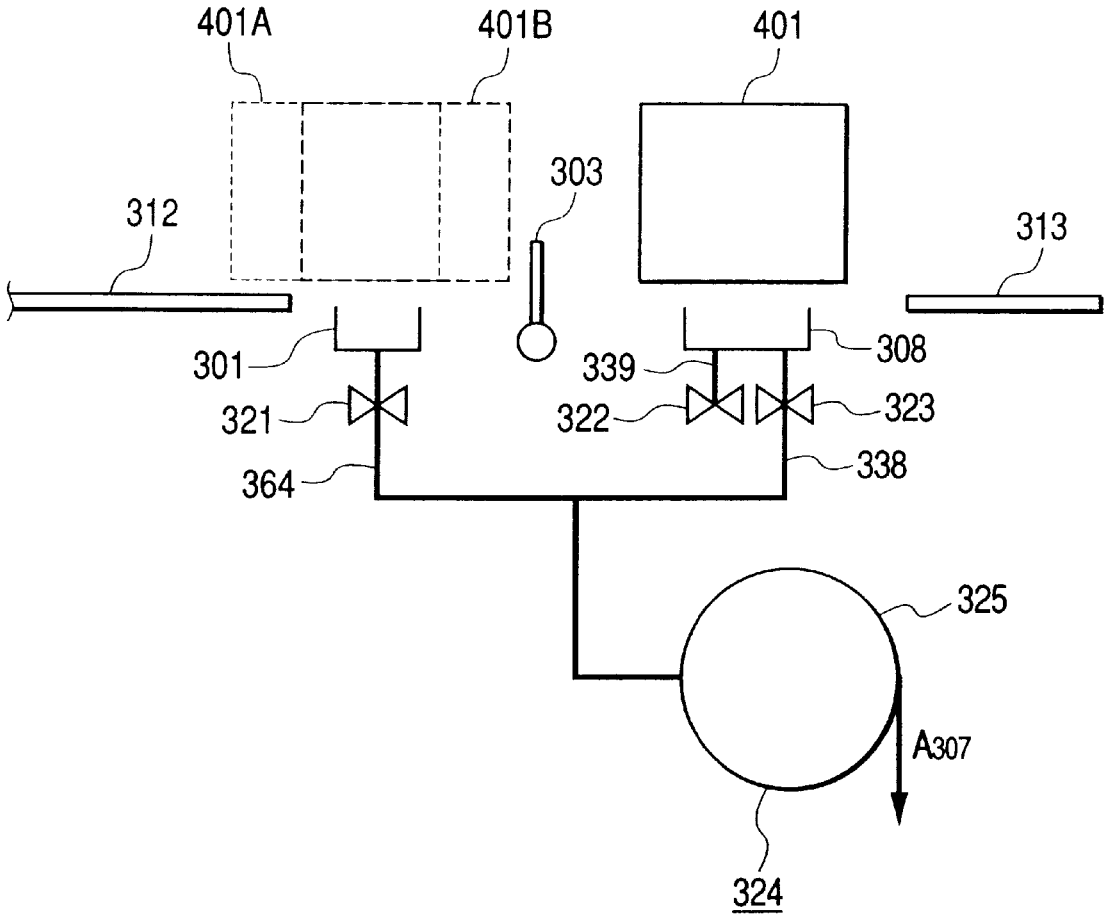
FIG. 29 is a diagram showing a relationship between a liquid path and a valve in the recovery system unit.

FIG. 29 is a diagram showing the structure of an ink flow path and a valve of the recovery system unit 300. In this embodiment, there are provided two-system flow paths to two liquid jet head units 401. However, for simplification of a description, FIG. 29 shows only a one-system flow path for one liquid jet head unit 401.

In this embodiment, a preliminary discharge valve 321, an atmosphere communication valve 322, a suction valve 323 and negative pressure generating means (a tube pump 324 in this embodiment) for generating a negative pressure when the liquid jet head unit 401 is sucked and recovered are provided in correspondence with the liquid jet head unit 401.

First, a state of the valve in the case of executing a preliminary discharge port idle suction process for collecting the ink discharged through the preliminary discharge process will be described. The preliminary discharge operation is executed while the liquid jet head unit 401 is moving from 401A to 401B. Thereafter, only the preliminary discharge valve 321 is opened, two other valves 322 and 323 are closed, and the tube pump 324 is driven by the above-described driving system, to thereby generate a negative pressure within the tube. With the above operation, the ink reserved within the preliminary discharge port 301 passes through the preliminary discharge tube 364 and the pump tube 325, and is discharged in a direction indicated by an arrow $A_{307}$ before being supplied to waste ink processing means not shown.

Subsequently, the state of the valve at the time of executing the suction recovery process will be described. In FIG. 29, the cap 308 is isolated from the liquid jet head 401, but in fact, the suction recovery process is executed in a state where a cap lever cam 350 which will be described later is driven to elevate the cap lever 311 which urges the cap 308, and the cap 308 is elastically brought in close contact with the nozzle surface 401*a* of the liquid jet head unit 401 so that the nozzle train is covered with the cap 308. After the tube pump 324 is operated in a state where the preliminary discharge valve 321, the atmosphere communication valve 322 and the suction valve 323 are closed, only the suction valve 323 is opened and a pressure within the cap 308 is momentarily reduced, to thereby suck the ink within the cap 308. In the idle sucking operation conducted for collecting the ink inside of the cap 308, the cap tube 338, the pump tube 325 and so on, after the atmosphere communication value 322 and the suction valve 323 are opened in a state the cap 308 is brought in close contact with the liquid jet head unit 401, coming to a state where an air is taken from the atmosphere communication tube 339, the tube pump 324 is actuated.

Subsequently, the mechanism of the tube pump 324 will be described with reference to FIGS. 30 and 31.

The roller guide 327 is provided with two rollers 326 so that those two rollers 326 are rotatable with a phase shift of 180°. Also, the roller guide 327 is formed with grooves 327*a* into which shaft portions 326*a* disposed on both ends of the rollers 326 are inserted, and each of the rollers 326 is movable along the groove 327*a*. Then, each of the rollers 326 can crush and squeeze the pump tube 325 made of silicon while the roller 326 is rotating. A roller damper 328 is formed of an elastic member such as rubber.

Figure 30:
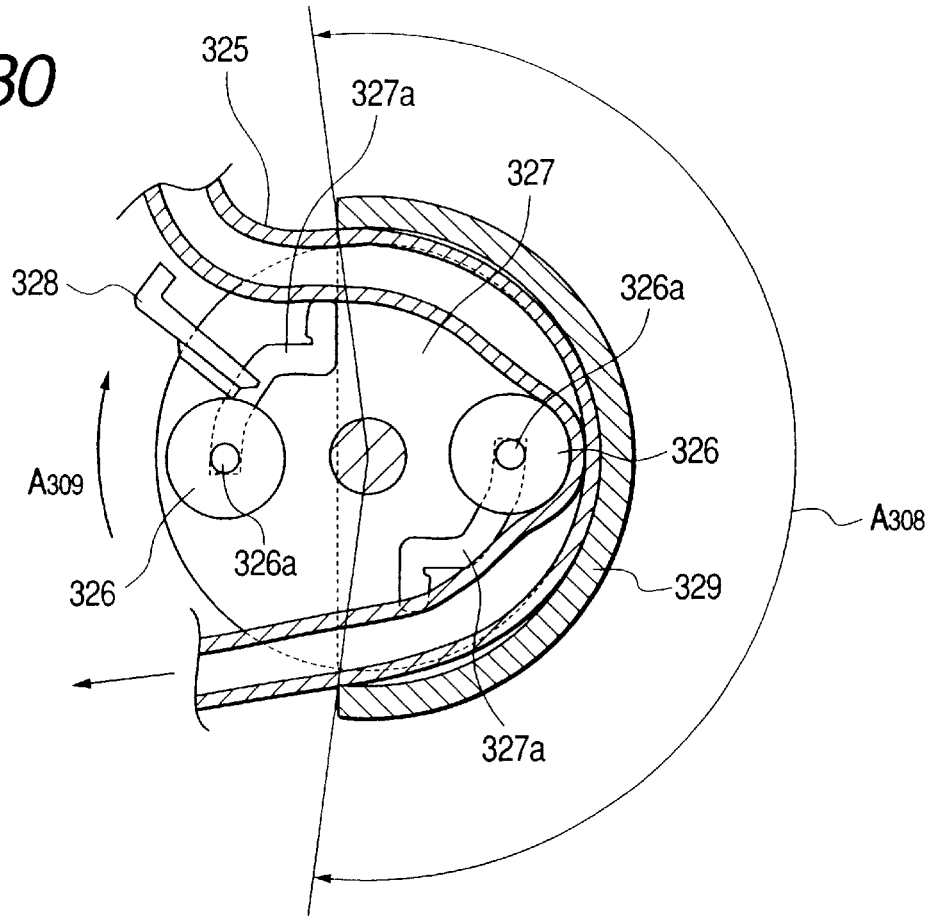
FIG. 30 is a schematic view showing a negative pressure generating state of a tube pump.

FIG. 30 shows a state in which the tube pump 324 is actuated to generate a negative pressure. The roller 326 drawn to one end portion of the groove 327*a* is moved to the most outer periphery and rotates while crushing the pump tube 325 and squeezes the pump tube 325. Each of the roller dampers 328 draws the roller 326 to one end portion of the groove 327*a* out of a pump tube crush area $A_{308}$. Because those two rollers 326 have the phase shift of 180° and the tube guide 392 is disposed in an area of 180° or more as indicated by $A_{308}$, the tube pump 324 always continues to generate the negative pressure continuously while the roller guide 327 is rotating in a direction indicated by an arrow $A_{309}$.

Figure 31:
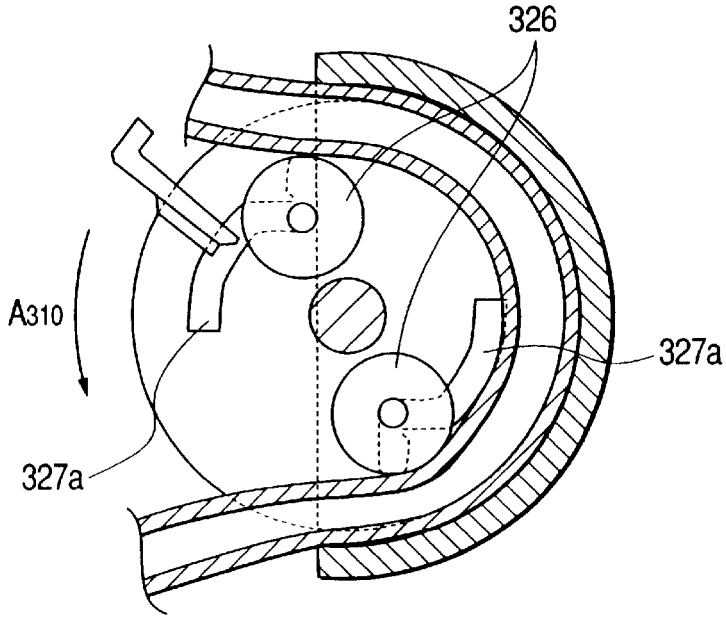
FIG. 31 is a schematic view showing the negative pressure generating state of the tube pump.

FIG. 31 is a diagram showing the operation in the case where the roller guide 327 is rotated in an opposite direction to that in FIG. 30 (in a direction indicated by an arrow $A_{310}$). In this case, the roller 326 is drawn to another end portion of the groove 327*a* in the opposite direction to that in FIG. 30 due to a load produced when the roller 326 interferes with the pump tube 235 and the roller damper 328, and the roller 326 escapes toward the rotary center direction of the roller guide 327. In the state, in fact, the roller 326 idles without crushing the pump tube 325. Therefore, no negative pressure is produced, and the pump tube 325 is not crushed and does not creep with no anxiety. Accordingly, it is desirable that the printing apparatus is kept in that state at the time of power. off or printing standby where the printing operation may suspend for a long period of time. In order to surely shift from the state shown in FIG. 30 to the state shown in FIG. 31, the rotation angle of 40° is required in the structure of this embodiment.

Subsequently, the structure of the valve mechanism will be described with reference to FIGS. 32 to 34.

First, the preliminary discharge valve 321 will be described with reference to FIG. 32. In this embodiment, there are provided a preliminary discharge valve cam 330 that controls the open/close operation of the preliminary discharge valve 321, a valve holder 331 that is installed with all of valves, a preliminary discharge valve rubber 332 which is formed of a diaphragm valve made of an elastic material such as rubber, a valve shaft 333*a* which is engaged with the preliminary discharge valve rubber 332 or a suction valve rubber 342 which will be described later, a first valve arm 334*a* which is engaged with the valve shaft 333*a,* a cam follower 335*a* which is abutted against the first valve arm 334*a* and the preliminary discharge valve cam 330 or a suction valve cam 341 which will be described later, a first valve arm spring 336*a* that urges the first valve arm 334*a* toward the preliminary discharge valve cam 332 or the suction valve cam 341, and a valve tube 337 that forms an ink flow path extending from the preliminary discharge valve 321 to a suction valve 323 which will be described later.

Figure 32:
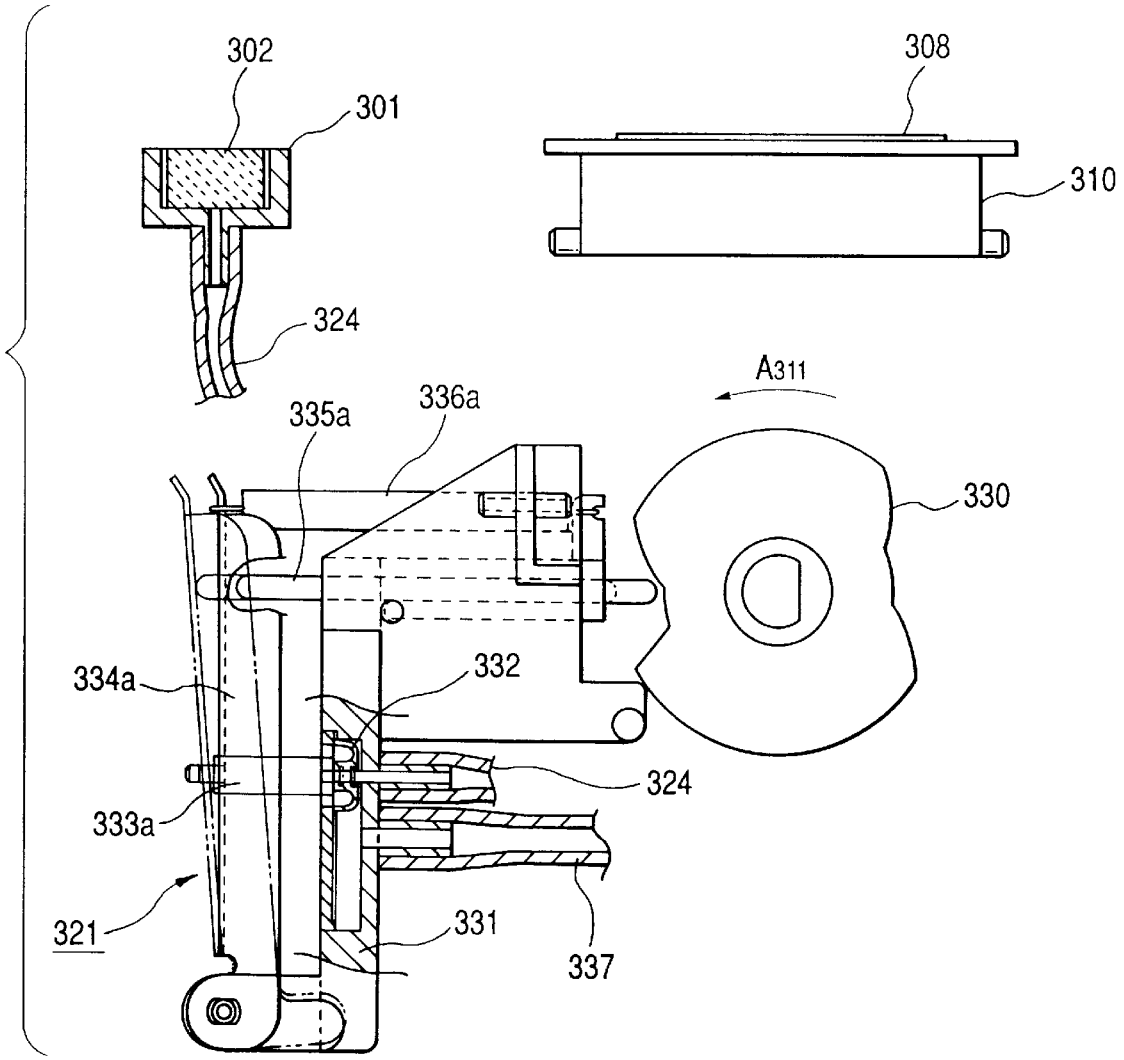
FIG. 32 is a schematic view showing the operation of an auxiliary discharge valve.

In FIG. 32, the preliminary discharge valve rubber 332 is positioned within the valve holder 331, and a state in which a flow path connecting between the preliminary discharge tube 364 and the valve tube 337 is closed is indicated by solid lines. When the preliminary discharge valve cam 330 rotates in a direction indicated by $A_{311}$ and the first valve arm 334*a* rotates up to a state indicated by alternate long and two short dashes lines from the above state, the valve shaft 333*a* is moved up to a position indicated by the alternate long and two short dashes lines, the preliminary discharge valve 321 is opened, and the flow path between the preliminary discharge tube 364 and the valve tube 337 is opened.

Figure 33:
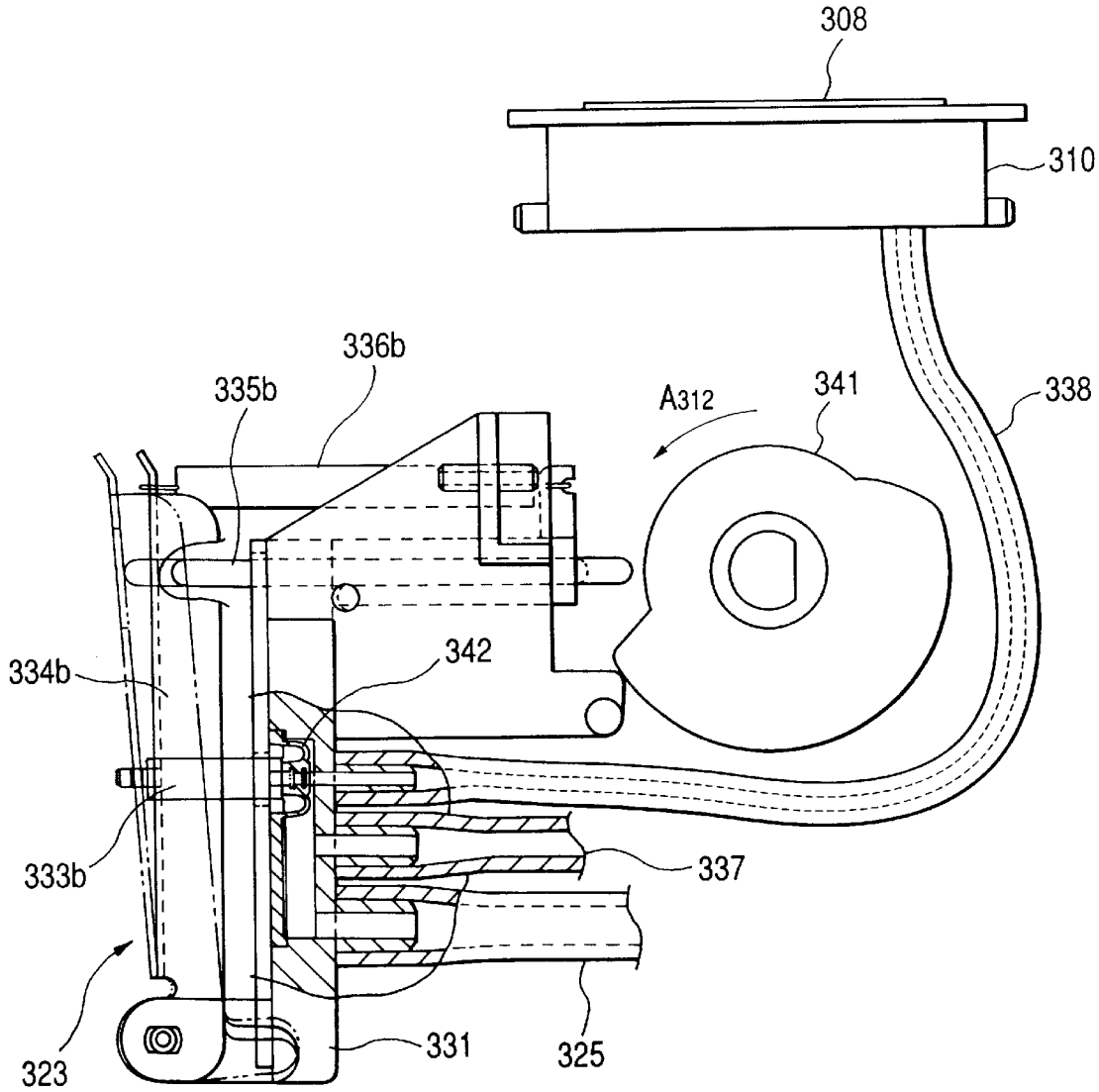
FIG. 33 is a schematic view showing the operation of a suction valve.

In FIG. 32, reference numerals to the end of which "a" is added represent members used for the preliminary discharge valve mechanism in the respective members, and in FIG. 33, reference numerals to the end of which "b" is added represent members used for the suction valve mechanism in the respective members. However, although only the portions for which the respective members are used are different, their functions and configurations are identical and therefore their description will be omitted.

FIG. 33 is a diagram showing the operation of the suction valve 323. In this embodiment, there are provided a suction valve cam 341 that controls the operation of the suction valve 323, a suction valve rubber 342 which is formed of a diaphragm valve made of an elastic material such as rubber, and a cap tube 338 that forms an ink flow path extending from the cap 308 to the valve holder 331.

In FIG. 33, a state in which the suction valve 323 is closed is indicated by solid lines, and the cap tube 328 and the valve tube 337 are closed by the same structure as that of the above-described preliminary discharge valve 321. When the suction valve cam 341 rotates in a direction indicated by $A_{312}$ and the first valve arm 334*b* rotates up to a state indicated by alternate long and two short dashes lines, the valve shaft 333*b* is moved up to a position indicated by the alternate long and two short dashes lines, the suction valve 323 is opened, and the flow path between the cap tube 338 and the valve tube 337 is communicated.

Figure 34:
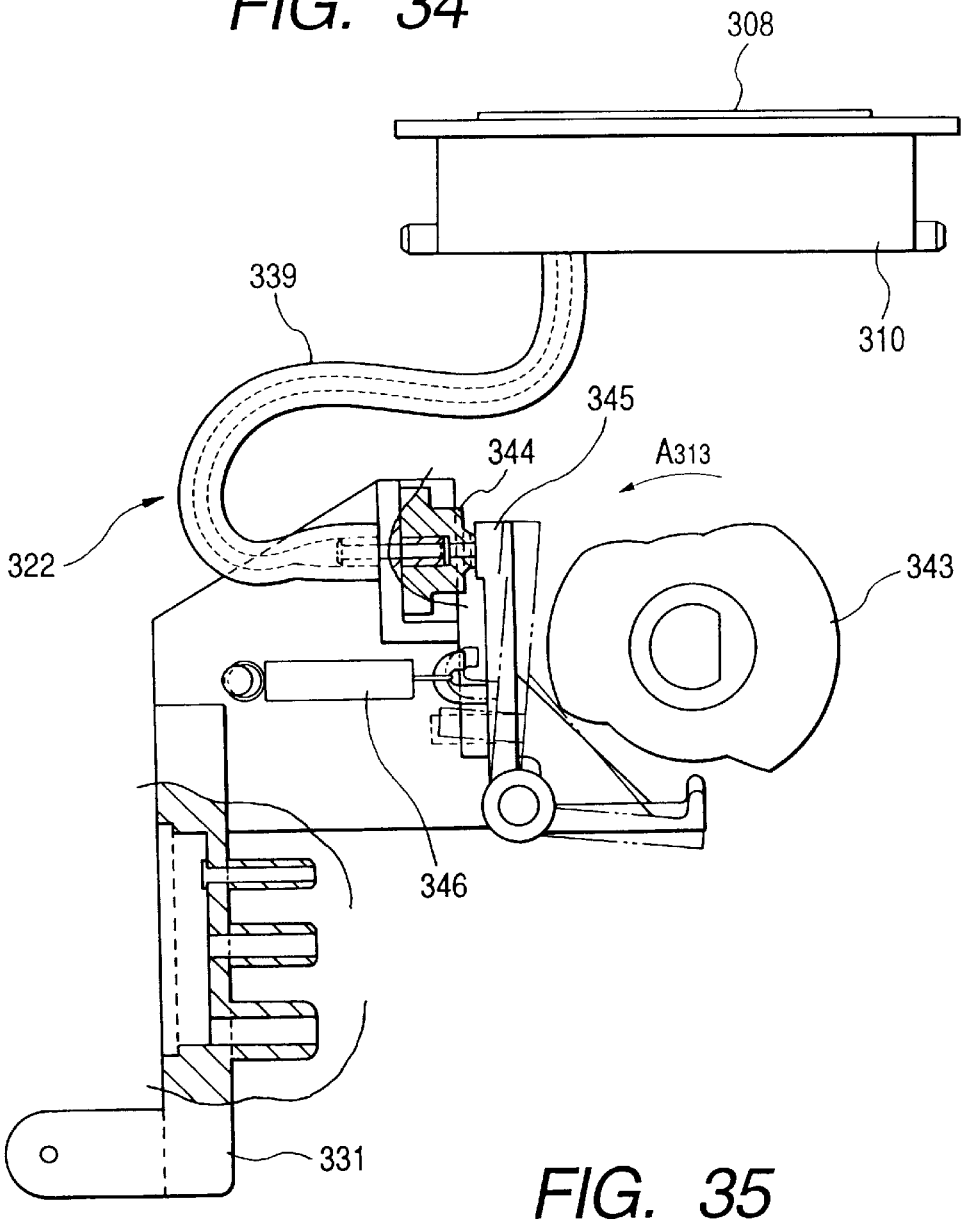
FIG. 34 is a schematic view showing the operation of an atmosphere communication valve.

FIG. 34 is a diagram showing the operation of the atmosphere communication valve 322. In this embodiment, there are provided an atmosphere communication valve cam 343 that controls the operation of the atmosphere communication valve 322, an atmosphere communication valve rubber 344 which is made of an elastic material such as rubber, and a second valve arm spring 346 that urges the second valve arm 345 and the second valve arm toward the atmosphere communication valve.

In FIG. 34, a state in which the atmosphere communication valve 322 is closed is indicated by solid lines. When the atmosphere communication valve cam 343 rotates in a direction indicated by $A_{313}$ and the second valve arm 345 rotates up to a state indicated by alternate long and two short dashes lines, the atmosphere communication tube 339 is opened to the atmosphere.

The atmosphere communication valve 322 is different from the above-described preliminary discharge valve 321 and suction valve 323, and the atmosphere communication tubes 339 connected to the two-system ink flow paths, that is, two caps 308 are collected into one tube by a joint member not shown and connected to the atmosphere communication valve rubber 344. Therefore, one valve mechanism may be provided for two caps 308.

Figure 35:
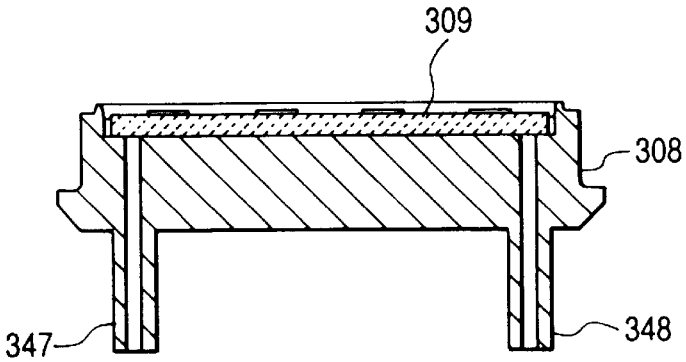
FIG. 35 is a cross-sectional view showing a cap.

FIG. 35 is a cross-sectional view of the cap 308. The cap 308 is equipped with a connecting portion 347 to the atmosphere communication tube 339 and a connecting portion 348 to the cap tube 338.

Figure 36:
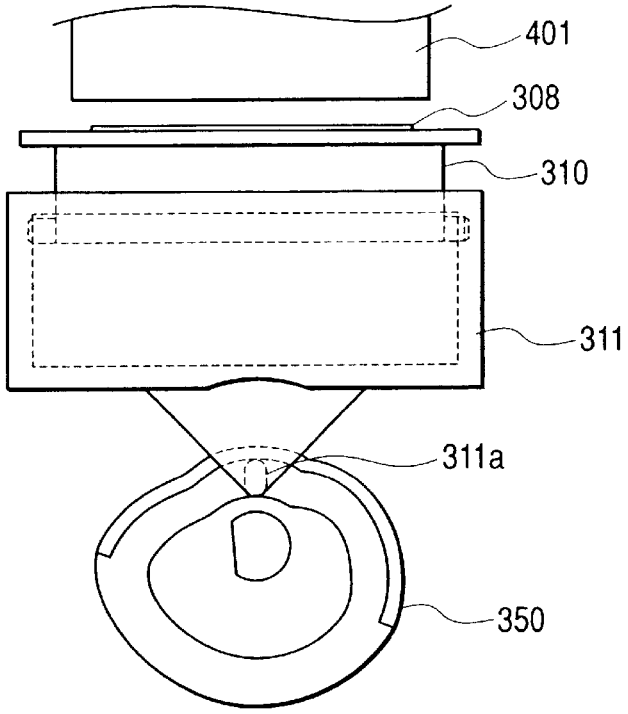
FIG. 36 is a schematic view showing a cap open state.
Figure 37:
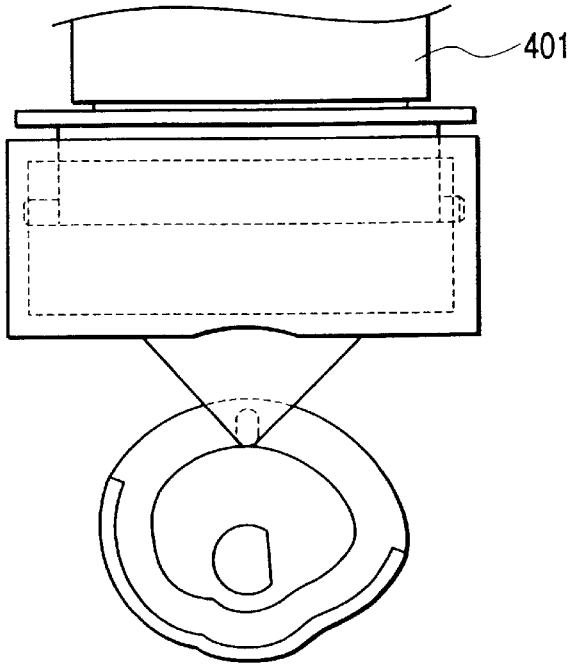
FIG. 37 is a schematic view showing a cap close state.

FIGS. 36 and 37 are diagrams showing the vertical operation of the cap 308 in which FIG. 36 is a diagram showing a cap open, that is, a state in which the cap 308 most drops whereas FIG. 37 is a diagram showing a cap close, that is, a state in which the cap 308 most climbs.

In this embodiment, there are provided a cap lever cam 350, and a cam follower 311*a* integrated with the cap lever 311 for the cap lever cam 350. As is apparent from FIGS. 36 and 37, since the cap lever cam 350 rotates and stops at a given position, the abutment and isolation of the cap 308 with respect to the nozzle surface 401*a* can be controlled. A cap spring hung between the cap holder 310 and the cap lever 311 is omitted from the figures. Also, because the cap lever cam 350 and the cam follower 311*a* of the cap lever 311 are so shaped as to be not only abutted against each other, but also engaged with each other, even if the cap 308 and the liquid jet head unit 401 adhere to each other due to the ink fixing, etc., the cap lever cam 350 and the cam follower 311*a* can be separated from each other.

Subsequently, the operation of the wiping means will be described with reference to FIGS. 38 and 39. The wiping means is equipped with a blade intermittent gear 351 which is engaged with a blade gear 305, a blade trigger gear 352 which is engaged with the blade intermittent gear 351, a blade cleaner 307 and a blade spring 353. The carriage 200 is provided with a blade rib.

Figure 38:
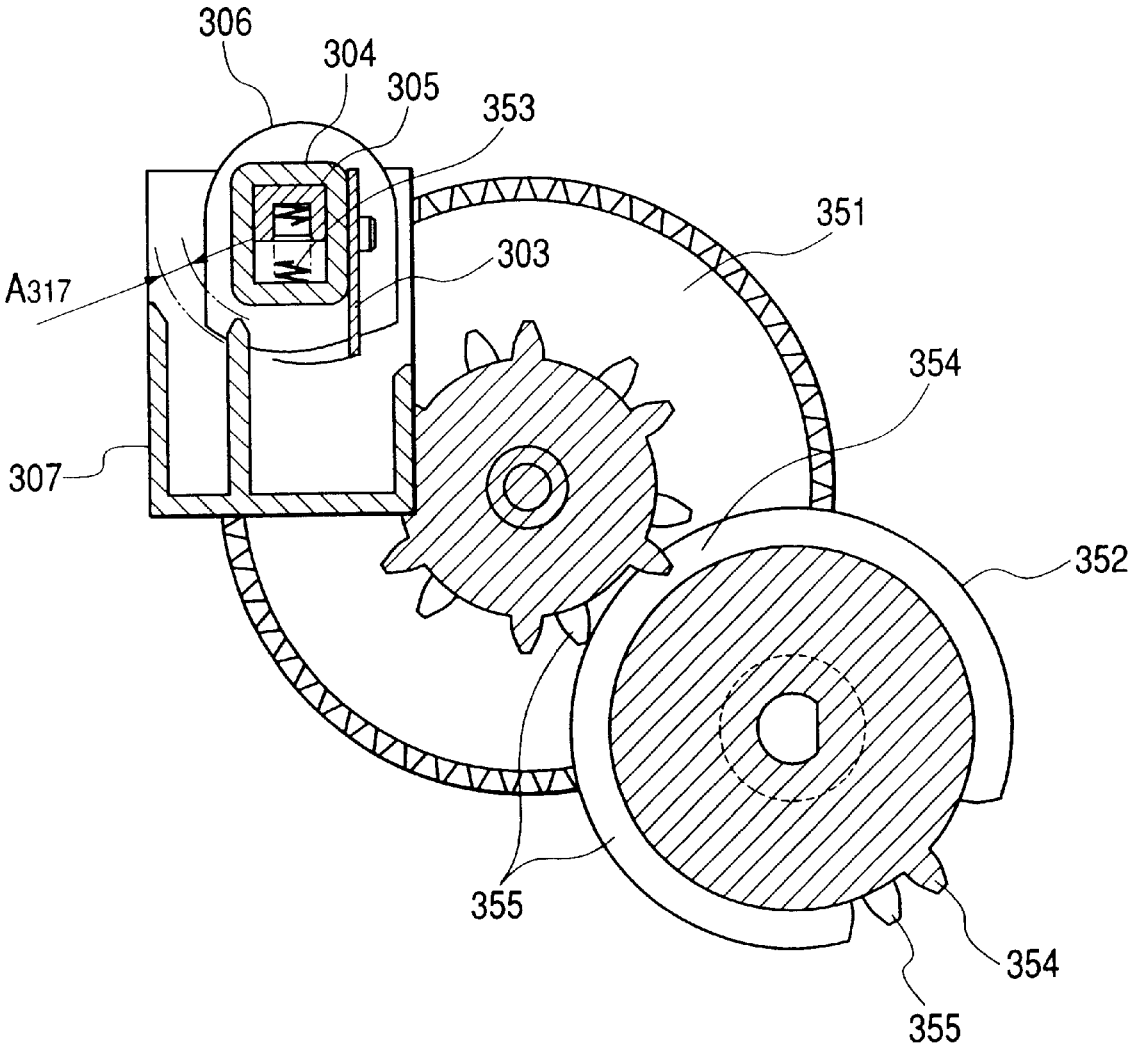
FIG. 38 is a schematic view showing a non-wiping state of wiping means.
Figure 39:
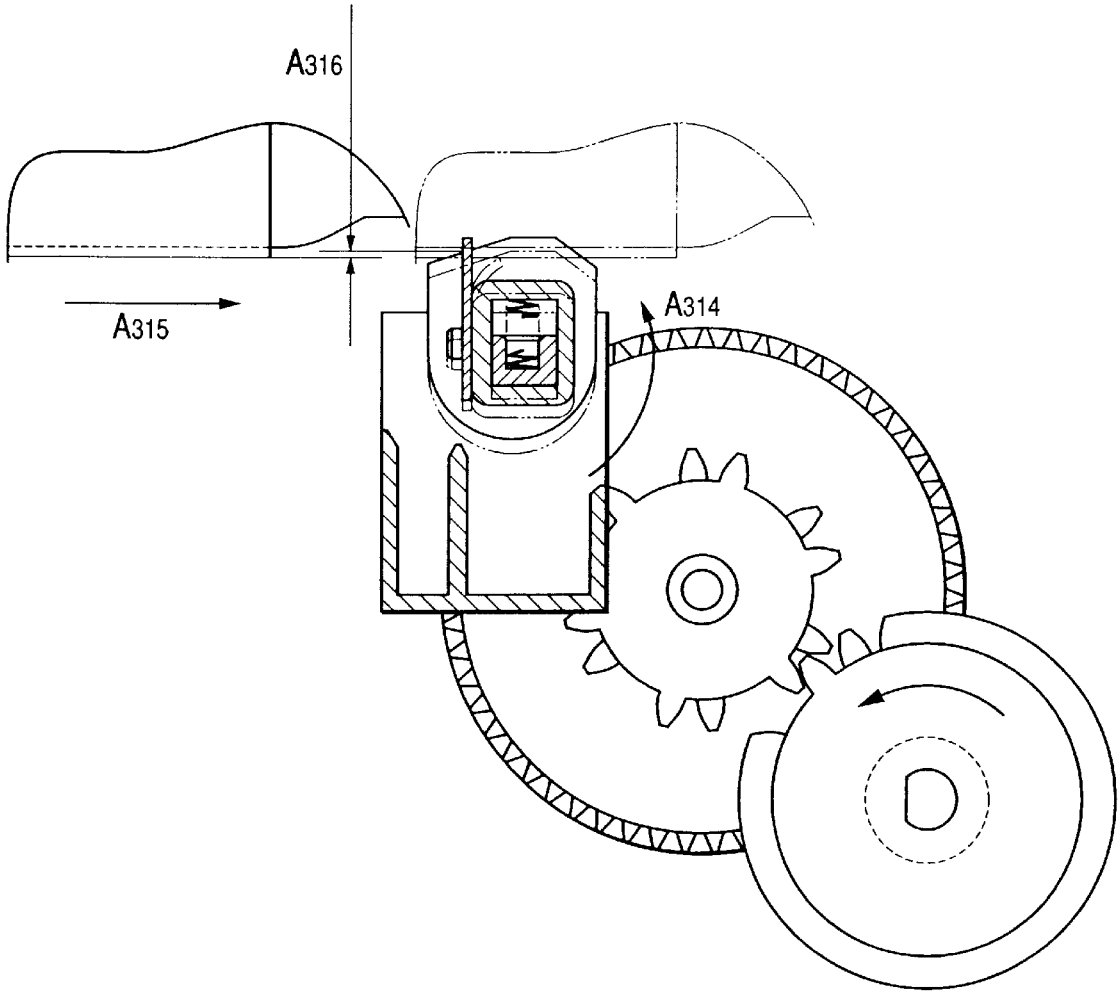
FIG. 39 is a schematic view showing a wiping state of wiping means.

In the wiping operation, when the carriage 200 comes to a position indicated by solid lines in FIG. 39 from a state shown in FIG. 38 which is a blade retreat state, the blade cam 306 is rotated up to a position shown in FIG. 39 in a direction indicated by an arrow $A_{314}$ so that a leading edge of the blade 303 is directed upward, resulting in a wiping standby state. Then, the carriage 200 is moved at a given speed in a direction indicated by an arrow $A_{315}$, and the wiping operation is executed. In this situation, the blade cam 306 is pushed down by a blade rib on the carriage 200, and the wiping means moves down to a position indicated by alternate long and two short dashes lines in FIG. 39. The blade holder 304 and the blade 303 which move down are urged upward by the blade spring 353, and the wiping operation is executed while the blade cam 306 is sliding in contact with the blade rib. With the above operation, the blade entry amount $A_{316}$ is ensured with a high precision, and the excellent wiping operation can be always stably executed. When the nozzle surface 401*a* of the liquid jet head unit 401 is made apart from the blade 303, the wiping operation is terminated. Subsequently, after the wiping means starts to rotate again and the blade 303 scraps the attached ink off by the blade cleaner 307, the wiping means stops in a state shown in FIG. 38. In this example, the interference amount $A_{317}$ of the blade cleaner 307 with the blade 303 is larger than the entry amount $A_{316}$, and the ink attached onto the blade 303 is removed.

The blade cleaner 307 is located at a position where the ink flied from the blade 303 during the blade cleaning operation is not flied to a member which dislikes the ink attachment such as the cap 308, for example, located below the blade 303 in this embodiment. Also, the blade cleaner 307 serves as a vessel that reserves the scrapped-off ink and can be readily replaced as occasion demands. Accordingly, in the case of conducting so-called wet wiping operation, etc., where the wiping operation is conducted while the dry ink attached onto the blade 303 is again resolved, or the discharge operation is conducted when an ink high in viscosity such as pigment is mainly used, the ink that drops from the blade 303 can be collected without going round to another portion within the apparatus.

Figure 40:
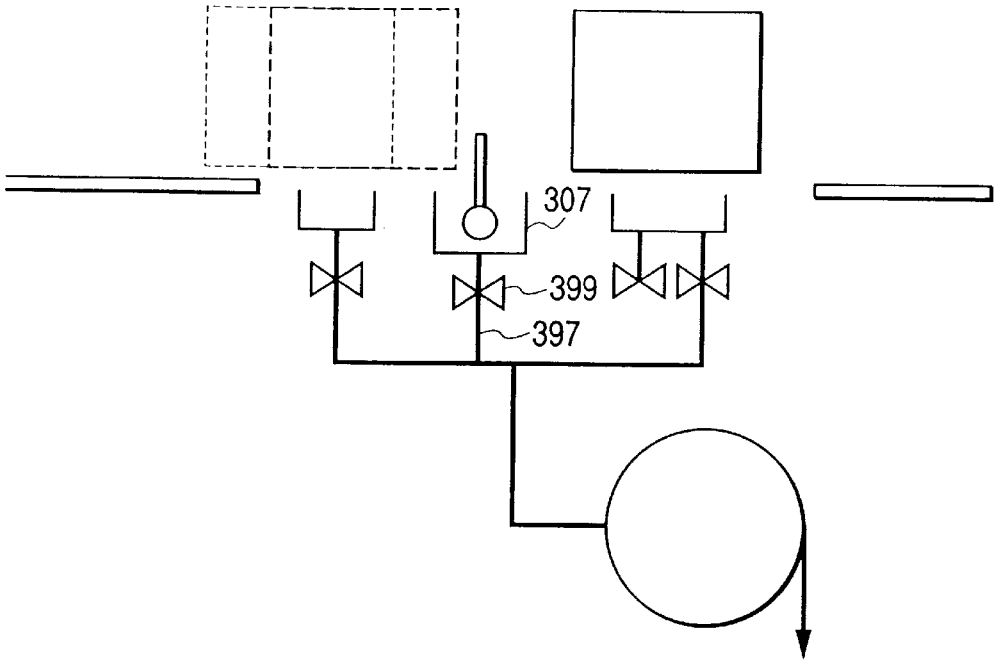
FIG. 40 is a schematic view showing a structure in which a waste ink is absorbed from a cleaner blade.
Figure 41:
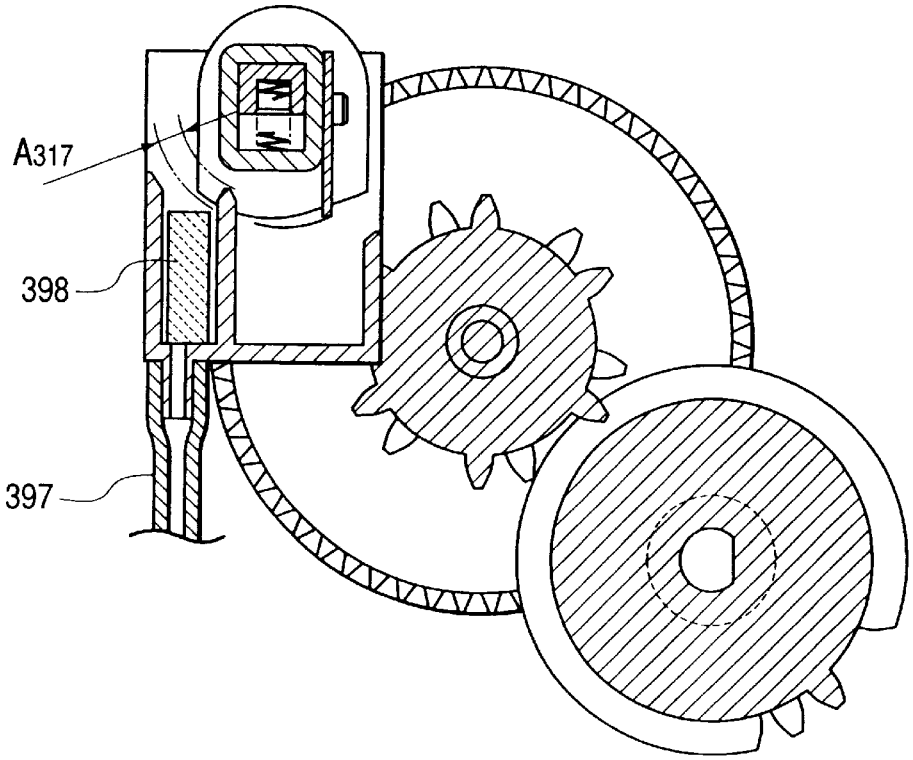
FIG. 41 is a schematic view showing a structure in which the waste ink is absorbed from the cleaner blade.

In addition, for example, in the case where it is difficult to replace the blade cleaner by a fresh one because the amount of ink reserved within the blade cleaner 307 is large, as shown in FIGS. 40 and 41, a cleaner tube 397 connected to the pump tube 325 is connected to the bottom surface of the vessel portion of the blade cleaner 307, the sucking operation is conducted as occasion demands, and the ink absorbed and retained in the cleaner absorber 398 disposed within the blade cleaner 307 is appropriately collected and discharged to the waste ink processing means. According to the above structure, there is no case in which the user is troubled about a treatment of the ink reserved within the blade cleaner 307 within the product lifetime. Although the description of the valve mechanism in this case will be omitted, the structure is identical with that shown in FIG. 32, and if the cleaner valve 399 is opened in a state where the suction valve 323 and the preliminary discharge valve 321 are closed, and the pump is actuated, the ink within the blade cleaner 307 can be collected.

Subsequently, the driving system of the wiping means will be described. In FIG. 38, the driving system is structured in such a manner that teeth 354 indicated by meshes among teeth of the blade intermittent gear 351 are meshed with only the teeth 354 indicated by meshes among teeth of the blade trigger gear 352, and teeth 355 indicated by no mesh among teeth of the blade intermittent gear 351 are meshed with only the teeth 355 indicated by no mesh among teeth of the blade trigger gear 352.

Accordingly, for the duration that a disc portion of the blade trigger gear 353 which almost occupied by the teeth indicated by no mesh is meshed with the blade intermittent gear 351, the blade intermittent gear 351 stops and cannot rotate, and the wiping means stops in a state where the blade 303 is directed downward, that is, in a non-actuating state. When the blade trigger gear 352 rotates, those gears are meshed with each other, and the wiping means rotates in a direction indicated by an arrow $A_{314}$ as shown in FIG. 39 and again returns to the state shown in FIG. 38.

In this embodiment, the blade trigger gear 352, the preliminary discharge valve cam 330, the suction valve cam 341 and the cap lever cam 350 are fixed to the same axis (hereinafter referred to as "cam shaft"). The blade intermittent gear 351 is meshed with the blade trigger gear 352 and rotates only when the rotation angle is 45° at a given phase while the blade trigger gear 352 is rotating by 360°. The blade gear has a speed increasing ratio eight times as large as that of the blade trigger gear 352. That is, the wiping means continuously rotates by 360° while the cam shaft rotates by 45° in a certain phase among the 360° rotation, and the wiping means stops in a state where the leading edge of the blade 303 is directed downward while the cam shaft rotates by the remaining 315°. Thus, because the wiping means always keeps in the stop state in the operation except for the wiring operation, and the wiping surface (a surface abutted against the nozzle formation) is directed in an opposite direction of the envelope conveying space and the preliminary discharge area, the attachment of the flied paper powder or ink mist, or other dusts, etc., can be suppressed to the minimum.

The driving mechanism of the recovery system unit 300 is structured in such a manner that the idling region is provided in the gear train by the phase angle 55° of the roller guide 327 as described above, and the roller guide 327 starts to rotate with a delay of the phase angle 55° when the rotating direction is reversed. The driving force is not transmitted to the cam shaft when the tube pump 324 is driven in a direction along which the negative pressure is generated because the driving force is transmitted to the cam shaft through the one-way clutch.

Figure 42:
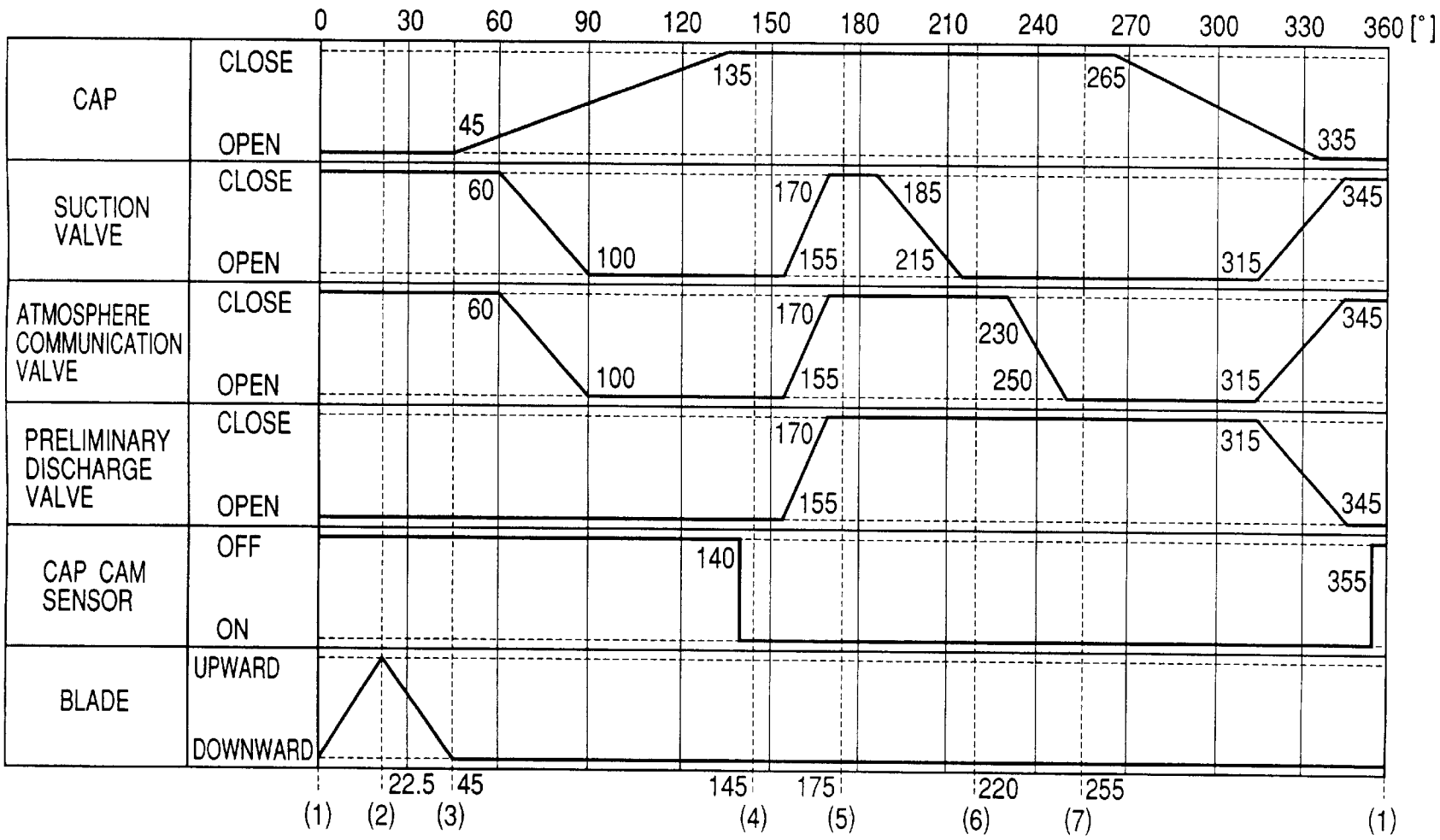
FIG. 42 is a timing chart showing the operation of the respective members which are interlocked with a cam.
Figure 43:
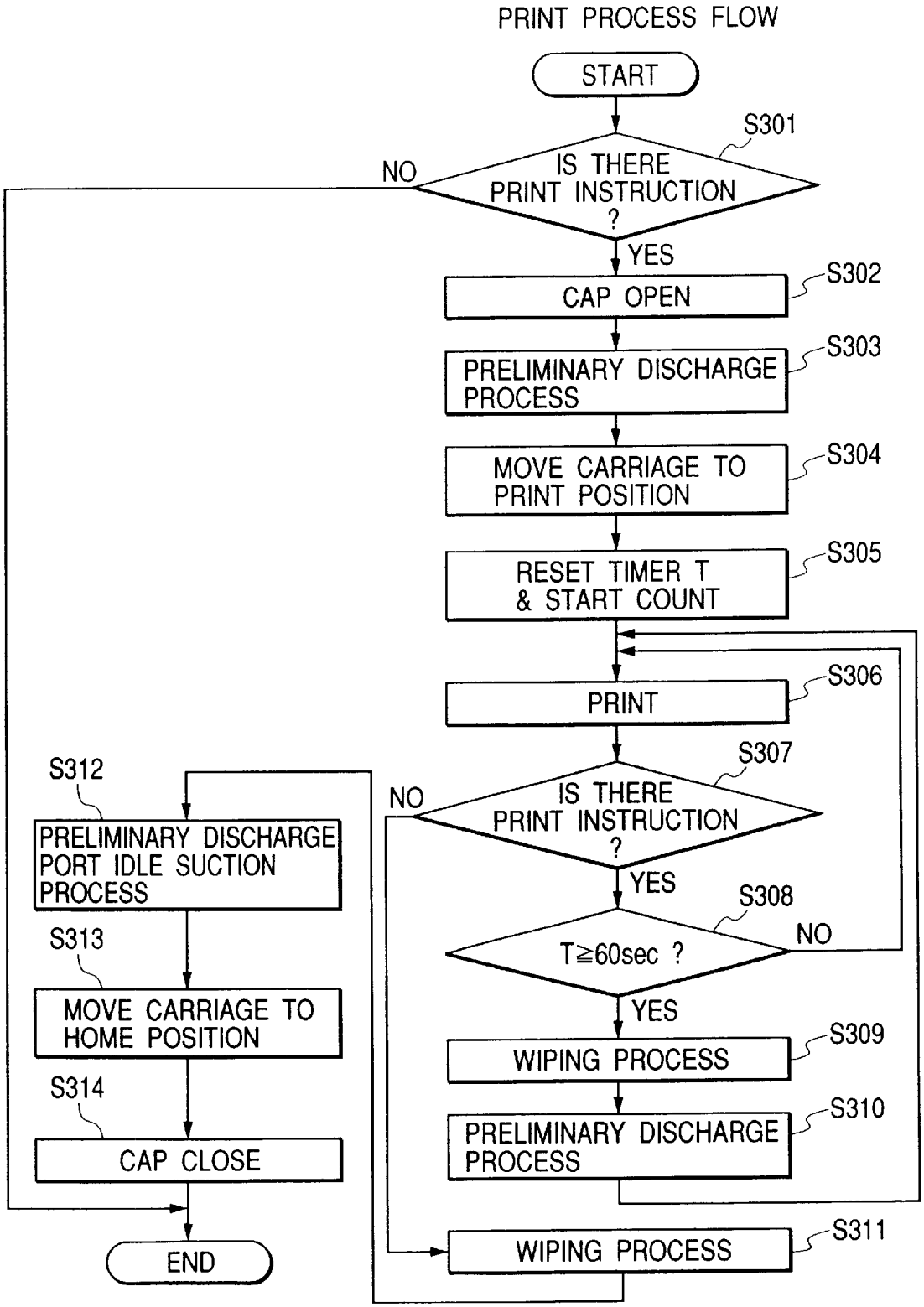
FIG. 43 is a flowchart showing a printing process.

Subsequently, the sequential processing operation of the recovery system unit 300 will be described with reference to FIG. 42 showing the cam shaft and FIGS. 43 to 47 showing flow charts. The circled numerals in the following description represent cam positions indicated in FIG. 42.

First, the operation of the recovery system unit 300 during the printing operation will be described. When a print instruction is issued in step S301, the motor starts to rotate counterclockwise in FIG. 28 in step S302, and rotates the cam shaft so as to open the cap 308 into a state (1).

Figure 44:
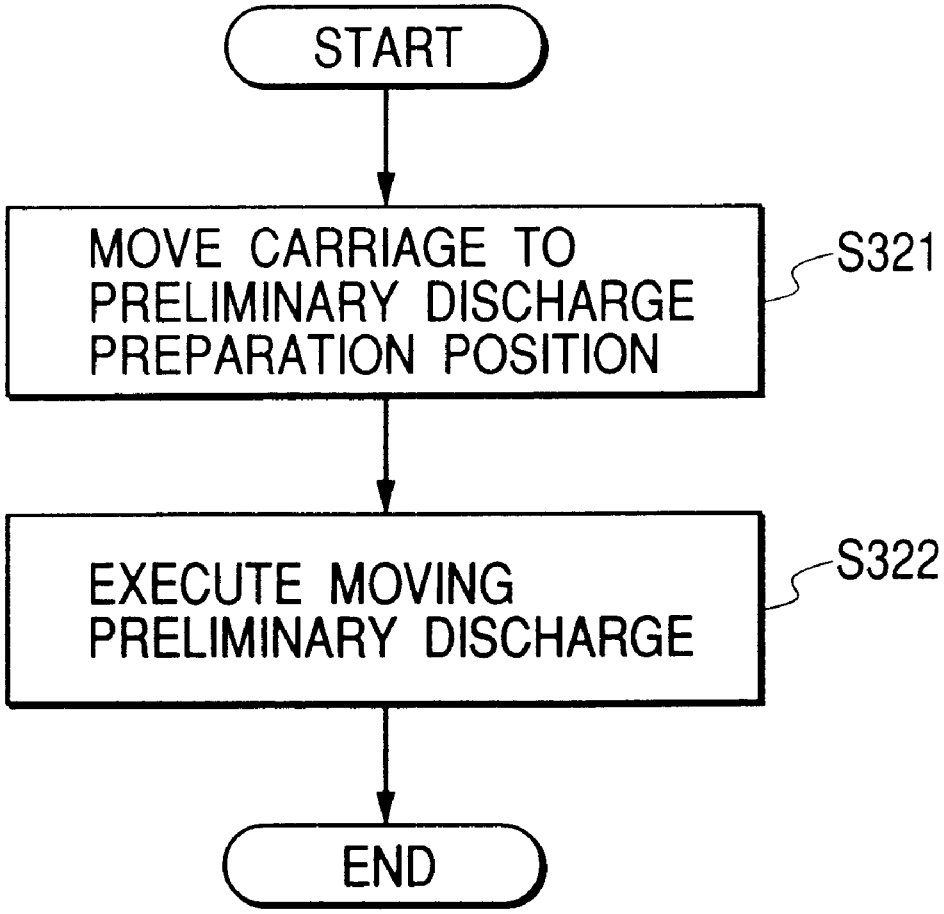
FIG. 44 is a flowchart showing an auxiliary discharging process.

Then, in order to conduct the preliminary discharge operation, the preliminary discharge process shown in FIG. 44 is executed. In the preliminary discharge process, the carriage 200 is moved up to a preliminary discharge standby position in step S321, and subsequently in Step 322, the flow preliminary discharge operation is sequentially executed from the nozzle block at a side close to the blade 303. When the preliminary discharge operation is completed in all of the nozzles, the discharge operation and the movement of the carriage 200 stop, and the preliminary discharge process is terminated. The ink may not always be discharged in the flow preliminary discharge operation while the carriage 200 is being scanned as described above, but the ink may be discharged in a state where the carriage 200 stops while the carriage 200 intermittently stops to be scanned.

Figure 45:
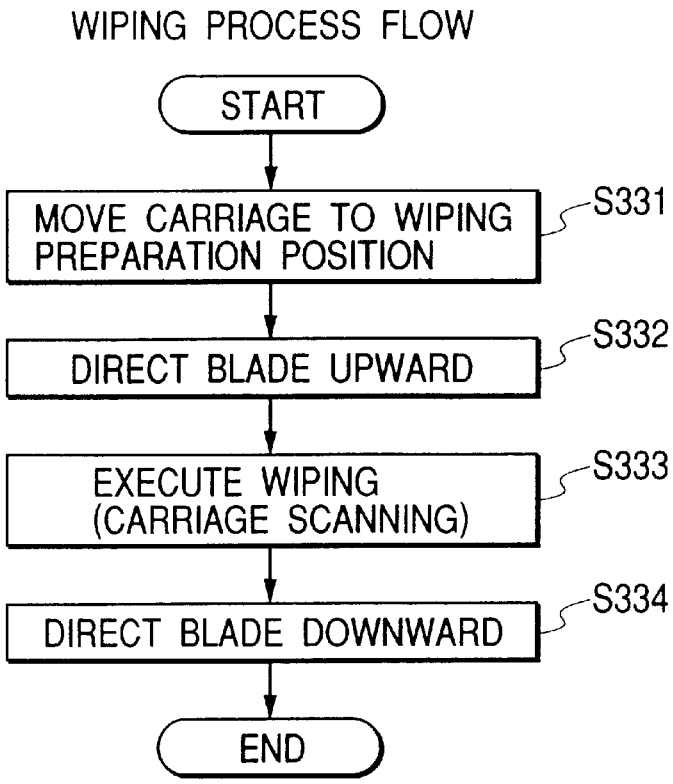
FIG. 45 is a flowchart showing a wiping process.

Then, the carriage 200 is moved to any print position of the envelope or the continuous sheet (tape) in step S304, and the count starts after a timer T is reset in step S305. In step S306, corresponding to the print information, the ink is discharged toward the conveyed printing medium to conduct the printing operation. If no print instruction is issued in step S307, the operation is advanced to step S311. On the contrary, if a print instruction is issued in step S307, the timer T is referred to in step S308. In this situation, if the timer T is equal to or shorter than 60 sec, the operation is returned to the step S306 to again conduct the printing operation. However, if the timer T is longer than 60 sec, the wiping process shown in FIG. 45 is executed in order to wipe off the ink attached onto the nozzle surface 401*a* in step S309.

During the wiping process, the carriage 200 is moved up to the wiping standby position in step S331. Subsequently, the motor is rotated counterclockwise in step S332 and moved from the state (1) to a state (2), that is, from a state where the leading edge of the blade 303 is directed downward (refer to FIG. 38) to a state where the leading edge of the blade 303 is directed upward which is a state where the wiping operation is enabled (refer to FIG. 39). Then, the wiping operation is executed by scanning the carriage 200 in step S333. The carriage scanning speed at this time is not always kept constant, but may be changed, for example, in accordance with the kind of ink. After the entire area of the nozzle surface 401*a* of the liquid jet head unit 401 has been wiped off by the blade 303, the carriage 200 stops and the motor is rotated counterclockwise to bring the wiping means in a state (3), that is, the blade 303 is directed downward and enclosed in step S334, thus completing the wiping operation.

Figure 46:
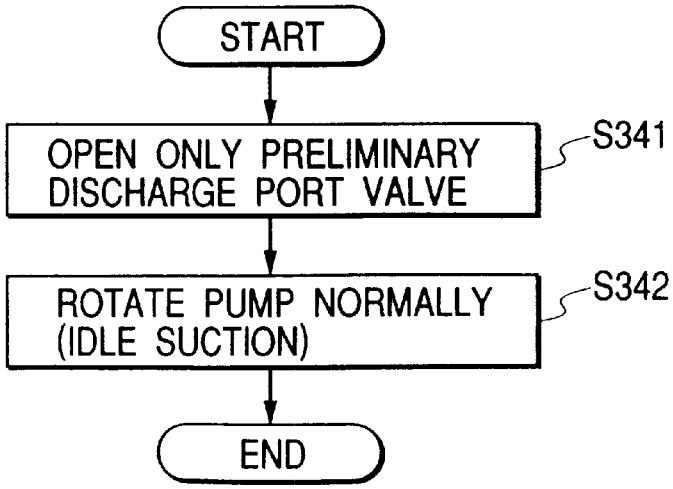
FIG. 46 is a flowchart showing an auxiliary discharge port dummy sucking process.
Figure 47:
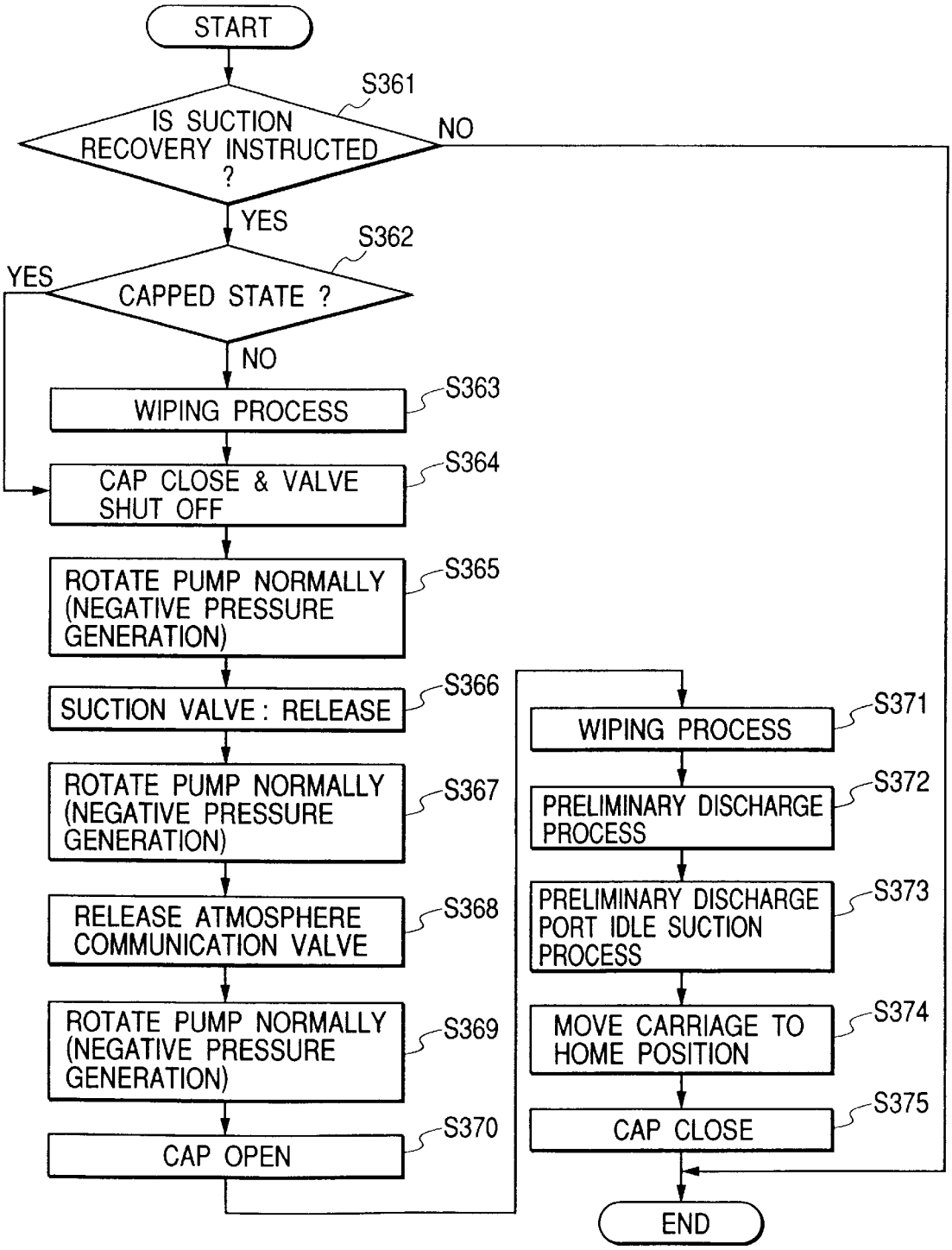
FIG. 47 is a flowchart showing a suction recovery process.

Then, in order to discharge a dry ink, a different kind of ink, etc., which may be pushed into the nozzles through the wiping process, the preliminary discharge process is executed in step S310. When the print instruction is interrupted, after the wiping process is executed as the completing operation of printing to remove the ink from the nozzle surface 401*a* in step S311, a preliminary discharge idle sucking operation shown in FIG. 46 is executed in order to discharge the ink reserved within the preliminary discharge port to the waste ink processing means not shown in step S312.

In step S341, the motor is rotated counterclockwise and brought into the state (3). Then, in step S342, the motor is rotated clockwise by a given rotation angle to drive the pump, and the ink within the preliminary discharge port is discharged to the waste ink absorber through the pump tube 325 to complete the preliminary discharge port idle sucking process. The given rotation angle means an angle at which the amount of ink which remains within the preliminary discharge port or the tube can be surely reduced down to an amount which does not give a trouble to the liquid jet head unit 401 or the recovery system unit 300.

Then, the carriage 200 is moved to the home position S, that is, the capping position in step S313, and the motor is rotated counterclockwise into a state (4), that is, a capping state in step S314, thus completing the printing operation. The rotation angle in this situation is 100°, and therefore the rotation angle is larger than a total angle of the delay angle 55° of the pumping operation and the rotation angle 40° required to change from a state where the roller 326 crushes the pump tube 325 to a state where the roller 326 releases the pump tube 325, and the pump at the standby time (capping time) is in a state shown in FIG. 31.

Subsequently, a description will be given of a suction recovery process executed automatically or manually in the case where because the liquid jet head unit 401 is not used for a long period of time, the ink within the nozzles is fixed or bubbles are mixed in the ink so that the discharge operation is not conducted, etc.

First, when a suction recovery instruction is received in step S361, the state of the printing apparatus is detected in step S362. In this situation, if the capping operation is conducted in a state where the printing apparatus is in a standby state, that is, in a state (4), the operation is advanced to step S364. If not so, the operation is advanced to Step 363 to execute the wiping process, and thereafter the capping operation is executed so that the printing apparatus is in the state (4) in step S364, and also the motor is rotated counterclockwise so that the printing apparatus is in a state (5) where all of the valves are closed. Then, in step S365, the motor is rotated counterclockwise to drive the pump, and the pressures within the tubes extending from three kinds of valves (five in total) to the pumps (two in total) are reduced down to a given value. Then, in step S366, the motor is rotated counterclockwise so that the printing apparatus is in a state (6), and only the suction valve is opened to exert the negative pressure on the interior of the cap. In this situation, the pump driving system is going to rotate the pump by 45° in a direction of $A_{310}$ until the state changes from the state (5) to the state (6). However, as described above, since the rotation angle of 55° or less is in the idle region where the roller guide does not rotate, the pump is not driven and therefore a state in which the pump tube 325 is crushed and closed by the roller 326 is kept.

If a given amount of ink necessary to remove the dry ink, the bubbles or the like within the nozzles can be sucked, the sucking operation may be terminated. However, in this embodiment, additional sucking operation is conducted assuming that the amount of suction is short. In step S367, the motor is again rotated clockwise to actuate the pump so that the negative pressure is generated, thus conducting the sucking operation. After the amount of suction reaches a given value, in order that the motor is rotated counterclockwise in step S368 to open the atmosphere communication value, the state is changed to a state (7), and the cap 308 is opened to the atmosphere to stop the suction.

Subsequently, the motor is rotated clockwise to actuate the pump in step S369 so that the ink within the cap 308, the atmosphere communication tube 339, the cap tube 338 and the pump tube 325 is discharged to the waste ink processing means. Then, the motor is rotated counterclockwise to open the cap, that is, to change the state to the state (1) in step S370, the wiping process is executed in step S371, the preliminary discharge process is executed in step S372 and the preliminary discharge idle sucking process is executed in step S373. Finally, after the carriage 200 is moved to the home position S in step S374, the motor is rotated counterclockwise to conduct the capping operation in step S375, thus completing the suction recovery process.

The cap cam sensor shown in FIG. 42 is a sensor which is made up of a photo interrupter having a cap cam not shown fitted to a cam shaft as a flag and can detect a phase of the cam or the like fitted to the cam shaft according to the detected result. In this example, the detection timing of the cap cam sensor is set immediately before the cap is opened and closed for the following reasons. That is, there is the possibility that when the cap is opened, a force of rotating the cap lever cam 350 counterclockwise in FIG. 36 is exerted on the cam follower 311*a* integrated with the cap lever 311 due to the cap spring having a spring force of about 800 gf in total in this embodiment, with the result that the cap lever cam 350 overruns in a direction along which the one-way clutch idles to produce a phase shift. On the contrary, when the cap is closed, there is a risk that the largest load is exerted on the cam shaft, and the motor for driving the recovery system unit which is made up of a stepping motor is stepped out. The above detection timing is set in order to correct the phase shift produced for the above reasons to always control the cam in a correct phase.

[Liquid Jet Head Unit]

Figure 48:
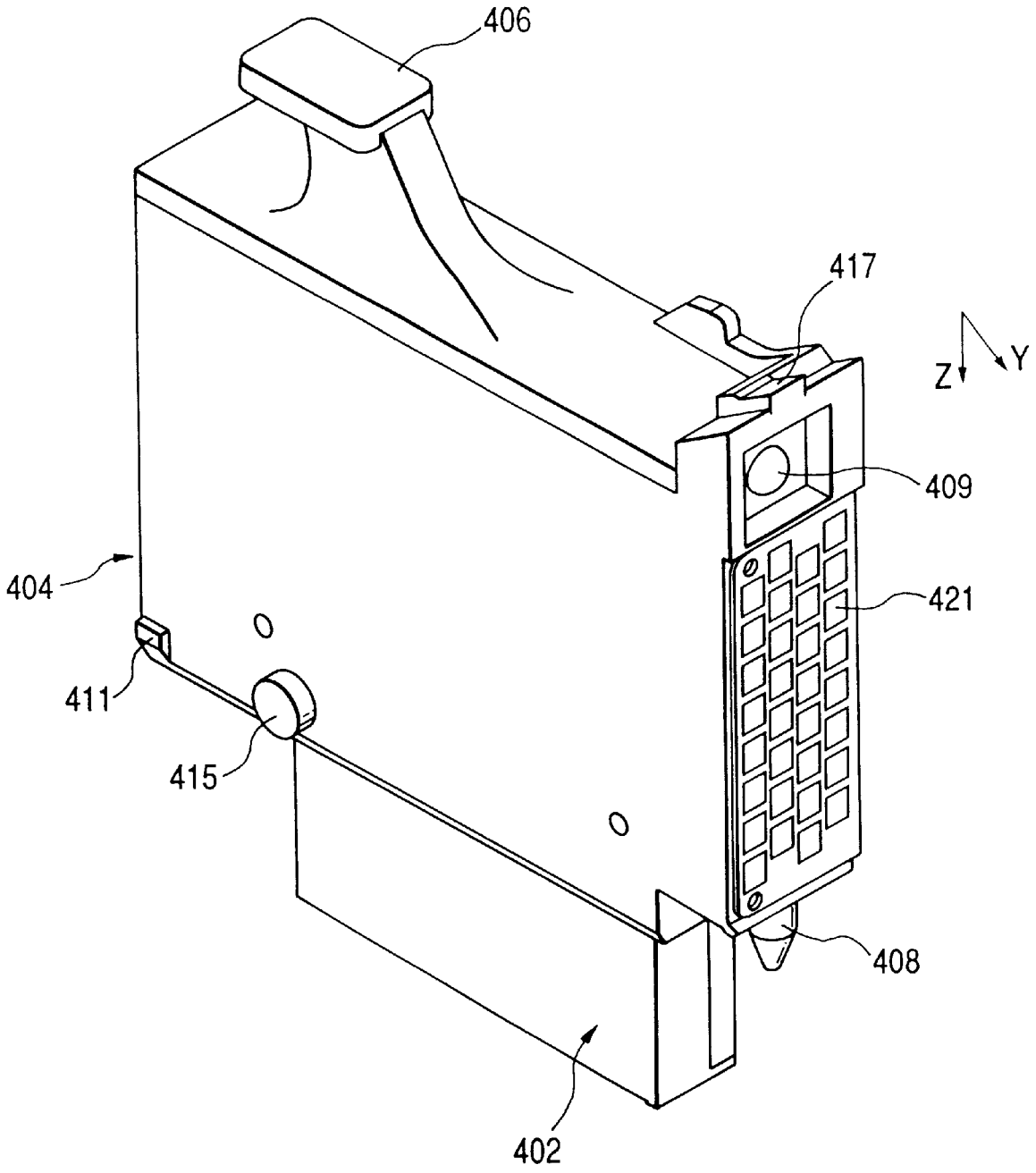
FIG. 48 is a perspective view showing a liquid jet head unit.
Figure 49:
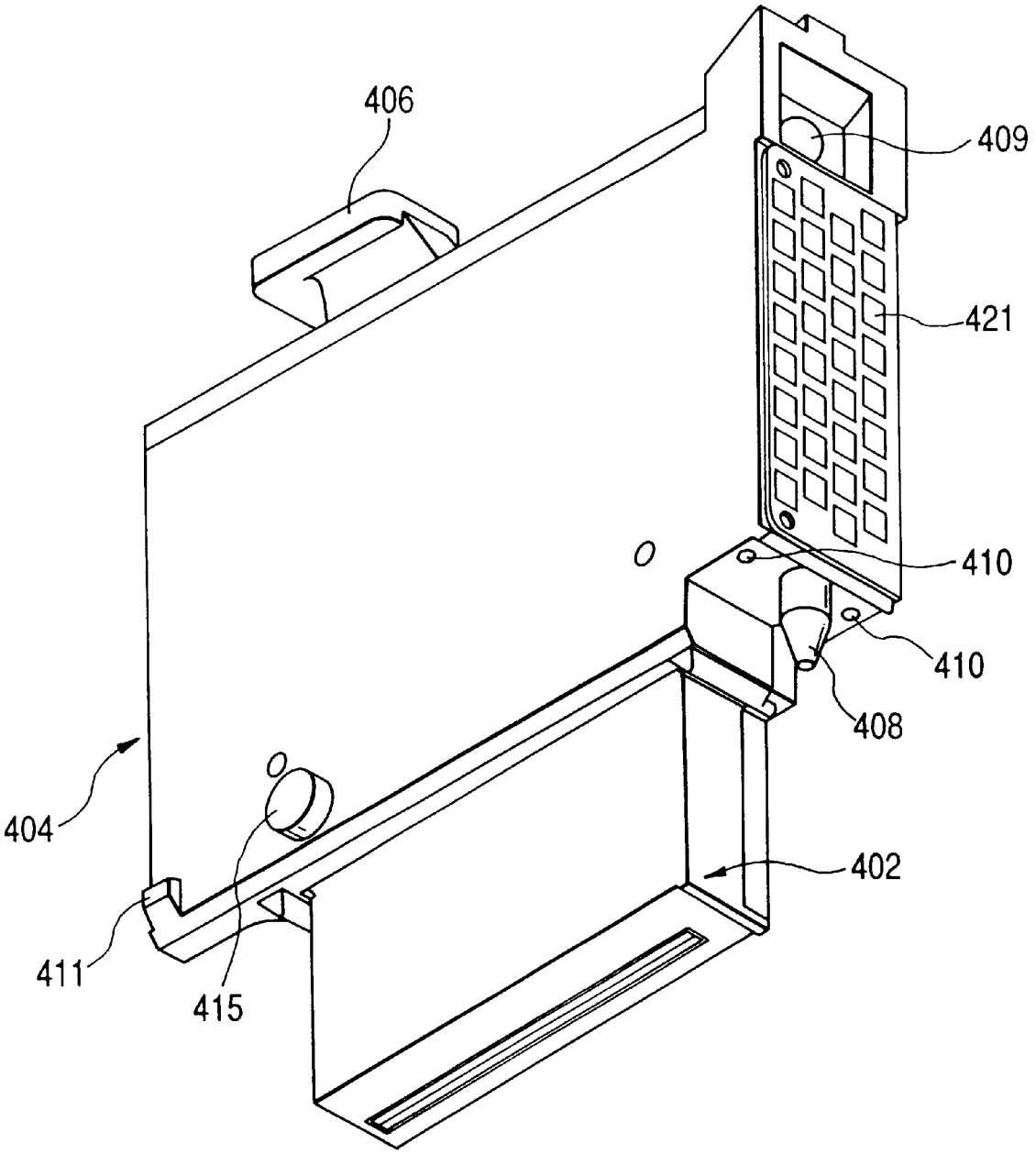
FIG. 49 is a perspective view showing the liquid jet head unit.
Figure 50:
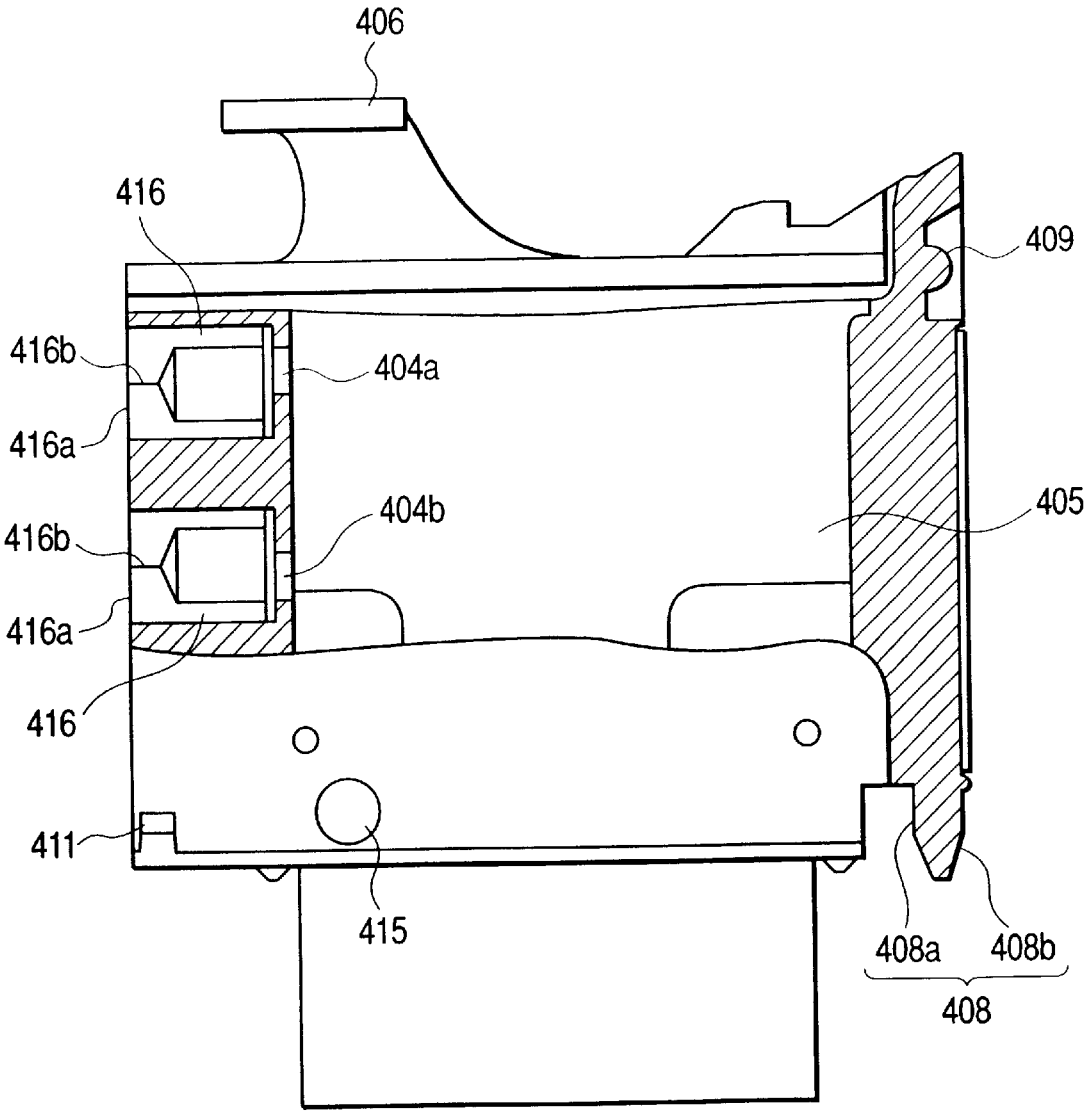
FIG. 50 is a cross-sectional view showing the liquid jet head unit.

FIGS. 20, 48 to 50 are diagrams showing the structure of the liquid jet head unit 401, and FIGS. 20, 48 and 49 are perspective views of the appearance of the liquid jet head unit 401, and FIG. 50 is a partially cross-sectional view of the liquid jet head unit 401.

The liquid jet head unit 401 according to this embodiment is made up of a liquid droplet discharge member (this is a so-called liquid jet head, and hereinafter referred to as "head chip") 402 which discharges a droplet from the nozzle train where the discharge ports (nozzles) which discharge the droplet are aligned in accordance with a print signal, a sheet wiring member 403 such as a flexible cable or TAB where an electric wiring that receives or transmits the print signal transmitted between the liquid jet head unit 401 and the printing machine main body are disposed, a unit frame 404 which has an ink reservoir chamber for reserving a liquid. such as the ink which is supplied to the head chip 402 and retains the head chip 402, etc.

The head chip 402 is fixed to the unit frame 404, for example, by welding a positioning boss 404*a,* a vis 451, or the like so that the head chip 402 and the unit frame 404 can be readily dissembled.

A second common liquid chamber 405 that can receive a desired amount of ink is disposed in the interior of the unit frame 404, and the ink reserved in a second common liquid chamber 405 is supplied to the head chip 402 and then supplied to the nozzle portion through an ink passage of a chip tank 603 which will be described later, and a first common liquid chamber 605*a* of a roof 605.

The grip 406 disposed above the liquid jet head unit 401 is a clue to the attachment or detachment of the liquid jet head unit 401 with respect to the carriage 200.

Positioning portion groups 408 to 411 are so designed as to mount the liquid jet head unit 401 at a given position within the carriage 200, and includes a columnar guide pin 408 disposed on a bottom surface of the liquid jet head unit 401 and a spherical projection 409 disposed on the depth surface of the liquid jet head unit 401. The center of the spherical projection 409 is provided on the extension of a center line of a columnar portion of the guide pin 408. When an inner columnar wall 408*a* of the guide pin 408 and the spherical projection 409 are abutted against given positions of the carriage 200, respectively, the liquid jet head unit 401 is vertically positioned with respect to the printing medium. A tapered surface 408*b* of the tip portion of the guide pin 408 is a guide for inserting the guide pin 408 into a given position.

Also, when spherical projections 410 disposed on the bottom surface of the liquid jet head unit 401 are abutted against given positions of the carriage 200, the liquid jet head unit 401 is positioned in the heightwise direction.

Also, the carriage 200 is positioned in a direction of the side surface and the liquid jet head unit 401 (and the discharge port train) is positioned in an inclination direction, by a trapezoidal projection 411 disposed on the side surface of the liquid jet head unit 401. That is, the amount of inclination with a straight line that connects the center of the guide pin 408 and the center of the spherical projection 409 as a fulcrum is changed with a variation in the height of the trapezoidal projection 411.

The columnar protrusion 415 disposed on the side surface of the liquid jet head unit 401 is an insertion guide for forcibly inclining the liquid jet head unit 401 when the liquid jet head unit 401 is inserted into the carriage 200 and so adapted as to guide the tip portion of the guide pin 408 to a given position by inclining the liquid jet head unit 401.

When the tip portion of the CR needle 222 penetrates a front surface of the joint rubber 416 into the second common liquid chamber 405, the ink is supplied to the second liquid chamber 405 from the main tank 501 connected to the CR needle 222 by connecting means such as a tube.

The joint rubber 416 has a closed hole 416*b* formed by allowing a needle-shaped member to penetrate from the surface side 416*a* to an opposed surface side, and the joint rubber 416 is inserted into a hole portion formed with an inner diameter smaller than the outer diameter of the joint rubber 416 under pressure. Because the closed hole 416*b* receives a compressive load from the outer peripheral portion of the joint rubber 416 by the above pressure insertion, the interior of the second common liquid chamber 405 can be kept in a sealing state when the CR needle 222 is not inserted. Then, when the CR needle 222 is inserted, since a gripping force (a compressive force from the outer peripheral portion) is exerted on the CR needle 222, the joint portion can be completely sealed except for the hollow portion of the CR needle 222.

Two upper and lower joint rubbers 416 are disposed, and the lower joint rubber 416 is a supply path for supplying the ink from the main tank 501, and the ink is supplied to the second common liquid chamber 405 through the lower CR needle 222 and the hole 404*b*. On the other hand, the upper joint rubber 416 is a suction path for controlling a negative force within the liquid chamber by discharging the air reserved in the second common liquid chamber 405 to the external of the liquid chamber, and the ink is discharged to the external of the second common liquid chamber 405 through the hole 404*c* and the upper CR needle 222 by driving means for suction such as a pump.

Also, if the negative force within the second common liquid chamber 405 is increased due to the suction path, the ink supply within the second common liquid chamber 405 can be controlled.

An inclined receiving surface 417 is a portion that receives a load exerted on the liquid jet head unit 401 from the carriage 200, and when the inclined receiving surface 417 receives the load, partial forces are produced in a direction indicated by an arrow Z and in a direction indicated by an arrow Y by the inclined configuration, and the liquid jet head unit 401 is pressed toward two directions.

A contact pad 421 is so adapted as to receive and send a print signal transmitted between the head chip 402 and the printing machine main body.

[Chip Structure]

Figure 63:
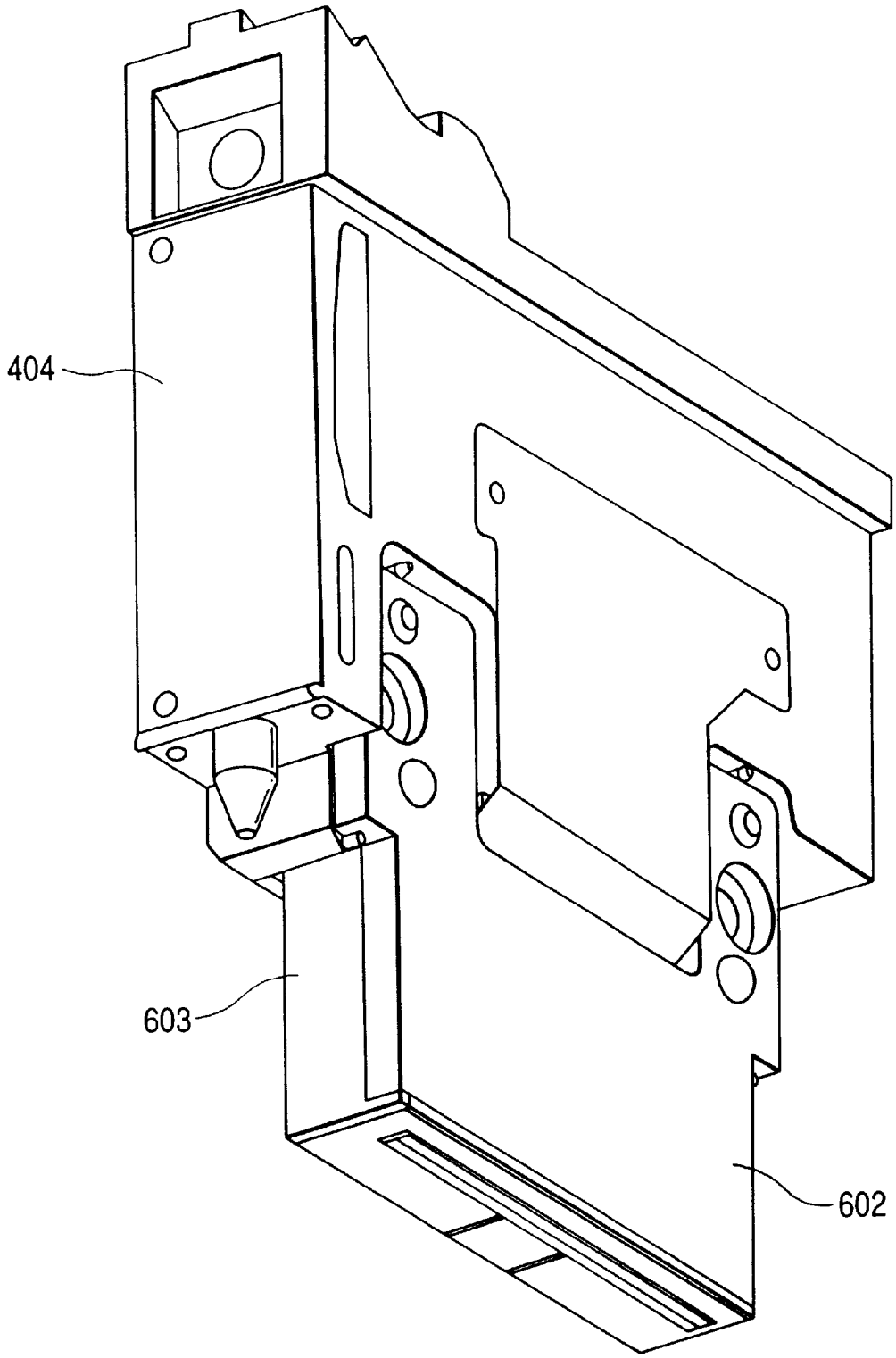
FIG. 63 is a perspective view showing the liquid jet head unit in accordance with the embodiment of the present invention.
Figure 64:
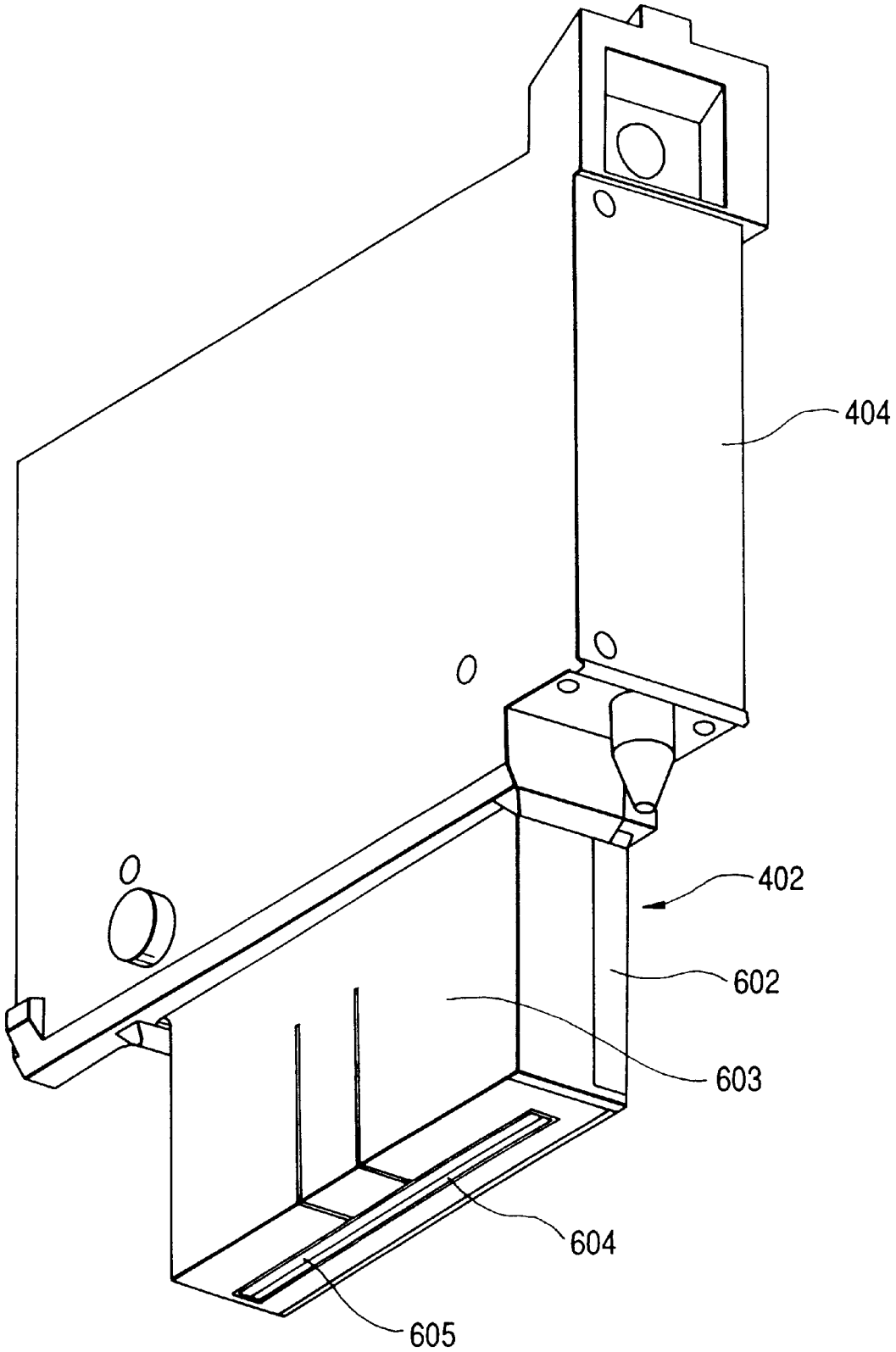
FIG. 64 is a perspective view showing the liquid jet head unit shown in FIG. 63, viewed from another direction.
Figure 65:
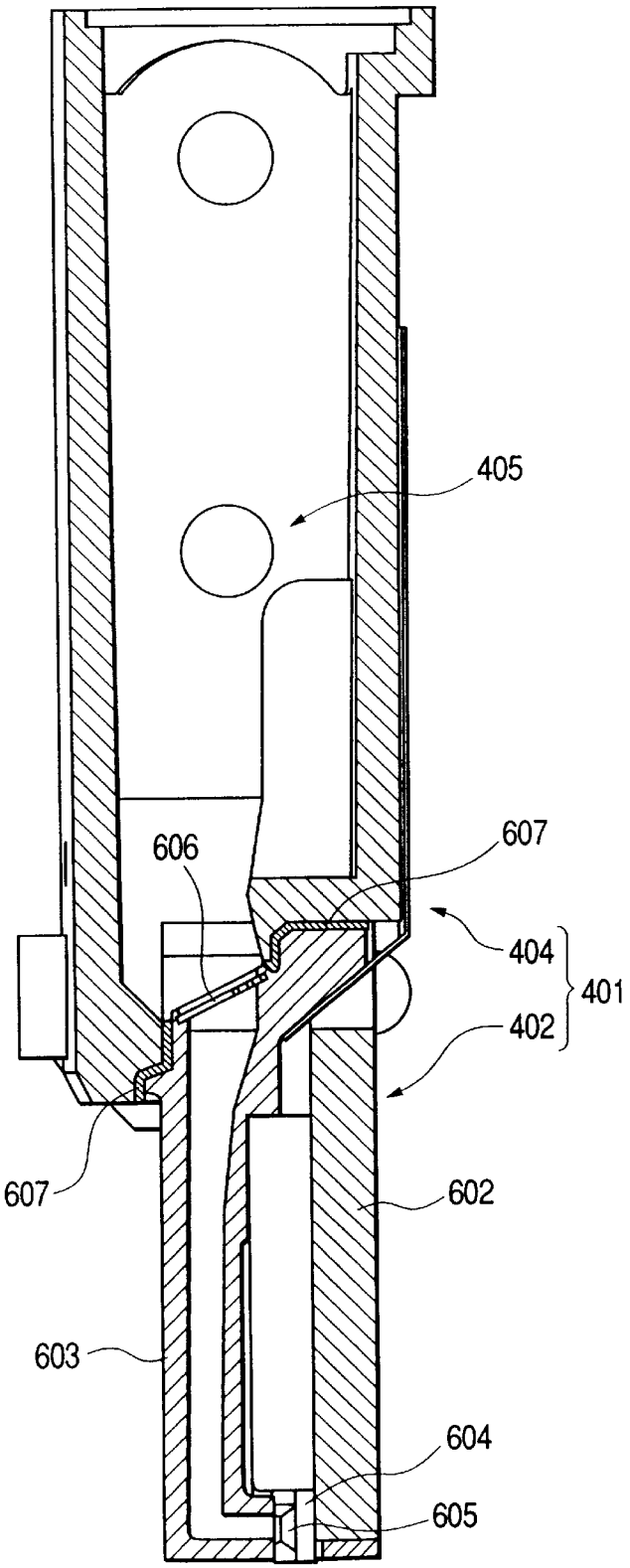
FIG. 65 is a longitudinally cross-sectional view showing the liquid jet head unit shown in FIG. 63.
Figure 66:
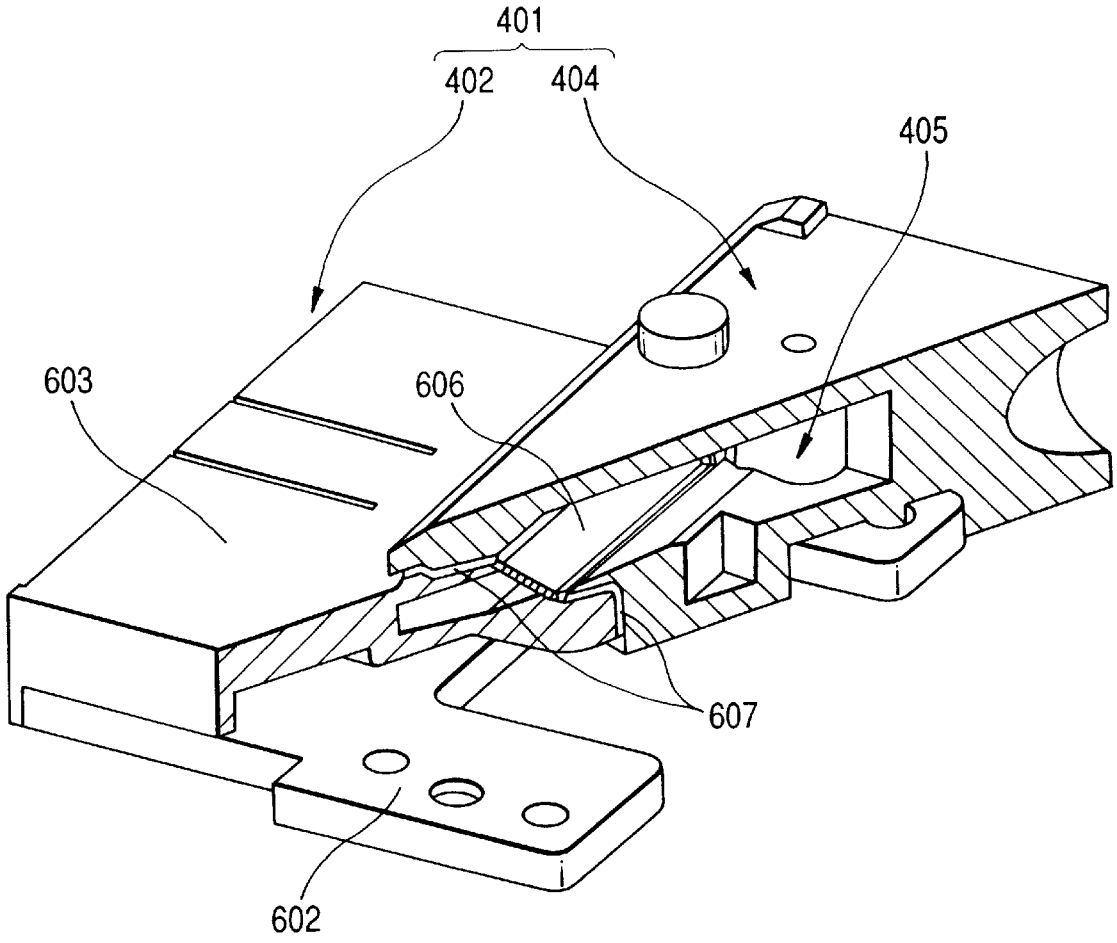
FIG. 66 is a perspective view showing the liquid jet head unit shown in FIG. 63, in a state where parts of a chip tank and a second common liquid chamber are broken.

Subsequently, the structure of the above-described liquid jet head unit 401 will be described in more detail. FIG. 63 is a perspective view showing the liquid jet head unit 401 in accordance with this embodiment, FIG. 64 is a perspective view of the liquid jet head unit 401 viewed from another direction, and FIG. 65 is a longitudinal cross-sectional view of the liquid jet head unit 401. Also, FIG. 66 is a perspective view showing the liquid jet head unit 401 shown in FIG. 63 in a state where parts of the chip tank 603 and the second common liquid chamber 405 are broken, and FIG. 67 is an enlarged cross-sectional view showing a connecting portion of the chip tank 603 and the second common liquid chamber 405.

The head chip 402 of the liquid jet head unit 401 according to this embodiment is structured in such a manner that an element board 604 on which a discharge energy generating element tray (not shown) which gives a discharge energy to the print liquid (ink or the like) is disposed for the flow paths, a roof 605 that is opposed to the discharge energy generating element tray and forms a flow path and a chip tank 603 which is a supply member that supplies the print liquid to the flow path are fitted onto a reference member 602 in a state where the respective members are relatively positioned. In addition, the unit frame 404 of the liquid jet head unit 401 includes a connecting portion for sending the supply liquid to the chip tank 603, a connecting portion for escaping an air within the liquid chamber and a second common liquid chamber 405 for reserving the print liquid temporarily or until the print liquid is completely consumed. Also, the chip tank 603 of the head chip 402 is fitted with a porous member 606 having fine holes which is positioned at a boundary portion of the chip tank 603 and the second common liquid chamber 405, and traps impurities within the print liquid. A connecting portion of the second common liquid chamber 405 and the chip tank 603 is filled with a filler 607 made of silicon rubber or the like.

Now, the structures of the above respective members will be described in more detail.

Figure 67:
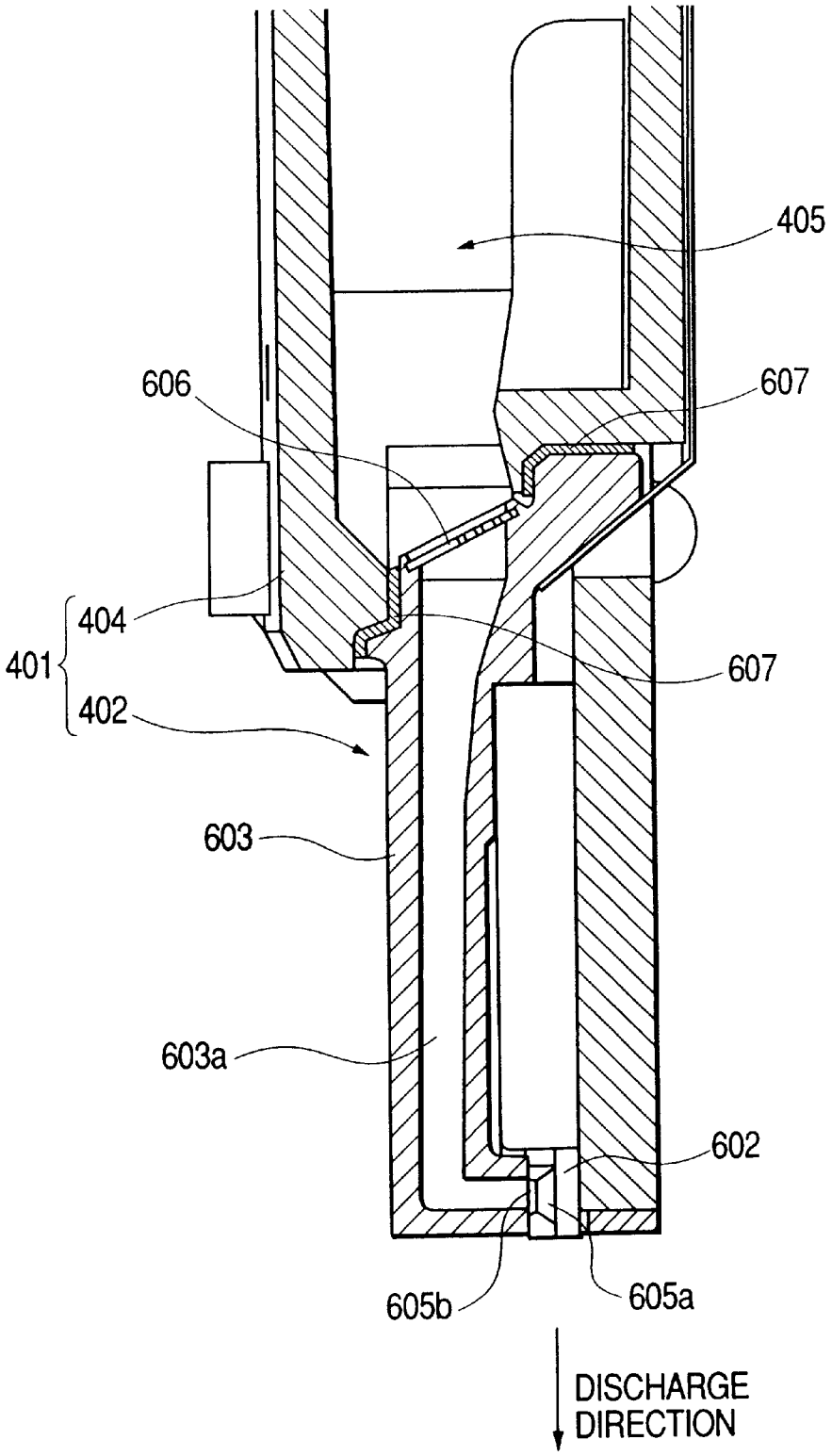
FIG. 67 is an enlarged cross-sectional view showing a connecting portion of the chip tank and the second common liquid chamber in the liquid jet head unit shown in FIG. 63.

The second common liquid chamber 405 serves as a buffer that reserves the print liquid, and when the print liquid is consumed by the discharging operation, the print liquid is appropriately supplied from the second common liquid chamber 405 to the first common liquid chamber 605*a* made up of the roof 605 and the element board 604 (refer to FIG. 67). Also, the second common liquid chamber 405 includes a connecting portion for receiving the print liquid from another print liquid reserving tank provided separately and a connecting portion for escaping the air within the liquid chamber to the external.

The chip tank 603 functions as a flow path that appropriately supplies the print liquid to the first common liquid chamber 605*a* (refer to FIG. 67) from the second common liquid chamber 405.

The porous member 606 exists between the second common liquid chamber 405 and the chip tank 603 and traps the impurities or the like within the print liquid. In this embodiment, the porous member 606 is joined to the chip tank 603 by welding. For that reason, a gas is prevented from entering the flow path from the connecting portion of the chip tank 603 and the porous member 606.

As shown in FIG. 67, the chip tank 603 and the roof 605 are joined to each other in a state where the print liquid supply path 603*a* of the chip tank 603 communicates with the print liquid supply port 605*b* of the roof 605. The joint of the chip tank 603 and the roof 605 is conducted by fitting both of the joint surfaces to each other under pressure, and the periphery of the joint surface is complementarily sealed with a filler (not shown).

Also, as described above, a portion between the chip tank 603 and the second common liquid chamber 405 is filled with a filler 607 on the entire periphery thereof and the water-tightness of the interior of the second common liquid chamber 405 to the chip tank 603 is ensured. However, because the filler 607 is made of silicon rubber having a gas permeability or the like, the outside air can transmit the filler 607 so as to enter the second common liquid chamber 405. The gas that has entered the second common liquid chamber 405 ascends within the second common liquid chamber 405 due to a buoyancy and stays in a gas layer on the upper portion of the liquid chamber. Then, the gas is finally discharged to the external through the connecting portion (not shown) which escapes the gas within the second common liquid chamber 405 to the external.

In this embodiment, the connecting portion of the chip tank 603 and the second common liquid chamber 405 is disposed upstream side of the porous member 606 with respect to the flow direction of the print liquid. For that reason, the gas that has transmitted the filler 607 does not enter the chip tank 603 downstream side of the porous member 606. Also, in the second common liquid chamber 405, even if a part of print liquid is solidified by drying or the like to produce a solid matter, the solid matter can be trapped by the porous member 606.

With the above structure, since the gas that enters the flow path downstream side of the porous member 606, that is, from the print liquid supply path 603*a* to the nozzles of the head chip 402 can be reduced, an adverse influence of the existence of the gas in the flow path downstream side of the porous member 606 on the liquid jet performance can be reduced. Also, since the gas that exists in the flow path downstream side of the porous member 606 is reduced, the recovery operation conducted when the liquid jet head which has been left for a long period of time starts to be used can be simplified. For that reason, the amount of print liquid sucked and dumped in the recovery operation is reduced, and the application efficiency of the print liquid can be improved.

Figure 69:
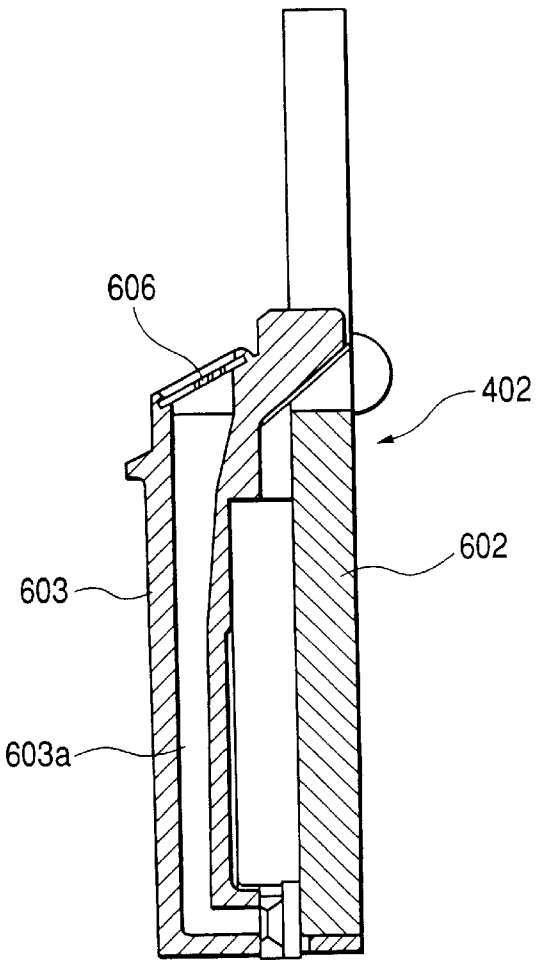
FIG. 69 is a cross-sectional view showing the head chip in the liquid jet head unit shown in FIG. 63.
Figure 68:
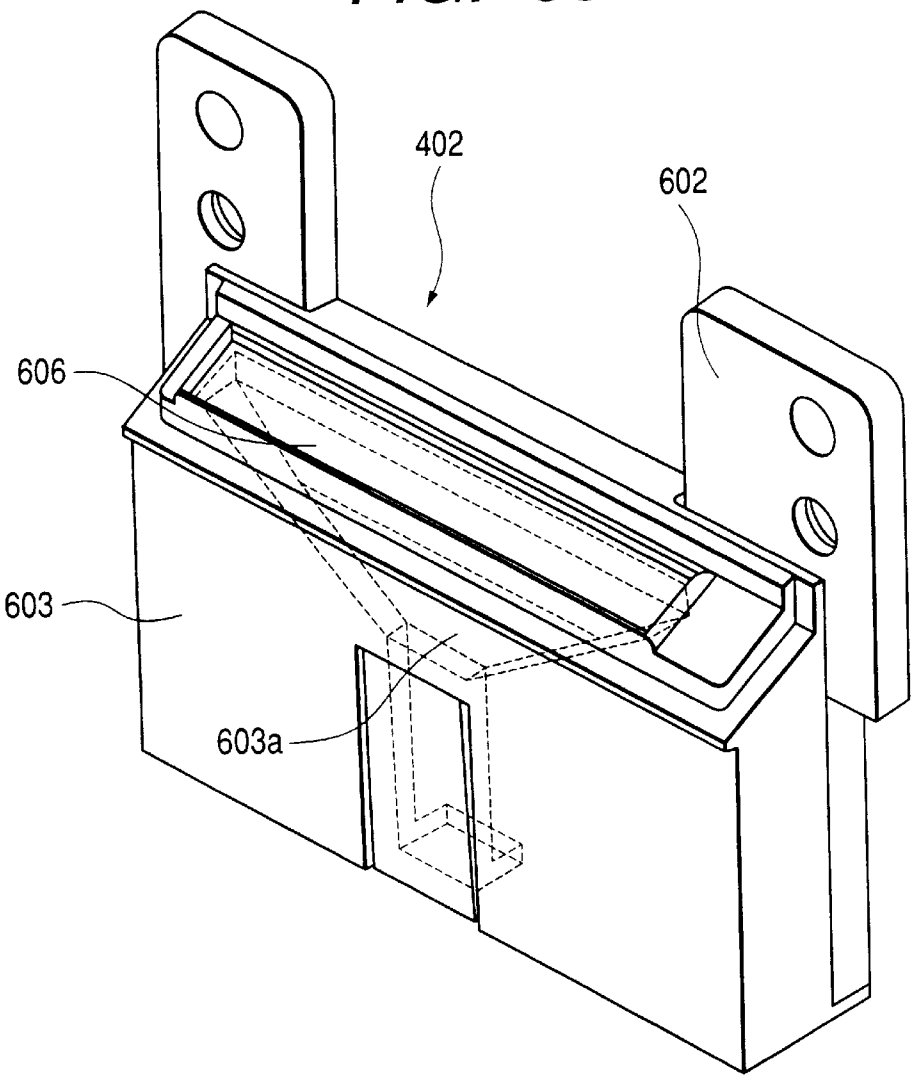
FIG. 68 is a perspective view showing a head chip in the liquid jet head unit shown in FIG. 63.

FIG. 68 is a perspective view showing only the head chip 402 of the liquid head unit 401 shown in FIG. 63 (a state where the unit frame 404 is omitted). FIG. 69 is a cross-sectional view of the head chip 402.

As shown in FIG. 68, a sectional area perpendicular to the flow direction of the connecting portion of the chip tank 603 to the second common liquid chamber 405 (refer to FIG. 63, etc.) at the flow path upstream side of the porous member 606, that is, at the second common liquid chamber 405 (refer to FIG. 63, etc.) is the maximum sectional area among the sectional areas perpendicular to the flow path direction of the print liquid supply path 603*a*.

Also, the porous member 606 is disposed obliquely with respect to the liquid flow direction of the print liquid supply path 603*a* of the chip tank 603. For that reason, the area of the porous member 606 is larger than the sectional area perpendicular to the flow path direction which is in the vicinity of the connecting portion of the chip tank 603 and the second common liquid chamber 405. In this embodiment, the area of the porous member 606 is about 20 times as large as the minimum sectional area of the print liquid supply path 603*a*.

According to the porous member 606 disposed as described above, the bubbles which are produced during the liquid discharge operation and ascends in the print liquid supply path 603*a* is trapped at the upper side (upstream side of the flow path) of the porous member 606 disposed obliquely. On the other hand, since the lower side (downstream side of the flow path) of the porous member 606 disposed obliquely is always in contact with the print liquid, the print liquid that flows to the print liquid supply path 603*a* of the chip tank 603 from the second common liquid chamber 405 through the porous member 606 does not stop to flow. Therefore, the print liquid of a constant flow amount necessary for discharging the liquid is supplied to the head chip 402.

Subsequently, a flow of bubbles in the print liquid supply path 603*a* of the chip tank 603 will be described with reference to FIGS. 70A to 70C.

Figure 70C:
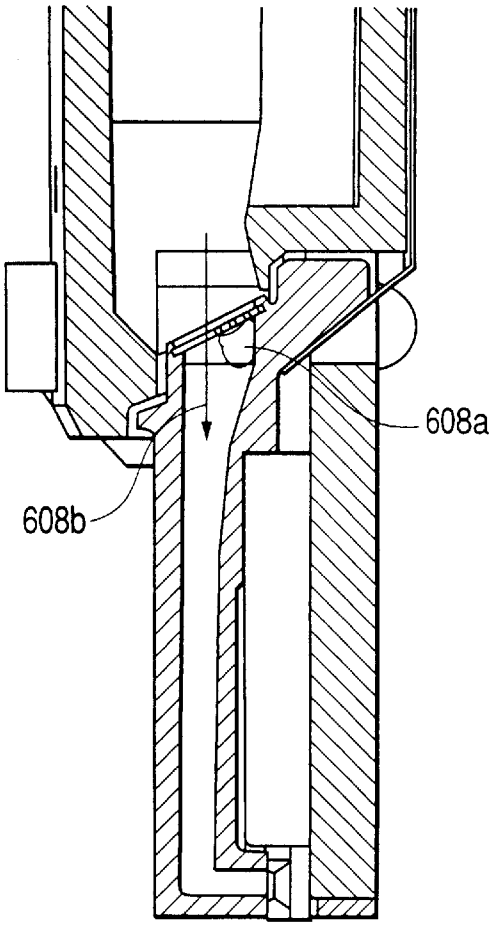
FIGS. 70A, 70B and 70C are cross-sectional views gradually showing a flow of bubbles in a print liquid supply path of the chip tank, respectively.
Figure 70B:
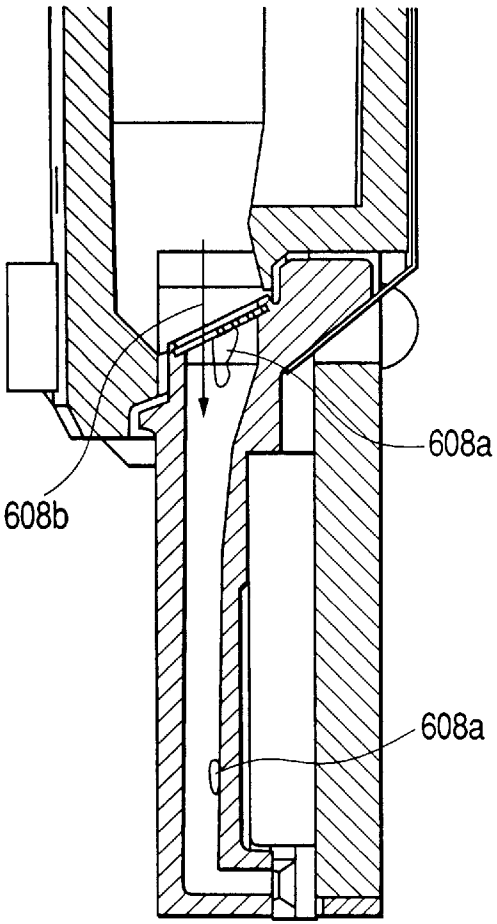
Figure 70A:
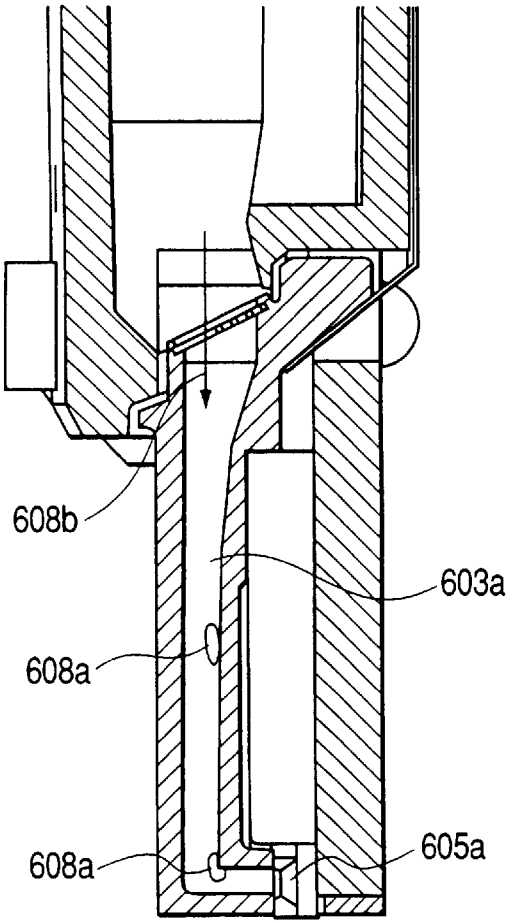

As shown in FIGS. 70A, bubbles 608*a* generated in the flow path by the discharge operation ascend in the print liquid supply path 603*a*. In this situation, the bubbles 608*a* do not yet reach the porous member 606. For that reason, since the entire area of the lower side of the porous member 606 is in contact with the print liquid, a sufficient flow path area is ensured, and a flow 608*b* of the print liquid from the second common liquid chamber 405 to the print liquid supply path 603*a* of the chip tank 603 through the porous member 606 is smooth.

In addition, as shown in FIG. 70B, the ascending bubbles 608*a* reach the porous member 606. Because the bubbles 608*a* cannot pass through the porous member 606 due to the surface tension, the bubbles 608*a* stay on the lower surface side of the porous member 606. Similarly, in this case, since the bubbles 608*a* do not cover the entire lower surface of the porous member 606, and the bubbles 608*a* do not grow to the degree that the bubbles 608*a* close the entire sectional area of the print liquid supply path 603*a*, a sufficient flow path area is ensured and the flow 608*b* of the print liquid is ensured.

As shown in FIG. 70C, the bubbles 608*a* that stay on the lower surface side of the porous member 606 move upward along the porous member 606 disposed obliquely with respect to the liquid flow direction of the print liquid supply path 603*a* and stay there. The print liquid flow path downstream side of the porous member 606 is ensured until the bubbles 608*a* cover the entire surface of the porous member 606, and the flow 608*b* of the print liquid is ensured until that time. In this embodiment, because the porous member 606 has an area about 20 times as large as the print liquid supply path, the flow of the print liquid is ensured for a corresponding period of time. In addition, the bubbles 608*a* that stay on the lower surface of the porous member 606 can be removed by appropriately conducting the recovery sucking operation.

A ratio of the flow path sectional area of a portion of the print liquid supply path 603*a* to which the porous member 606 is attached to the area of the porous member 606 can be selectively determined by changing an angle at which the porous member 606 is attached to the print liquid supply path 603*a*.

If the horizontal direction is 0°, when the attaching angle of the porous member 606 is set to 30°, the area of the porous member 606 is slightly larger than about 1.1 times of the flow path sectional area of the portion to which the porous member 606 is attached, when the attaching angle is 45°, the former is slightly larger than about 1.4 times of the latter, and when the attaching angle is 60°, the former is slightly larger than about 1.7 times of the latter. The ratio of area is decided by the outer diameter of the liquid jet head unit 401 or the assembling property adaptive to the structure, etc.

In the case where the porous member 606 is disposed perpendicularly to the gas ascending direction (the liquid flow direction of the print liquid supply path 603*a*), the bubbles 608*a* are liable to stay in the center of the print liquid supply path 603*a* on the lower surface side of the porous member 606. The bubbles 608*a* that stay there expands in the horizontal direction and are liable to close the flow path of the lower surface side of the porous member 606 if the bubbles 608*a* further grow. However, if the porous member 606 is obliquely arranged as described above, the bubbles that reach the porous member 606 stay above the print liquid supply path and do not expand in the horizontal direction even if the bubbles further grow. For that reason, the flow 608*b* of the print liquid is liable to be ensured on the lower side of the porous member 606. Accordingly, the recovery operation for ensuring the print liquid flow path can be reduced, and a reduction in the efficiency of the print liquid application and a reduction in the recording speed by conducting the recovery operation can be prevented.

In addition, in the case where the porous member 606 is obliquely arranged, the connecting portion of the chip tank 603 and the second common liquid chamber 405 is also oblique. For that reason, when the filler 607 with which the connecting portion is filled is injected from the upper side of the connection, since the filler 607 can smoothly flow in the connecting portion, the productivity of the liquid jet head is improved.

[Ink Tank Portion]

Figure 5:
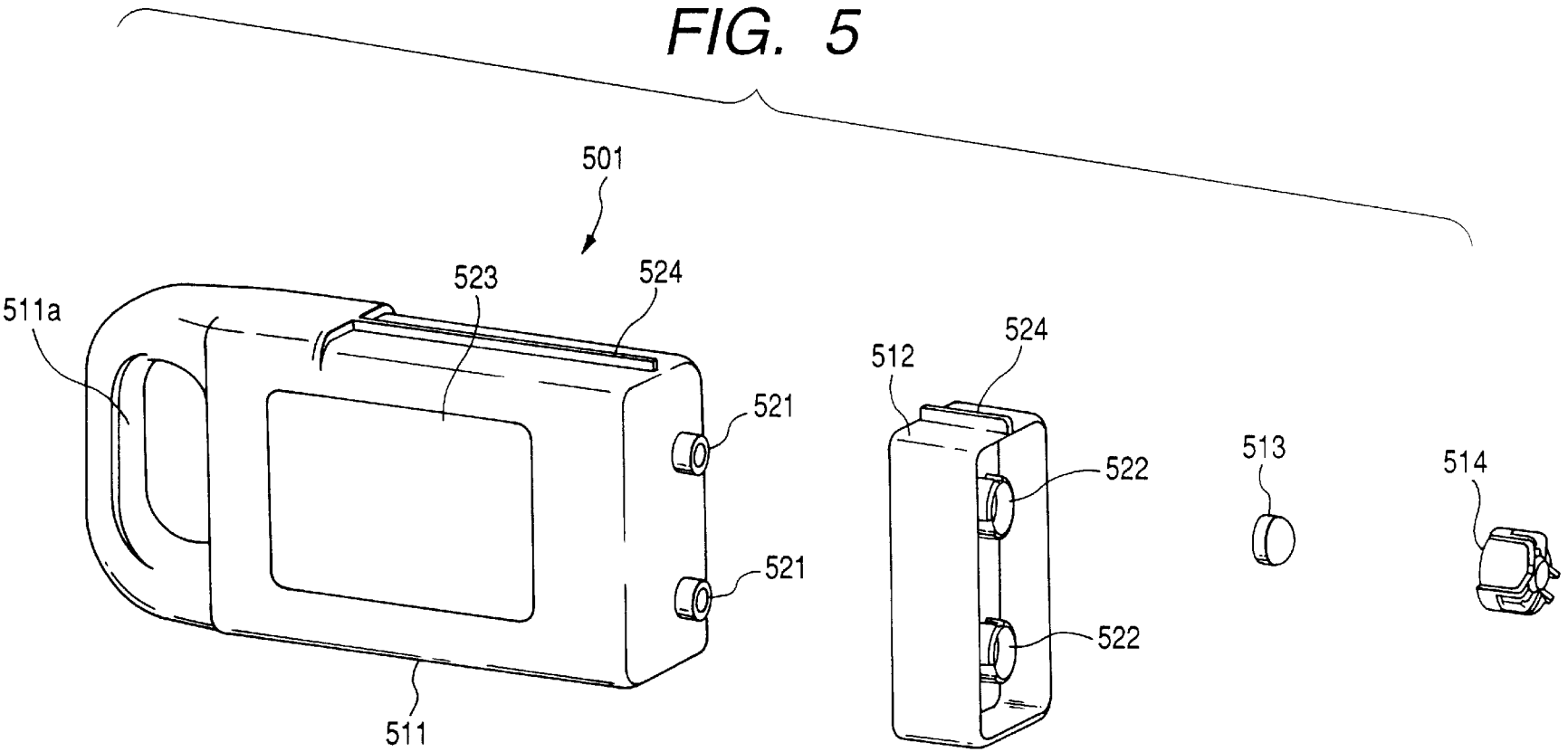
FIG. 5 is an exploded diagram showing a main tank.

FIG. 5 is an exploded perspective view showing an ink cartridge in accordance with the first embodiment of the present invention. An ink reserving chamber is made up of an ink container 511 and a cap 512 of the ink container 511. The ink container 511 is formed by the blow molding manner is equipped with a handle 511*a* for assisting the attachment or detachment of the ink cartridge with respect to the printing machine main body. In addition, a side surface of the ink container 511 is recessed to provide a space 523 to which a label for product identification is stuck.

The cap 512 is attached onto a housing 521 located on the ink container 511 by ultrasonic welding. Housings 522 that form communication ports, respectively, are disposed on the cap 512, and a dome-shaped elastic member (rubber stopper) 513 is assembled into each of the housings 522, and a crest 514 is assembled into each of the housings 522 as a fixing member. With this structure, connecting portions for ink circulation, etc., with the printing machine main body are formed, to thereby constitute an integral ink tank, that is, an ink cartridge.

The ink cartridge (liquid container) will be described in more detail.

Figure 71:
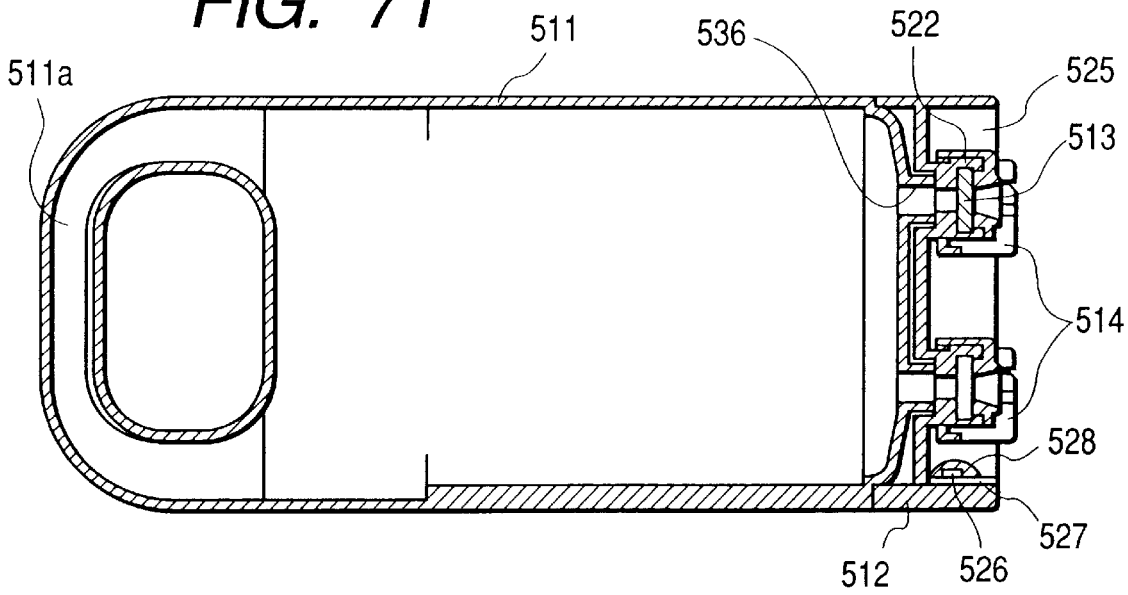
FIG. 71 is a cross-sectional view showing an ink cartridge in accordance with an embodiment of the present invention.
Figure 72:
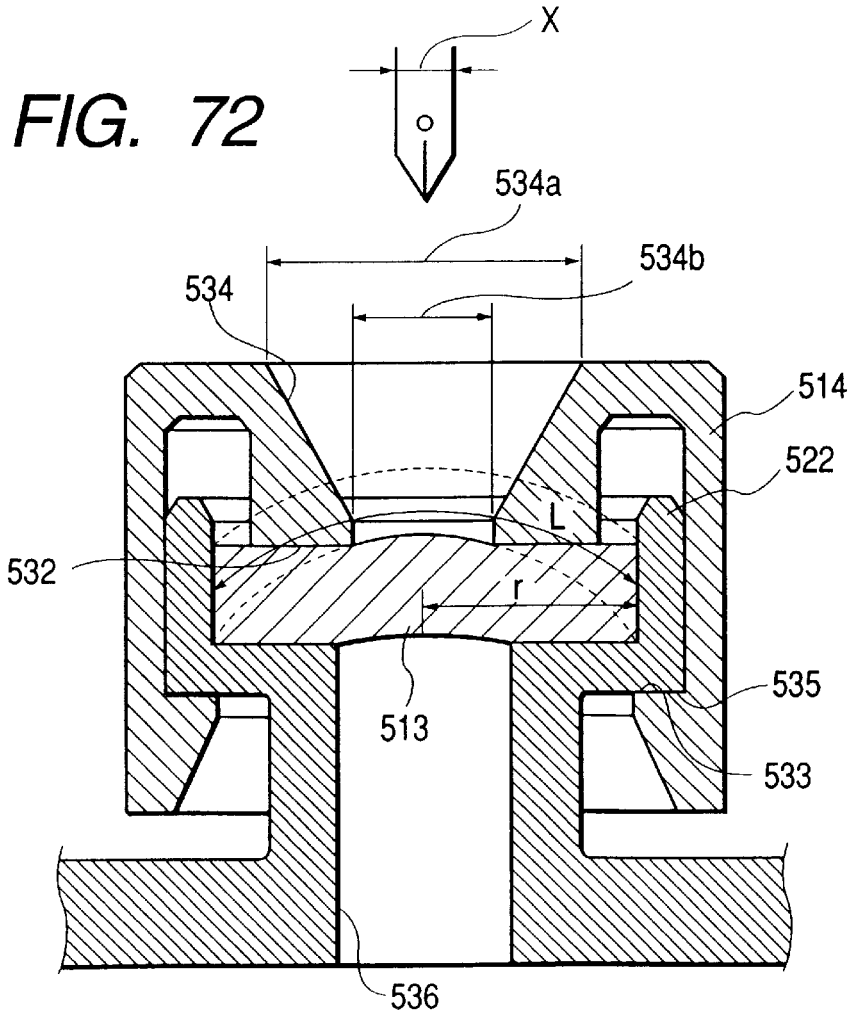
FIG. 72 is an enlarged view showing the periphery of a connecting portion of the ink cartridge shown in FIG. 71.
Figure 73:
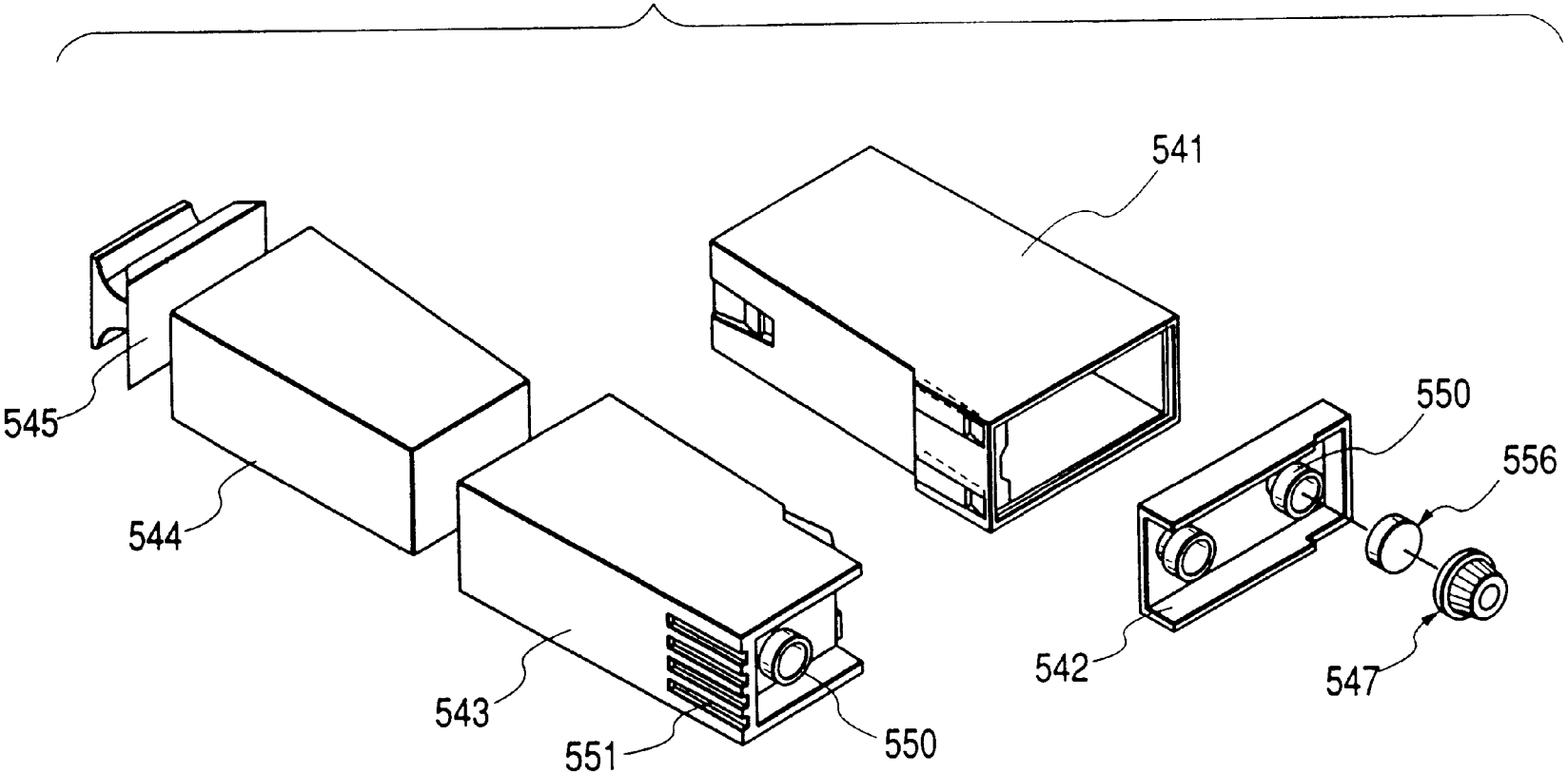
FIG. 73 PRIOR ART
FIG. 73 is an exploded perspective view showing a conventional example of the ink tank.

FIG. 71 shows a cross-sectional view of the ink cartridge. FIG. 72 is an enlarged view of the connecting portion in the cross-sectional view of the ink cartridge shown in FIG. 71.

The housing 521 is cylindrically shaped so as to be disposed around two holes for supplying the ink. A surface of the ink container 511 on which the housing 521 is formed is joined with the cap 512, and the cap 512 includes a hole which is inserted into the housing 521 of the above-described ink container 511, a communication portion 536 which is a circular hole that communicates with that hole, the housing 522 cylindrically formed around the communication portion 536, a wall 525 which is formed so as to surround the two housings 522, constitutes the outer peripheral portion of the ink cartridge and protects an operator's hand from entering the interior of the housing 521, etc.

Also, a convex portion (rib) 524 which serves as a guide for surely connecting the ink cartridge to the connection port of the printing apparatus main body is disposed on the side surface of the ink cartridge over the side surface of the ink container 511 and the wall 525 portion of the cap 512. That is, when the convex portion 524 is slid in a state where the convex portion 524 is inserted into a groove of the rail 29 on the main body side as shown in FIG. 3, the main body connecting portion and the ink cartridge can be surely connected to each other.

The wall 525 is equipped with a storage medium 526 (an EEPROM (electrically erasable programmable read only memory is used in this embodiment) for storing the monitor information, the control information, the identification information, the liquid amount information, or the manufacturer information on the main body and the liquid container, and a connecting terminal 527 to the main body. The storage medium 526 and a contact of the storage medium 526 and the connecting terminal 527 are covered with a sealant 528 so as to be protected.

Figure 77:
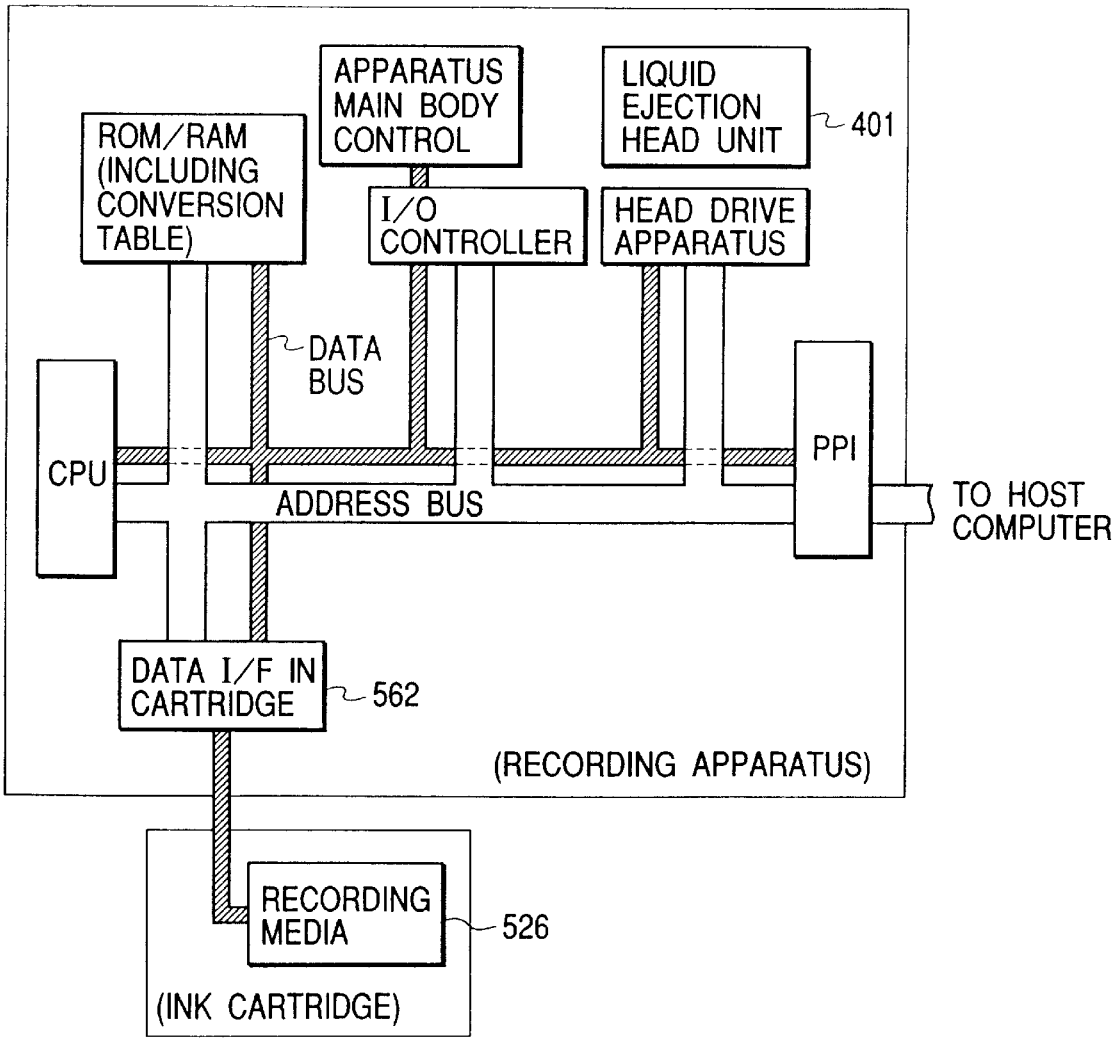
FIG. 77 is a block diagram showing an appearance of the connection of a storage medium of the ink tank shown in FIG. 71 and a main body of the printing apparatus.

FIG. 77 is a block diagram showing the appearance of the connection of the storage medium 526 and the main body. With the connection of the ink tank to the main body, the storage medium 526 equipped in the ink tank is connected to an interface 562 of the main body side, the information in the storage medium 526 is transmitted to the main body, and the information is employed for control of the liquid jet head unit 401 in the main body.

The opening portion of the housing 522 disposed so as to surround the periphery of the communication portion 536 of the cap 512 is fixed with the dome-shaped elastic member 513 by the crest 514 attached so as to cover the housing 522, and the connecting portion with the apparatus main body for ink circulation is formed by the communication portion 526, the housing 522, the elastic member 513 and the crest 514. As shown in FIG. 71, the height of the connecting portion is higher than the height of the wall 525, and the tip of the connecting portion, that is, the tip of the crest is projected from the wall 525.

In order to reduce the manufacturing costs, it is desirable that the crest 514 and the elastic member 13 are integrally manufactured by the two-color molding method.

FIG. 72 shows the detailed diagram of the connecting portion. As shown in the figure, the crest 514 is so equipped as to cover the housing 522 and fixed by engaging an engaging portion 535 of the housing 522 with a claw portion 533. The crest 514 is disposed with a pressing portion 532 that presses the elastic member 513 in an axial direction of the elastic member 513. The elastic member 513 is shaped as indicated by a broken line before the elastic member 513 is assembled with the crest 514, but assembled so as to be suited to the inner configuration of the housing 522 as indicated by a solid line by the pressure from the pressing portion 532 of the crest 514 in a state where the elastic member 513 is elastically deformed so as to be in close contact with the housing 522. In other words, a diameter L in a state where no stress of the elastic member 513 is applied is larger than an inner diameter 2r of the housing 522, and the elastic member 513 in a state where the elastic member 513 is pressed by the crest 514 produces a restoring force which is going to make the elastic member 513 spread in the radial direction of the housing 522, thereby coming to a state where a force which is going to make the elastic member 513 contract in the radial direction in an opposite direction of the restoring force is applied from the housing 522.

An opening portion 534 for guiding a needle 534 for ink circulation in the printing apparatus main body is formed on a top surface of the crest 514, and the width of the top end 534*a* is made larger than that of the rear end 534*b* so that the needle 534 is surely guided substantially in the center of the elastic member. When the ink cartridge is installed in the printing apparatus main body, a needle 52 penetrates the elastic member 513 to form an ink circulation path. When the ink cartridge is detached from the printing apparatus main body, the needle 52 is drawn off from the elastic member 513. However, since the hole cut in the elastic member 513 by the needle 52 is closed by a force applied from the housing 522 which is going to contract the elastic member 513 in the radial direction, the ink which is the content does not seep out of the hole.

Figure 76A:
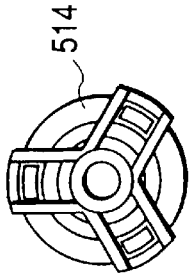
FIGS. 76A and 76B are enlarged views showing a crest member of the ink cartridge shown in FIGS. 75A and 75B, respectively.
Figure 76B:
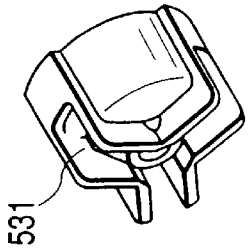
Figure 74:
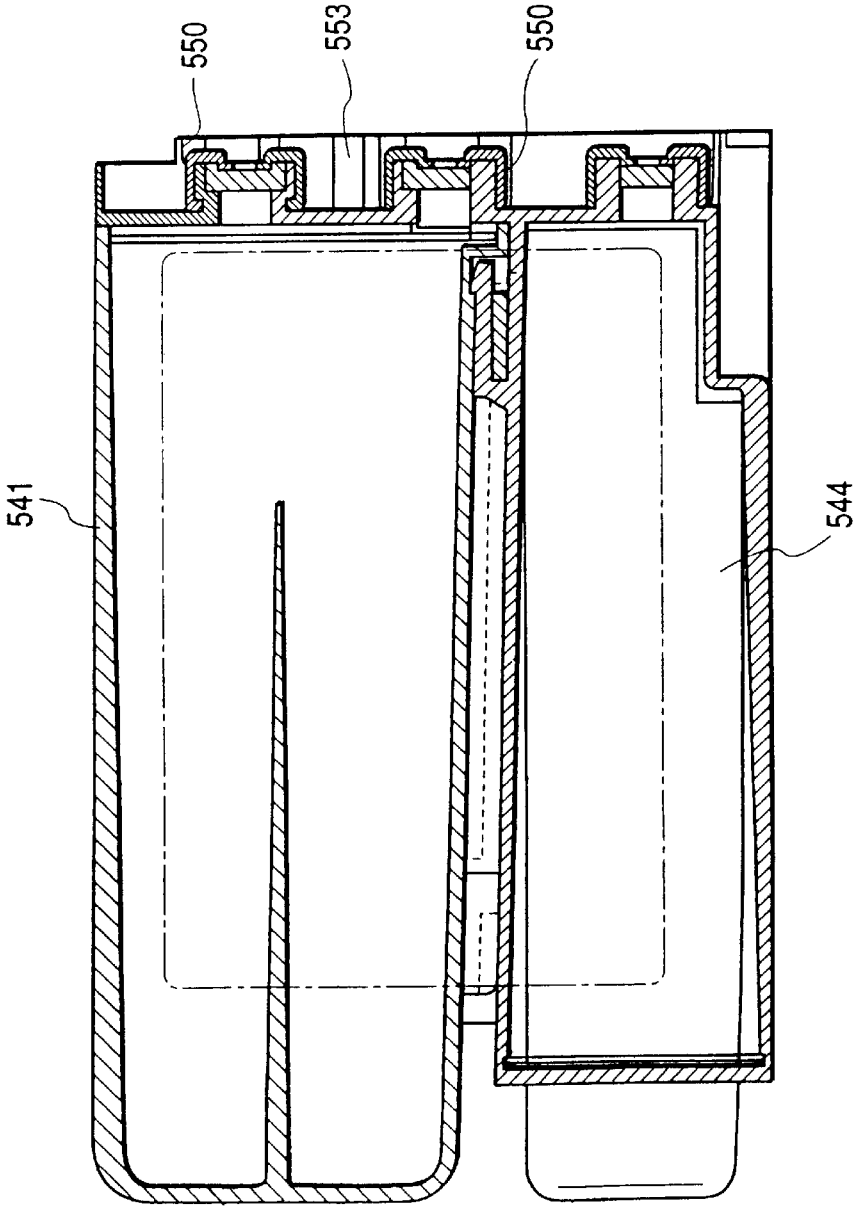
FIG. 74 PRIOR ART
FIG. 74 is a cross-sectional view showing the ink tank shown in FIG. 73.
Figure 75B:
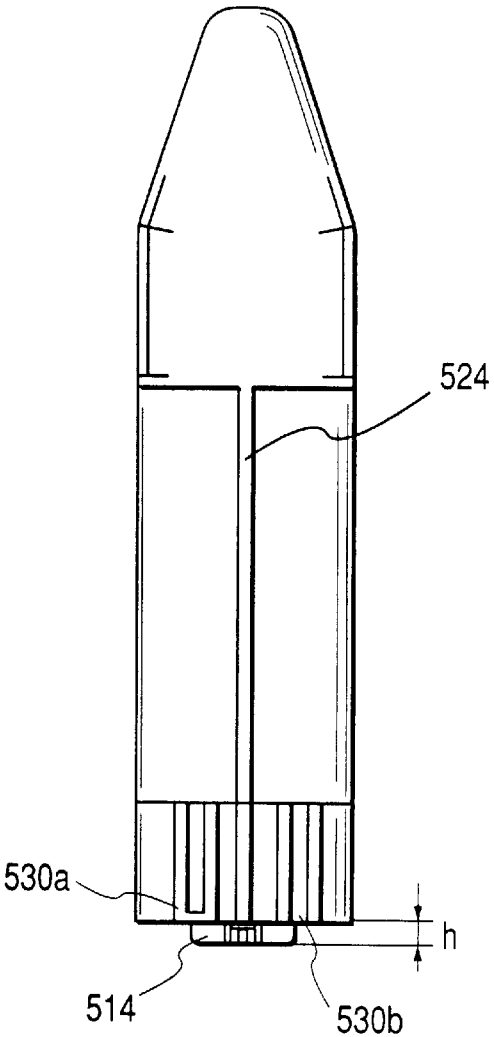
FIGS. 75A and 75B are schematic views showing an ink cartridge in accordance with another embodiment of the present invention, respectively.
Figure 75A:
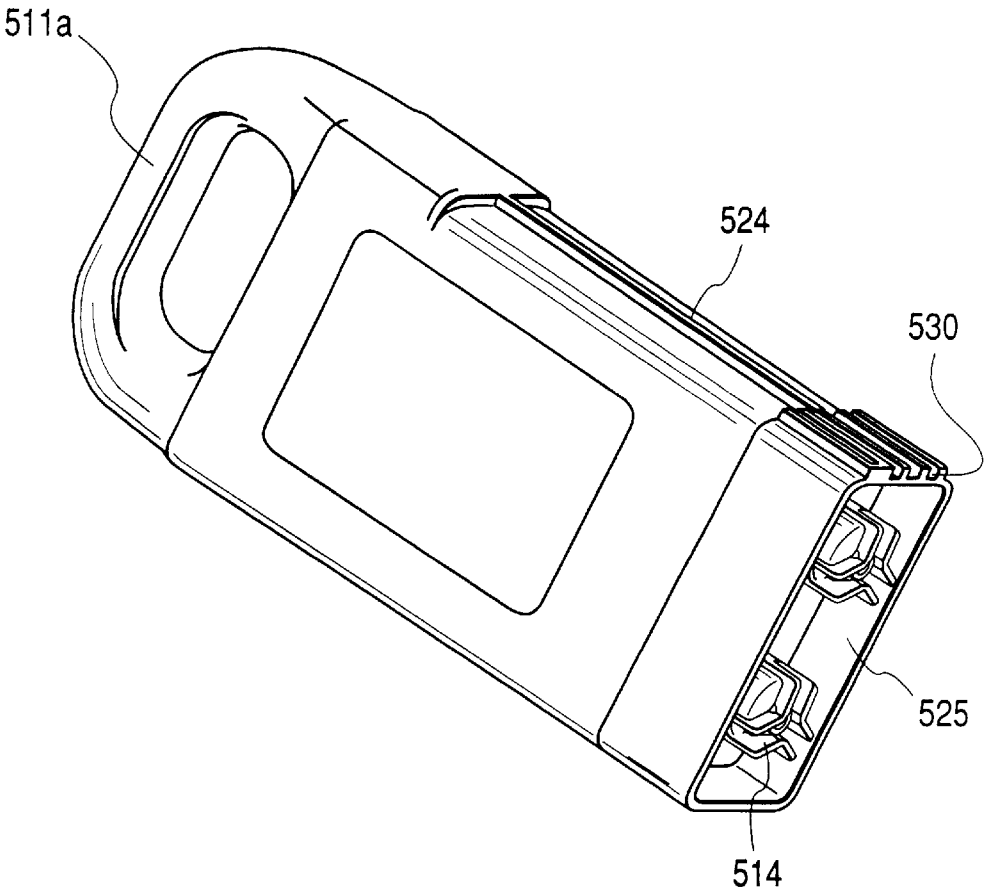

Modified examples of the ink cartridge shown in FIGS. 5, 71 and 72 are shown in FIGS. 75A, 75B and 76A, 76B. FIG. 75A is a perspective view of an ink cartridge in accordance with a modified example, and FIG. 75B is a side view of the ink cartridge. FIGS. 76A and 76B are enlarged views of the crest 514 in which FIG. 76A is a front view of the crest 514 and FIG. 76B is a perspective view of the crest 514.

The ink cartridge shown in FIGS. 75A and 75B is formed with a plurality of grooves 530 on the side surface of the wall 525. The groove 530 includes grooves 530*a* which are partially closed and grooves 530*b* which are not closed, and the combination of those different grooves 530*a* and 530*b* constitutes a mechanical key mechanism for connection to the printing apparatus main body. In other words, the combinations of the grooves 530 are changed for each kind of the ink cartridges, and rails 560 that coincide with the grooves 530, respectively, are provided on the connected main body side as shown in FIGS. 3 and 4, as a result of which even if an ink cartridge of a kind different from the ink cartridge to be intentionally equipped is going to be inserted into the main body, the insertion can be prevented.

Also, the height of the crest 514 or the projected amount h from the wall 525 is changed for each kind of the ink cartridges, and the heights of a needle 52 and a needle base 51 which form a connection base of the ink cartridge which is disposed on the main body side are changed for each of the ink cartridges to be equipped so as to be adapted to the height of the crest 514. With this structure, even if an ink cartridge of a kind different from the ink cartridge to be intentionally equipped is going to be inserted into the main body, the insertion can be prevented.

Further, grooves 531 are formed on the side surface of the crest 514, and a connection member which coincides with the grooves 531 is disposed in the printing apparatus main body, thereby being capable of guiding the insertion of the main body.

Subsequently, a case in which the user drops down the ink cartridge according to this embodiment in error will be described. In the case where the ink cartridge drops down in a state where the user holds the handle 511*a,* the ink cartridge comes in contact with a floor from a surface of the ink cartridge on which the connecting portion is formed. In this situation, since the connecting portion is projected from the wall 525 as described above, the largest impact caused by the first contact of the ink cartridge with the floor to which the ink cartridge drops down is applied to not the wall 525 but the connecting portion. For that reason, the wall 525 and the convex portion 524, the groove 530, the storage medium 526 and the connecting terminal 527 which are located on the wall 525 can be prevented from being destroyed and failing in function. In addition, since the impact applied to the connecting portion is transmitted to the elastic member 513 through the pressing portion 532 of the crest 514, and the impact can be absorbed by the elastic deformation, it is difficult to damage the connecting portion, and the impact indirectly transmitted to the wall 525 is made small, thereby being capable of preventing the operating failure of the storage medium 526 which is weak to impact from occurring.

In this embodiment, the liquid container that supplies the liquid to the printing apparatus main body was described. However, the present invention is also applicable to the liquid container that retains the liquid discharged from the printing apparatus main body which does not contribute to printing and is disused.

In the head described in this embodiment, a case in which the head is applied to the printing apparatus for the envelope and the continuous sheet which can be appropriately cut was described. However, the present invention is not limited to or by this structure but applicable to a normal printer using plain paper.

In the present specification, "print" (also "record") means not only a case in which significant information such as a character or a figure is formed, but also a case in which an image, a pattern or the like is formed on a printing medium or a medium is processed by a broad meaning regardless of the significance or insignificance, and also regardless of information being visualized so as to be visible by humans, or not.

In the present specification, "printing medium" means not only a paper used in the normal printing apparatus but also an ink receptive material such as a cloth, plastic, a film, a metal plate, glass, ceramic, wood or leather by a broad meaning.

In addition, "ink" (also "liquid") should be interpreted widely similar to the definition of "print" and means a liquid which can be subjected to the formation of an image, a pattern or the like, the processing of the printing medium, or the processing of an ink (for example, solidification or insolublity of a coloring material in the ink which is given to the printing medium).

A mode where the present invention is effectively used is a mode in which a film boiling is produced in a liquid by using a thermal energy generated by an electrothermal converting member to form bubbles.

As was described above, the present invention can provide an ink tank in which it is difficult to cause a damage by which the failure of connection with the printing apparatus main body occurs and which is high in impact resistance even if a user drops it by mistake. In order to enhance the resistance to the impact, since a member such as a cushioning material is not used, the manufacturing costs are not increased.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A liquid container for storing a liquid to be supplied to a recording head of a printing apparatus, said liquid container being removably mountable to the printing apparatus, said liquid container comprising:

a main container body defining a space for storing the liquid; and a connecting portion provided on a side surface of said main container body, said connecting portion being connectable to a supply route used for supplying the liquid to the recording head, wherein a most forward leading edge of said connecting portion is projected outwardly beyond a most forward leading edge of the side surface of said main container body and is elastically displaceable.

2. The removable liquid container as claimed in claim 1, said removable liquid container having a hole in the side surface of said main container body, wherein said connecting portion comprises:

a housing formed so as to surround the hole, said housing having an opening portion exposing the hole;

an elastic member mounted within the opening portion of said housing, said elastic member covering the hole; and a crest member disposed so as to cover said housing and fixedly press said elastic member within the opening portion of said housing.

3. The removable liquid container as claimed in claim 2, wherein said housing is in the form of a cylinder and said elastic member is substantially dome shaped having a maximum diameter larger than an inner diameter of said housing, wherein said elastic member is compressed in a radial direction when mounted within the opening portion of said housing.

4. The removable liquid container as claimed in claim 2, wherein said elastic member and said crest member are integrally molded by a bicolor mold.

5. The removable liquid container as claimed in claim 1, said removable liquid container further comprising a first concave portion or convex portion formed on a wall of said removable liquid container, wherein said removable liquid container can be inserted into a main body of the printing apparatus by engaging the first concave portion or convex portion with a second convex portion or concave portion formed on the main body of the printing apparatus and sliding said removable liquid container in an engaged state into the main body of the printing apparatus.

6. A printing apparatus comprising:

the removable liquid container as claimed in claim 5; and the second convex portion or concave portion formed on the main body of said printing apparatus, wherein said removable liquid container is mounted in the main body of said printing apparatus by engaging said first concave portion or convex portion of said removable liquid container with said second convex portion or concave portion and sliding said removable liquid container into the main body in an engaged state.

7. The removable liquid container as claimed in claim 1, said removable liquid container further comprising a first set of up to a plurality of grooves, a pattern of which is different for each type of a plurality of types of removable liquid containers, formed on a wall of said removable liquid container, wherein said first set of up to a plurality of grooves is engaged with a second set of up to a plurality of grooves, a pattern of which is different for each type of the plurality of types of removable liquid containers, formed on a main body of the printing apparatus when said removable liquid container is inserted into the main body of the printing apparatus.

8. A printing apparatus comprising:

the removable liquid container as claimed in claim 7; and the second set of up to a plurality of grooves, a pattern of which is different for each type of the plurality of types of removable liquid containers, formed on the main body of said printing apparatus, wherein said removable liquid container is mounted in the main body of said printing apparatus and said first set of up to a plurality of grooves is engaged with said second set of up to a plurality of grooves.

9. The removable liquid container as claimed in claim 1, further comprising:

a storage medium; and an interface for electrically connecting said storage medium and a main body of the printing apparatus, wherein said storage medium and said interface are disposed on a wall of said removable liquid container.

10. A printing apparatus comprising:

the removable liquid container as claimed in claim 9;

a circuit for reading information stored in said storage medium; and a printing apparatus operation controller for controlling said printing apparatus according the stored information.

11. The printing apparatus as claimed in claim 10, further comprising a processor for changing the stored information in said storage medium.

12. The removable liquid container as claimed in claim 1, wherein said connecting portion comprises a first convex portion or concave portion formed on a side surface of said connecting portion, wherein said first convex portion or concave portion is engaged with a second concave portion or convex portion formed on a main body of the printing apparatus to guide insertion of said removable liquid container into the main body of the printing apparatus.

13. The removable liquid container as claimed in claim 1, wherein a height of said connecting portion from the side surface of said main container body on which said connecting portion is provided is different for each type of a plurality of types of removable liquid containers.

14. A printing apparatus comprising:

the removable liquid container as claimed in claim 13; and a connecting base connected to said connecting portion, wherein a height of said connecting base connected to said connecting portion is different for each type of the plurality of types of removable liquid containers in correspondence with the height of said connecting portion of said removable liquid container.

15. A printing apparatus comprising the removable liquid container as claimed in claim 1.

* * * * *

UNITED STATES PATENT AND TRADEMARK OFFICE

CERTIFICATE OF CORRECTION

PATENT NO. : 6,554,411 B1
DATED : April 29, 2003
INVENTOR(S) : Nobuyuki Hatasa et al.

It is certified that error appears in the above-identified patent and that said Letters Patent is hereby corrected as shown below:

Column 9,
Line 36, “holes-up” should read -- holes up --.

Column 16,
Line 5, “the” should be deleted.

Column 29,
Line 67, “level” should read -- lever --.

Column 32,
Line 25, “power.” should read -- power --.

Column 37,
Line 12, “because” should be deleted.

Column 38,
Line 34, “liquid.” should read -- liquid --.

Column 48,
Line 25, “the” should read -- to the --.

Signed and Sealed this

Second Day of December, 2003

JAMES E. ROGAN
*Director of the United States Patent and Trademark Office*